US008474353B1

(12) United States Patent
Thoman

(10) Patent No.: US 8,474,353 B1
(45) Date of Patent: Jul. 2, 2013

(54) MANUAL DUAL END ROTARY DRIVER OF Z CONFIGURATION

(76) Inventor: Timothy Michael Thoman, Tulsa, OK (US)

( * ) Notice: Subject to any disclaimer, the term of this patent is extended or adjusted under 35 U.S.C. 154(b) by 207 days.

(21) Appl. No.: 12/941,975

(22) Filed: Nov. 8, 2010

(51) Int. Cl.
*B25B 23/16* (2006.01)

(52) U.S. Cl.
USPC ..... 81/177.6; 81/177.7

(58) Field of Classification Search
USPC ..... 81/177.5, 177.6, 177.7, 177.85, 28, 81/64, 65.2
See application file for complete search history.

(56) References Cited

U.S. PATENT DOCUMENTS

| | | | | | |
|---|---|---|---|---|---|
| 1,431,389 | A | * | 10/1922 | Frisz | 81/177.7 |
| 1,775,402 | A | * | 9/1930 | Mandl | 81/177.75 |
| 2,712,765 | A | | 7/1955 | Knight | |
| 2,951,405 | A | * | 9/1960 | Engquist | 81/440 |
| 4,334,445 | A | | 6/1982 | Timewell | |
| 5,349,886 | A | | 9/1994 | Jin | |
| 5,421,180 | A | * | 6/1995 | Rojdev | 70/456 R |
| 5,797,300 | A | * | 8/1998 | Fairbanks | 81/60 |
| 5,943,925 | A | * | 8/1999 | Huang | 81/177.2 |
| 6,145,413 | A | * | 11/2000 | Lin | 81/63.1 |
| 6,640,672 | B1 | | 11/2003 | Cheng | |
| 6,662,688 | B1 | * | 12/2003 | Avery | 81/124.5 |
| 7,197,965 | B1 | | 4/2007 | Anderson | |
| 7,299,718 | B2 | | 11/2007 | Hsieh | |
| 7,328,634 | B1 | * | 2/2008 | Greenberg et al. | 81/73 |
| 7,975,578 | B2 | * | 7/2011 | Youtsey | 81/467 |
| 2003/0061915 | A1 | * | 4/2003 | Wang | 81/177.6 |
| 2007/0214916 | A1 | * | 9/2007 | Lee | 81/177.1 |
| 2011/0005359 | A1 | * | 1/2011 | Su | 81/177.7 |

* cited by examiner

*Primary Examiner* — David B Thomas

(57) ABSTRACT

Multiple embodiments of a manual tool, for ergonomic, controlled and variable application of rotary motion, torque, and or axial force to an object. One embodiment is comprised of three elongated members connected at their ends in a chain by two pivoted joints. The two outboard members each have an outboard end shaped for connecting to an object to be rotated and a rotatable handle. One way to use the tool is to grasp each handle with a hand; one hand holds the tool in axial alignment and engaged with the object to be rotated and the other hand orbits about the other handle. The three members can be fluidly positioned in a nearly straight Z, crank, L or in-line shape, so as to vary and control the speed, torque, and force. Either end of the tool may be used to rotate an object by swapping the tool end for end.

10 Claims, 28 Drawing Sheets

Figure 1A:
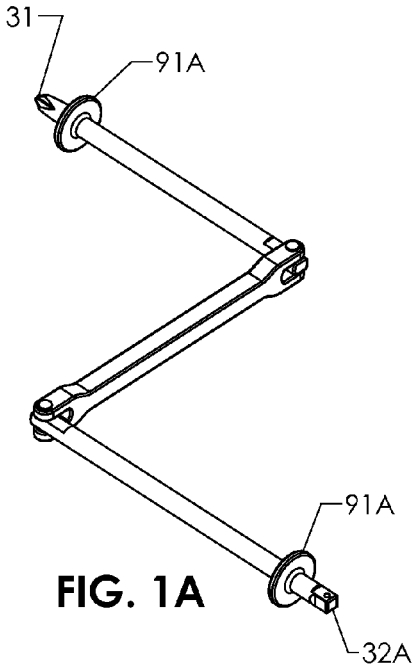

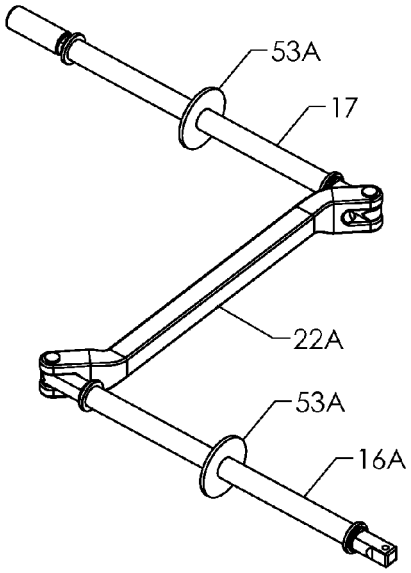
FIG. 4A
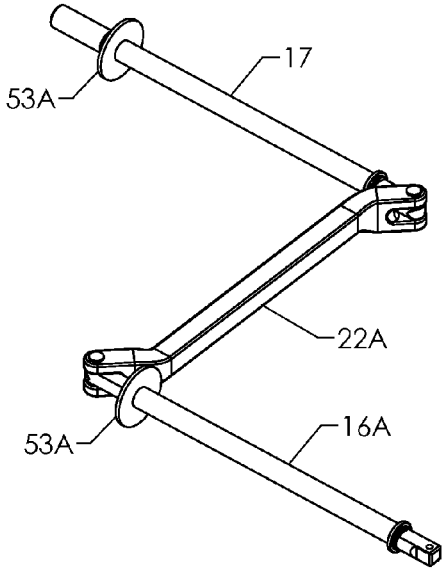
FIG. 4B
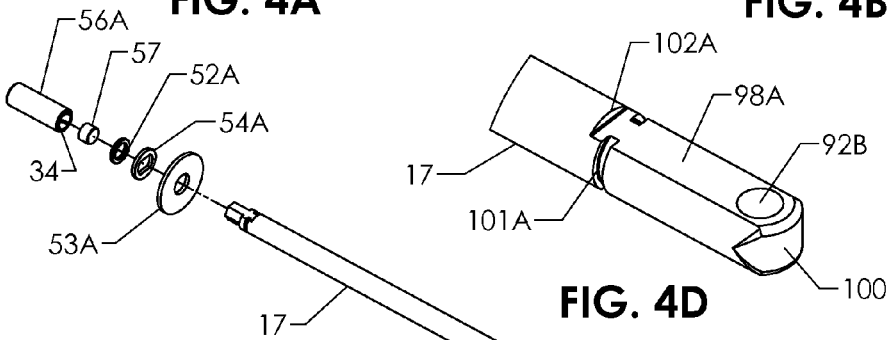
FIG. 4D
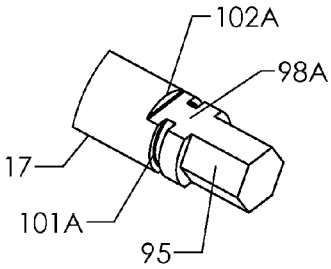
FIG. 4G
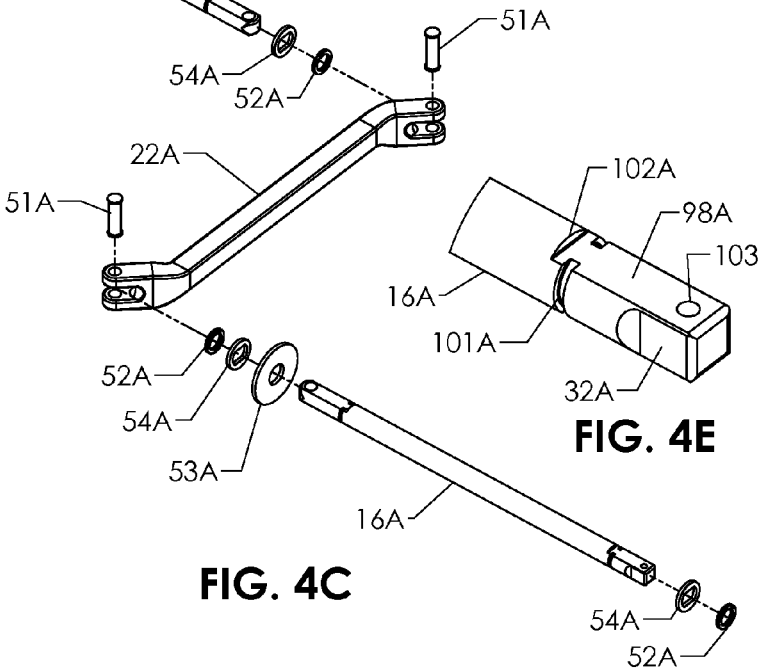
FIG. 4E
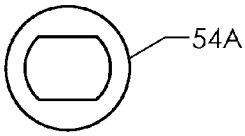
FIG. 4F
FIG. 4C

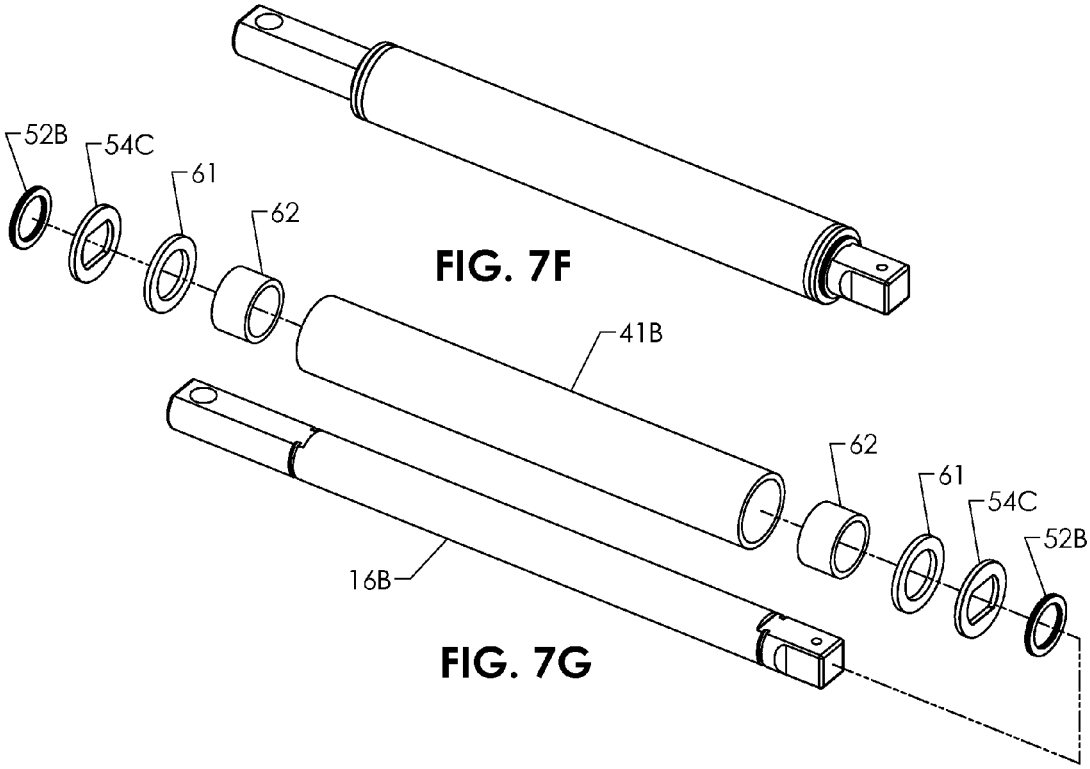
FIG. 7F
FIG. 7G
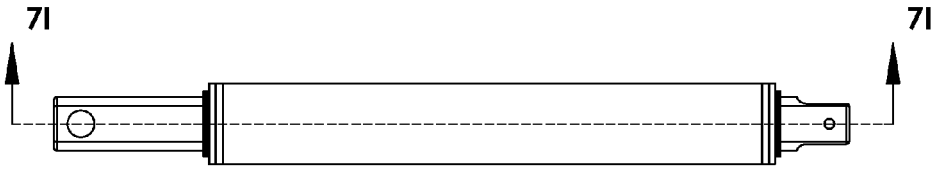
FIG. 7H
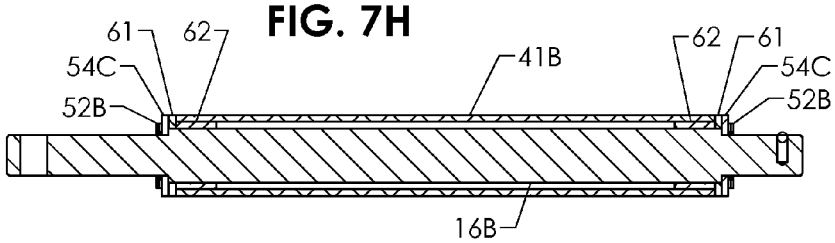
FIG. 7I

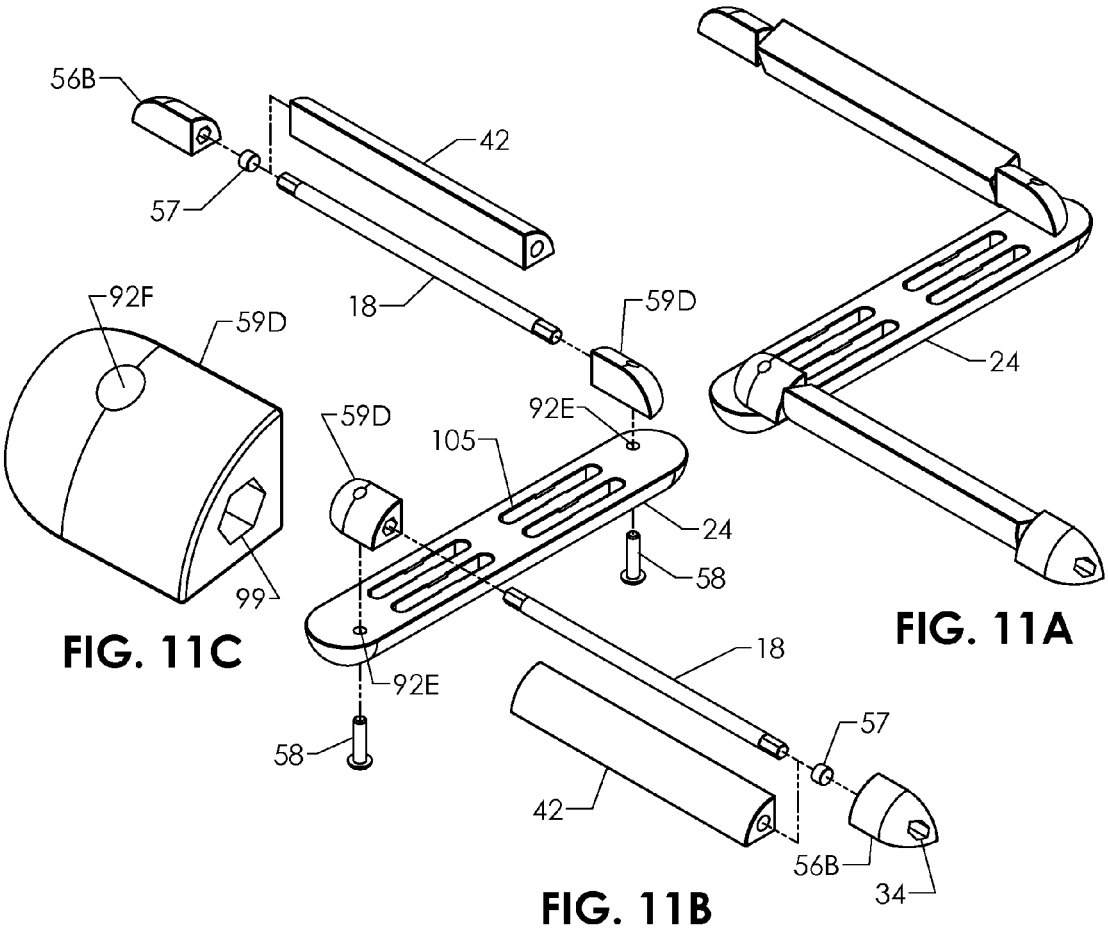
FIG. 11C
FIG. 11A
FIG. 11B
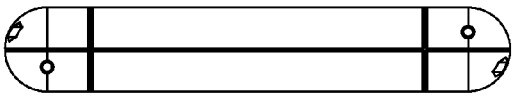
FIG. 11E
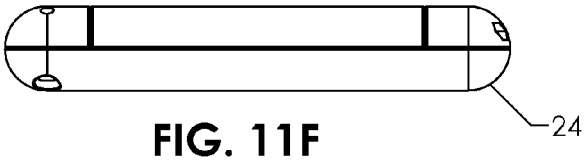
FIG. 11F
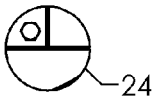
FIG. 11H
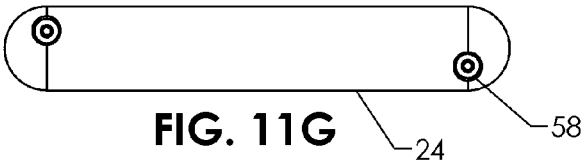
FIG. 11G
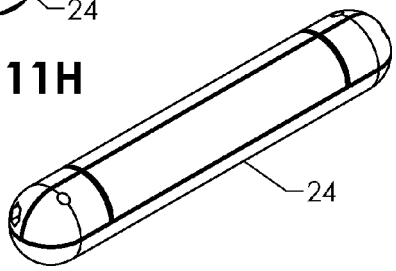
FIG. 11D

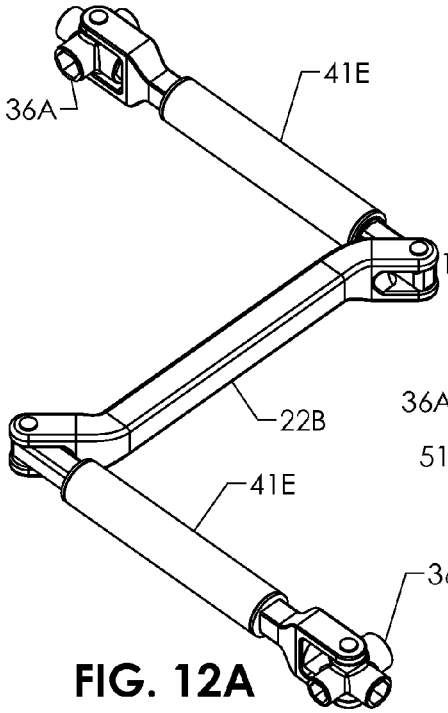
FIG. 12A
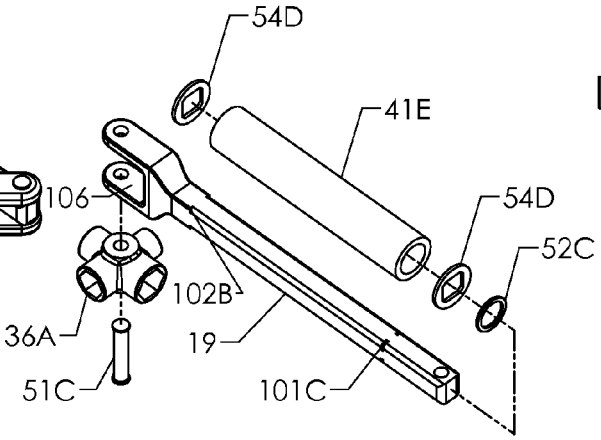
FIG. 12B
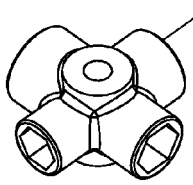
FIG. 12C
FIG. 12G
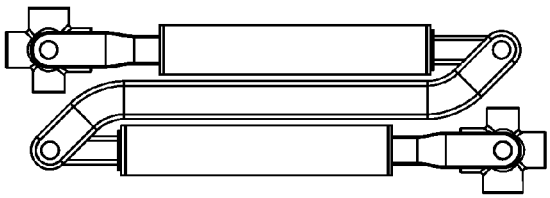
FIG. 12D
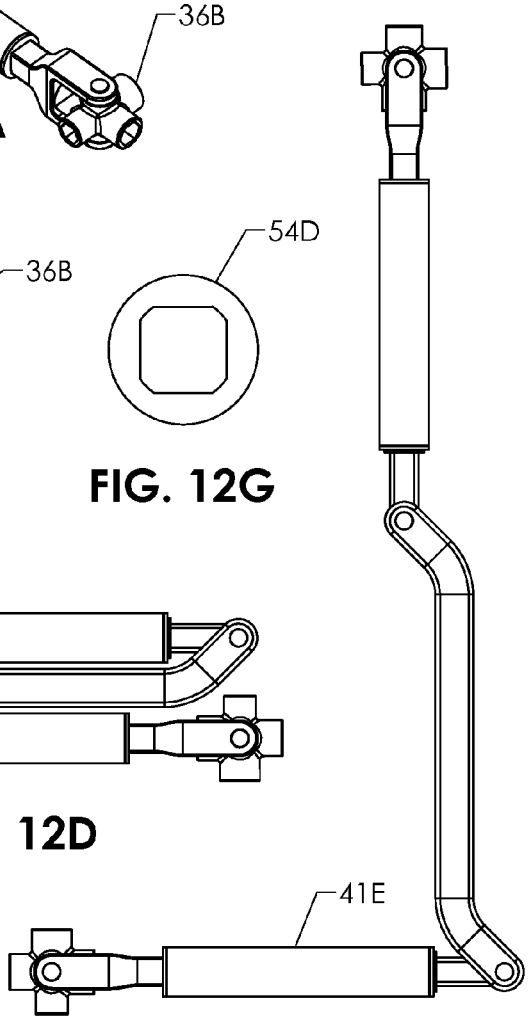
FIG. 12E
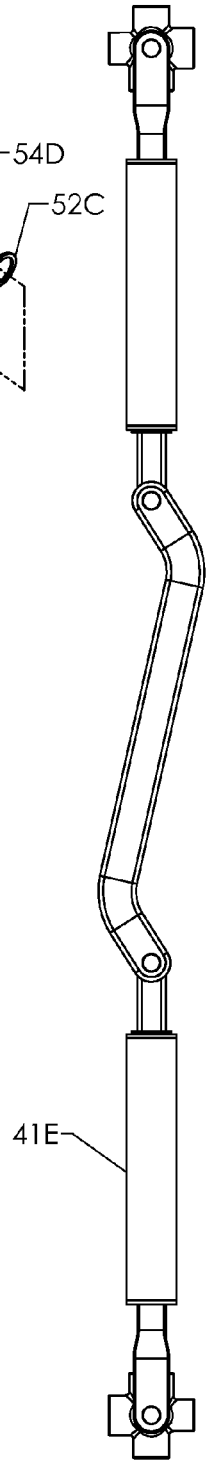
FIG. 12F

MANUAL DUAL END ROTARY DRIVER OF Z CONFIGURATION

CROSS-REFERENCE TO RELATED APPLICATION

Not Applicable

FEDERALLY SPONSORED RESEARCH

Not Applicable

SEQUENCE LISTING OR PROGRAM

Not Applicable

BACKGROUND

1. Field

This application relates to hand tools used for applying rotary motion to objects, specifically to an improved manually operated, dual grip, dual end design that allows the rotational speed, direction, and torque to be ergonomically and easily applied, varied, and controlled.

2. Prior Art

Applying rotary motion to objects such as screws, bolts, sockets, hex bits, drill bits, shafts, generators, drives, etc. has been done via a multitude of manually operated and powered hand tools. Most have drawbacks such as too slow, too fast, inadequate torque, heavy, fatigues user quickly, needs a power cord or power source. A simple straight screw driver is slow, may require a very firm grip, fatigues the hand and arm quickly, and requires repeated stopping and regripping. A ratcheting screw driver requires repeated stopping and reversing and also fatigues the hand and arm quickly. A Yankee-Style (spiral drive) screw driver turns when the handle is on the push stroke but then requires a pull stroke, opposite the bit engaging force, during which it does not turn. To change rotation direction requires stopping and moving a switch. It can be hard to hold this screw driver aligned and engaged with a screw. A ratchet screw driver or wrench requires repeated stopping and reversing. Reversing a ratchet screw driver or ratchet wrench requires stopping and turning a sleeve or flipping a lever. A pneumatic driver requires connection to a compressed air supply via a hose that must be long enough to reach the work. The hose can get tangled or caught on things. The weight and drag of the hose must be counteracted when using the pneumatic driver.

A corded electric driver may be heavy, requires connection to a power source via an electrical cord long enough to reach the work. The cord may get tangled or caught on things. The weight and drag of the cord must be counteracted when using the electric driver. Electric drivers should not be used in wet environments due to the potential for electric shock and cannot be used underwater unless of special sealed design. Electric drivers can be noisy and objectionable in areas or situations requiring quiet, such as a library, workplace, hospital or stealth military operation. A battery powered drill can be heavy, lack torque, and must be periodically recharged at a power source. If the battery does not have a charge or loses charge then it can't be used until it is charged, which may take a long time. An electric driver, even if variable speed and high torque, can be hard to control, especially when trying to apply sufficient torque to fully seat a screw then immediately stop rotation when fully seated. A variable speed electric drill with screw driver bit must be run at or near full power to get enough torque to drive the screw in fully. This makes it hard to stop the drill when the screw is fully seated. If not stopped at the correct time/position it may over tighten and damage the material receiving the screw, deform and damage the fastener drive, deform and damage the drive bit tip or break off the head of the fastener. Reversing an electric drill requires flipping a switch.

U.S. Pat. No. 7,197,965 Pivoted Socket Wrench Speed Handle teaches a jointed handle which allows the joints to be locked at angular positions. This does not allow fluid adjustments of speed and torque, such as is desired when screwing a sizeable screw into wood. It can be hard to hold in alignment with and engaged with the object being rotated.

U.S. Pat. No. 4,334,445 Z Style Speed Wrench teaches a jointed tool with a rotating handle. It can be hard to hold in alignment with and engaged with the object being rotated. The tool will easily slip off the object to be rotated if not held against it. This is especially true when the Z configuration is elongated for speed, the tool will tend to slip off the object being rotated. At high speed the centrifugal force of the connecting section tends to pull the coupled end sideways and off the object to be rotated. Fasteners such as a Phillips head screw require an axial engagement force proportional to the torque being applied in order to keep the Phillips bit and screw head engaged, otherwise either may deform and be damaged ("cam out"), which can result in either being made unusable. It does not provide for using both ends of the tool to rotate objects.

U.S. Pat. No. 2,712,765 Wrist-Motion Rotary Hand-Tool teaches the wrist motion but lacks any way to vary the handle position to vary speed and torque. It can be hard to hold in alignment with and engaged with the object being rotated. It is not able to develop much torque.

U.S. Pat. No. 7,299,718 Multi-Folding Screwdriver teaches a folding screw driver with torque limiter. It can be hard to hold in alignment with and engaged with the object being rotated. It does not provide for using both ends of the tool to rotate objects. It does not allow for good control over the amount of torque applied to the object to be rotated.

U.S. Pat. No. 5,349,886 Hand Screw Driver teaches a wrist motion screw driver with two positions. It can be hard to hold in alignment with and engaged with the object being rotated. It does not provide for using both ends of the tool to rotate objects.

It is, therefore, a primary objective of this application to provide a tool than can be used to apply rotary motion to an object via human power that is ergonomic to use and allows the applied rotational speed, torque, direction, and axial force to be easily varied and controlled. It is a further object of this invention to provide a tool that can be used to create substantial amounts of torque but also operate at moderately high speed. It is a further object of this application to provide a tool that can be compactly folded and is light weight. It is also an object of this application to provide a tool that is quiet, can be used in wet environments, is reliable, and always ready for use (needs no power source). It is also an object of this application to provide a tool that can be used to rotate many different objects, adapters, and drives. It is a further object of this application to provide a tool whose construction can be varied to suit the needs of a multitude of applications.

This application provides two handles. One handle is used as a steadying handle for keeping the tool axially aligned with the object to be rotated and to apply axial force to maintain engagement with the object to be rotated. The other handle is swiveled, cranked or levered about the first handle to create rotary motion and torque. Both handles are functionally equivalent so that either end of the tool can be used for either steadying or cranking. The design can be made such that the handle used for cranking can also apply axial force to maintain engagement with the object to be rotated or for the purpose of drilling.

This tool is much easier to use, more ergonomic, than a traditional screwdriver because the required grip for a given torque is reduced. This application produces much less operator fatigue than a traditional screwdriver. It is much faster than a traditional screw driver or ratchet drive, as the motion is continuous in the desire direction. No repetitive re-gripping, as with a screwdriver, and no repetitive reversing direction, as with a ratchet. The rotation direction is easily and quickly reversible without requiring stopping and flipping a switch or ratchet pall.

This application is relatively light weight, much lighter than a corded electric drill or battery powered drill. It can be used safely in a wet environment, used submerged under water or even in outer space. This application is more reliable because it has no gears or brushes to wear out, no electrical windings to fail, nor cord to fray or come unplugged. This application works quietly whereas a drill motor can be noisy which is objectionable in some quiet situations such as a hospital, library, office or stealth military operation. This application is human powered so it never needs a power source or recharging, it is always ready to be used. This is an environmentally friendly "green" tool in that it is powered by a human that runs on a renewable energy resource, food. No batteries will ever be discarded as a result of using this tool.

This application can easily and fluidly be repositioned to vary the rotational speed, torque, and force applied. It can be made in a multitude of sizes, member lengths, and configurations to accommodate small delicate fastener requiring less torque and perhaps more speed, large fasteners requiring more torque and perhaps less speed, small drill bits requiring more speed or large drill bits requiring more torque. It can be made so that it provides a substantial amount of torque. For example it can be used to fully screw in a ⅜" diameter×4" long lag bolt (large hexagon head screw) into pine wood without the use of a pilot hole. It provides for good control of the applied speed, torque, and or axial force so that fasteners can be tightened fully as desired but not over tightened, thus preventing damage to fastener, bit and or work piece. This application can be made to fold compactly for storage in a small tool box or for carrying in a pocket or holster. It can also be made so that when folded it can be used like a conventional screwdriver.

The driver ends can be a single drive type such as Phillips or hexagon key or made such that it will accept interchangeable existing hex bits, sockets, and drill bits (via an attached drill chuck or drill bits with hexagon ends). The tool can be turned end for end as both ends are usable and can have integral driving bits or adapters affixed to both ends at the same time, allowing it to be used to rotate two types or sizes of objects without changing adapters. For example, two sockets of different sizes could be affixed to square drive ends. The tool ends could be the same size, such as ¼" square drive, or different, say one ¼" square drive and the other ⅜" square drive. It could have a hex bit adapter on both ends with a wood screw driving hex bit in one end and a corresponding hex bit pilot drill affixed in the other end. One end could be a drill chuck for holding drill bits or hex bits. A Phillips bit on one and a flat screw driver bit on the other end. Thus two ends or affixed adapters are ready for use. The driver ends can also have rotatable indexable hubs with a plurality of drive tips on each hub, thus greatly increasing the number of drive tips that are available for use.

The tool's pivot joints are not fixed at various positions. This allows them to be easily and fluidly repositioned to vary the rotational speed and torque during use. A pivot rotation limiting stop can be incorporated on one or both pivots so that the members swing through a predetermined pivot angle and then stop. This allows axial force from the crank handle to be transmitted through the connecting member, to the output member and its end or adapter to provide additional axial engagement force with the object being rotated or for drilling.

When drilling it is important to hold the bit in the same position to start and in axial alignment while the hole is being drilled. Steadying via the output member's handle greatly assists in maintaining the position and axial alignment. To further minimize axial misalignment, an extension of sufficient length can be used between the drill and the output member. This reduces the angle of misalignment for a given amount of sideways movement of the steady handle. An adapter with a slightly swiveling joint can also be used to limit the effect of misalignment when drilling. Once the hole is started, the swivel joint allows the tool to be slightly out of alignment with the drill bit, without putting stress on the drill bit, which is aligned with the axis of the hole it is making.

The tool is very ergonomic to use, versatile in its ability, range of use and characteristics. It has two comfortable handles for ease of use. It can be made to use a multitude of adapters, drives and drill chucks. It can be used as a swivel, crank, or lever, be used as a conventional screwdriver or conventional tee handle driver. It can produce a good amount of rotational speed and substantial amounts of torque. It can be used with small screw fasteners, nuts and bolts, machine drives, pumps and drills. It needs no power source, is quiet, can be made small and lightweight or large and heavy duty, and made to fold compactly. This is a very useful tool.

SUMMARY

A tool for applying rotary motion, torque, and or axial force to an object via human power, which allows easy, smooth, and controlled variation of the applied rotational speed, rotation direction, torque, and or axial force. The tool is comprised of three elongated members pivotably connected end to end. The outboard ends of the two end sections each have means to connect to an object to be rotated, or means to connect to adapters which in turn connect to an object to be rotated. The two end members are each grasped and can rotate by slipping in the grasps or may incorporate a rotary handle. The middle connecting member is pivotably connected to the two end members and allows them to be fluidly positioned in a nearly straight Z shape as a swivel, at right angles as a crank or in an L as a lever, so as to vary the applied rotational speed, rotation direction, torque, and or axial force. Either end of the tool may be used to rotate an object. The members can be made such that they fold compactly for storage or for use much like a conventional screwdriver. The pivots can incorporate a rotation stop, which in the cranking configuration allows both hands to push axially to apply engagement force with the object being rotated. The component designs can be varied to provide performance characteristics to suit a multitude of applications needing rotation or to accommodate manufacturing and materials preferences. This is a reliable tool and a "green" tool, needing no power source.

DRAWINGS

Figures

The first twelve figure numbers each corresponds to a given embodiment. Figures related to each embodiment have the same number but different alphabetical suffixes. The remaining figure numbers correspond to figures showing additional construction alternatives and or examples of use.

FIGS. 1A to 1J show views of a first embodiment with single fixed thrust flanges on each end member.

FIG. 1A perspective view in cranking configuration

Figure 1B:
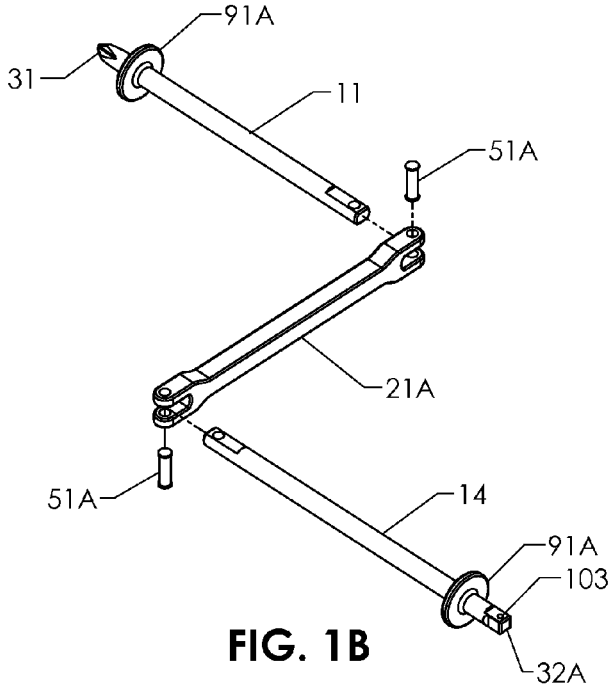

FIG. 1B exploded perspective view in cranking configuration

Figure 1C:
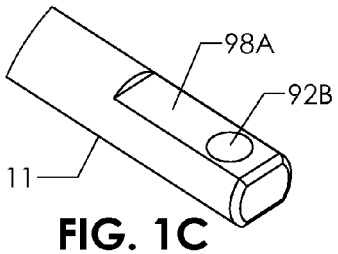

FIG. 1C detail view of end member's pivot end

Figure 1D:
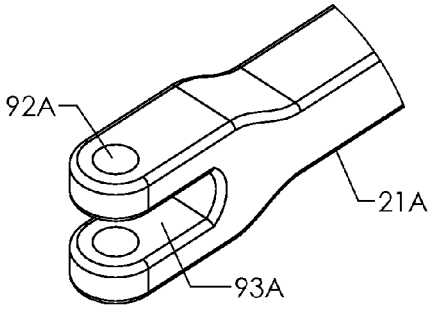

FIG. 1D detail view of connecting member's clevis end

Figure 1E:
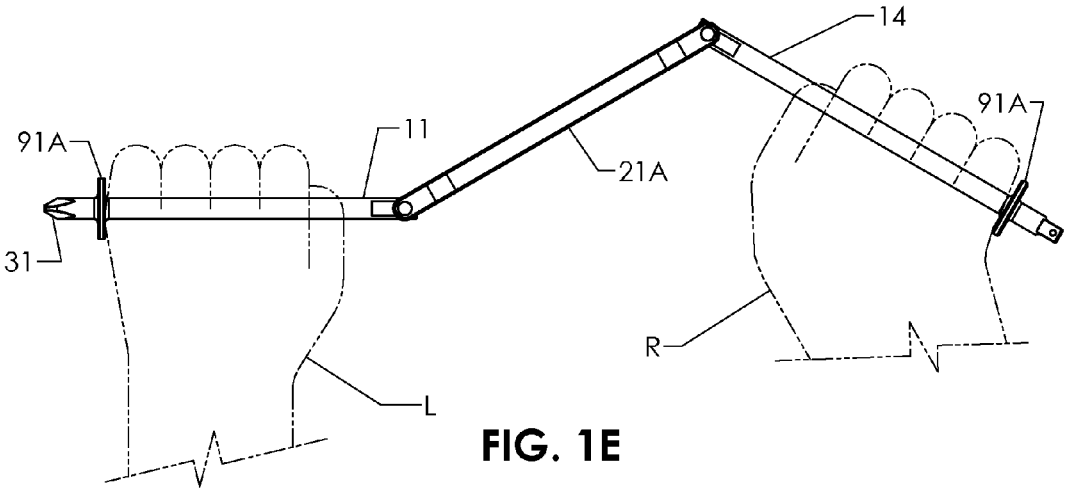
Figure 1F:
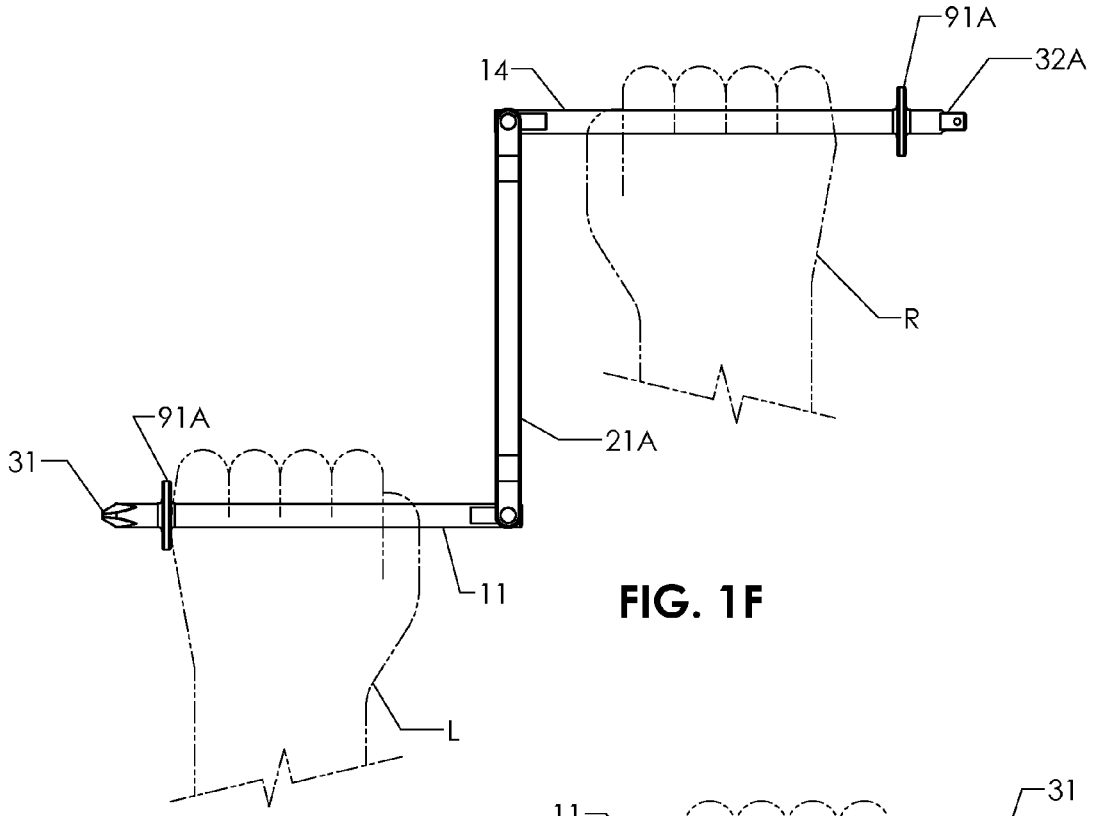
Figure 1G:
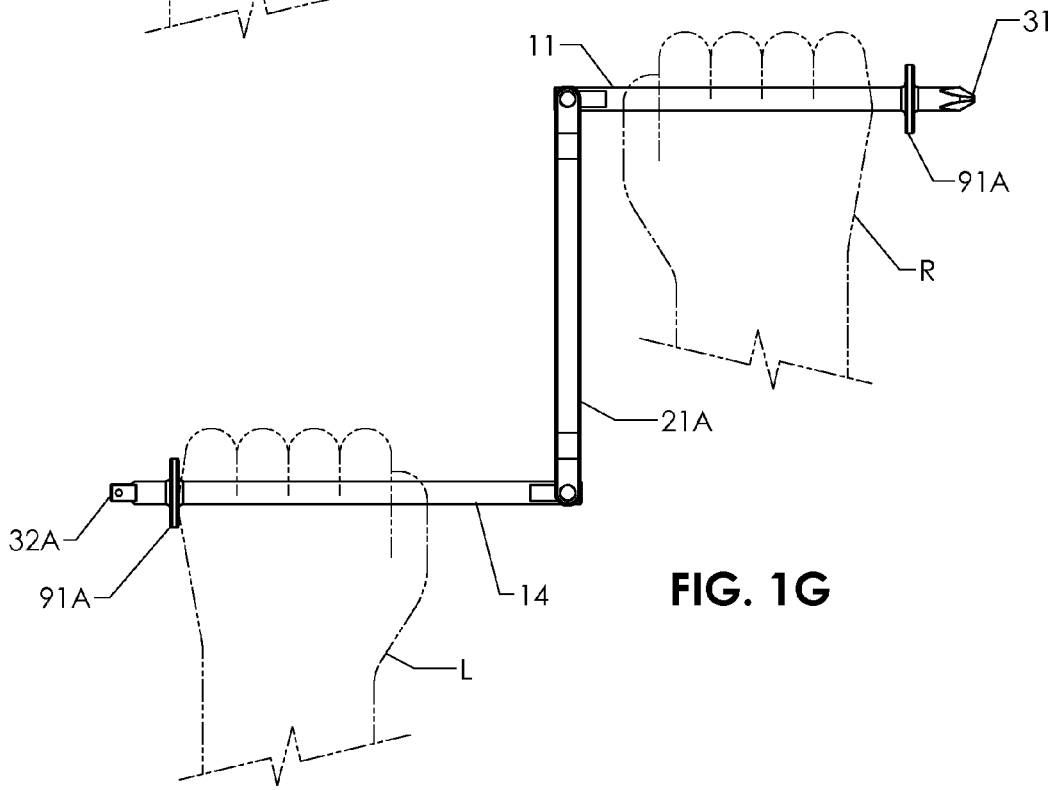
Figure 1H:
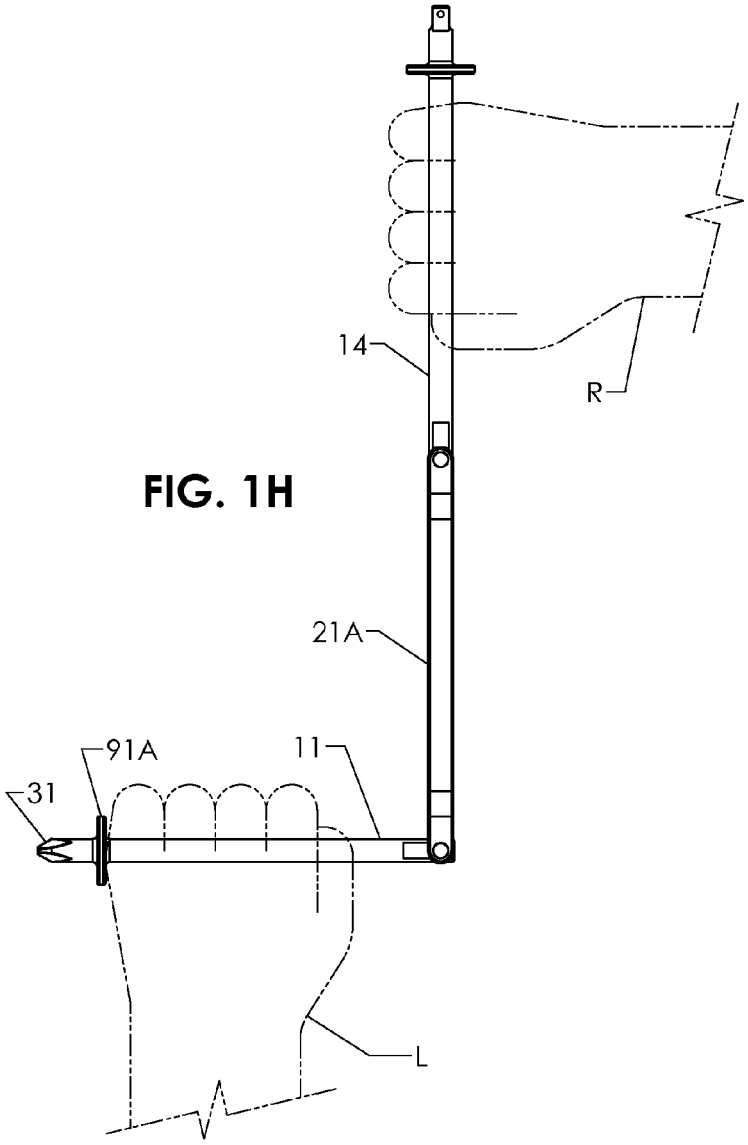
Figure 1I:
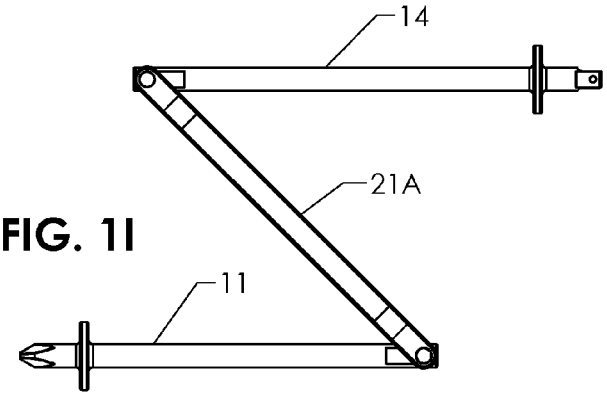
Figure 1J:
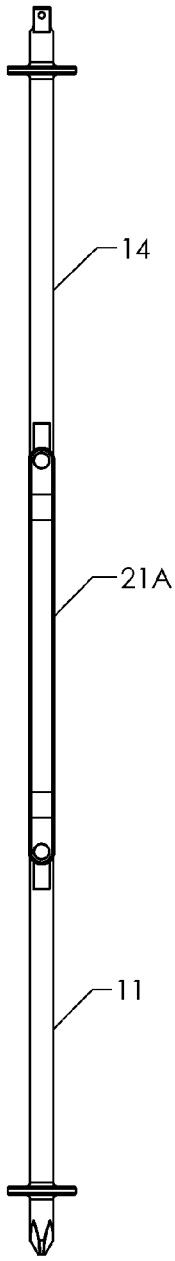

FIG. 1E plan view of operation in high speed configuration, using Phillips tip end FIG. 1F plan view of operation in cranking configuration, using Phillips tip end FIG. 1G plan view of operation in cranking configuration, using square drive end FIG. 1H plan view of operation in maximum torque configuration, using Phillips tip end FIG. 1I plan view of folded storage configuration FIG. 1J plan view of straight storage configuration FIGS. 2A to 2L show views of a second embodiment with rotation stop and dual fixed thrust flanges on each end member.

Figure 2A:
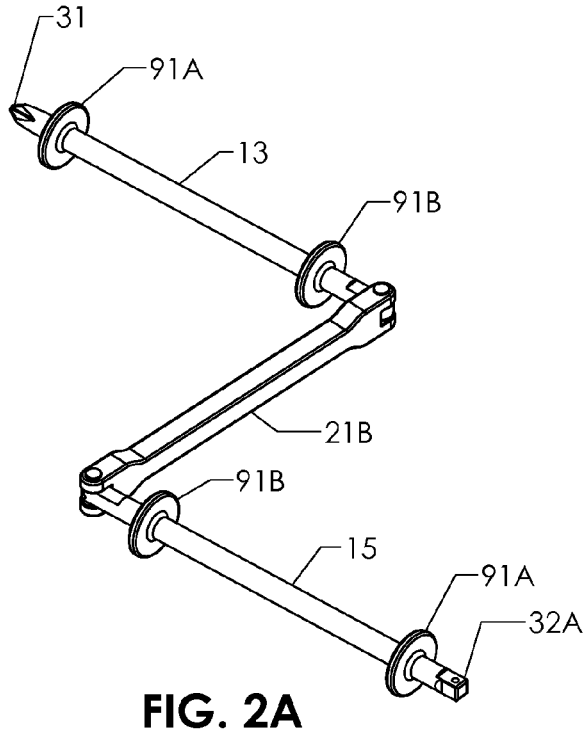

FIG. 2A perspective view in cranking configuration

Figure 2C:
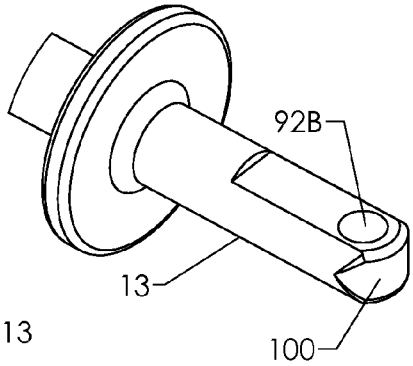
Figure 2D:
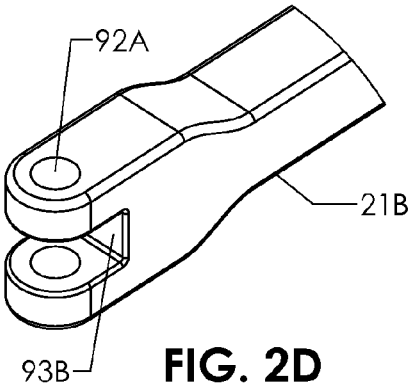
Figure 2B:
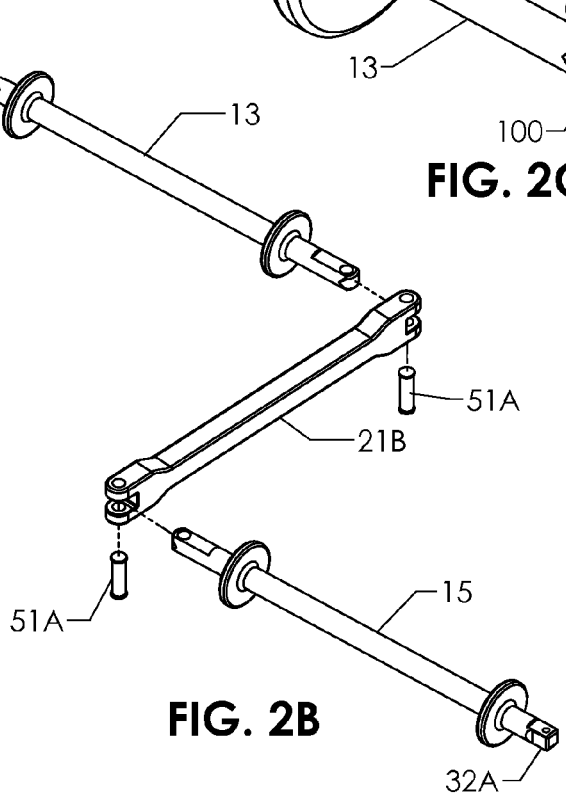

FIG. 2B exploded perspective view in cranking configuration

FIG. 2C detail view of end member's pivot end

FIG. 2D detail view of connecting member's clevis

Figures 2E, 2F, 2G, 2H:
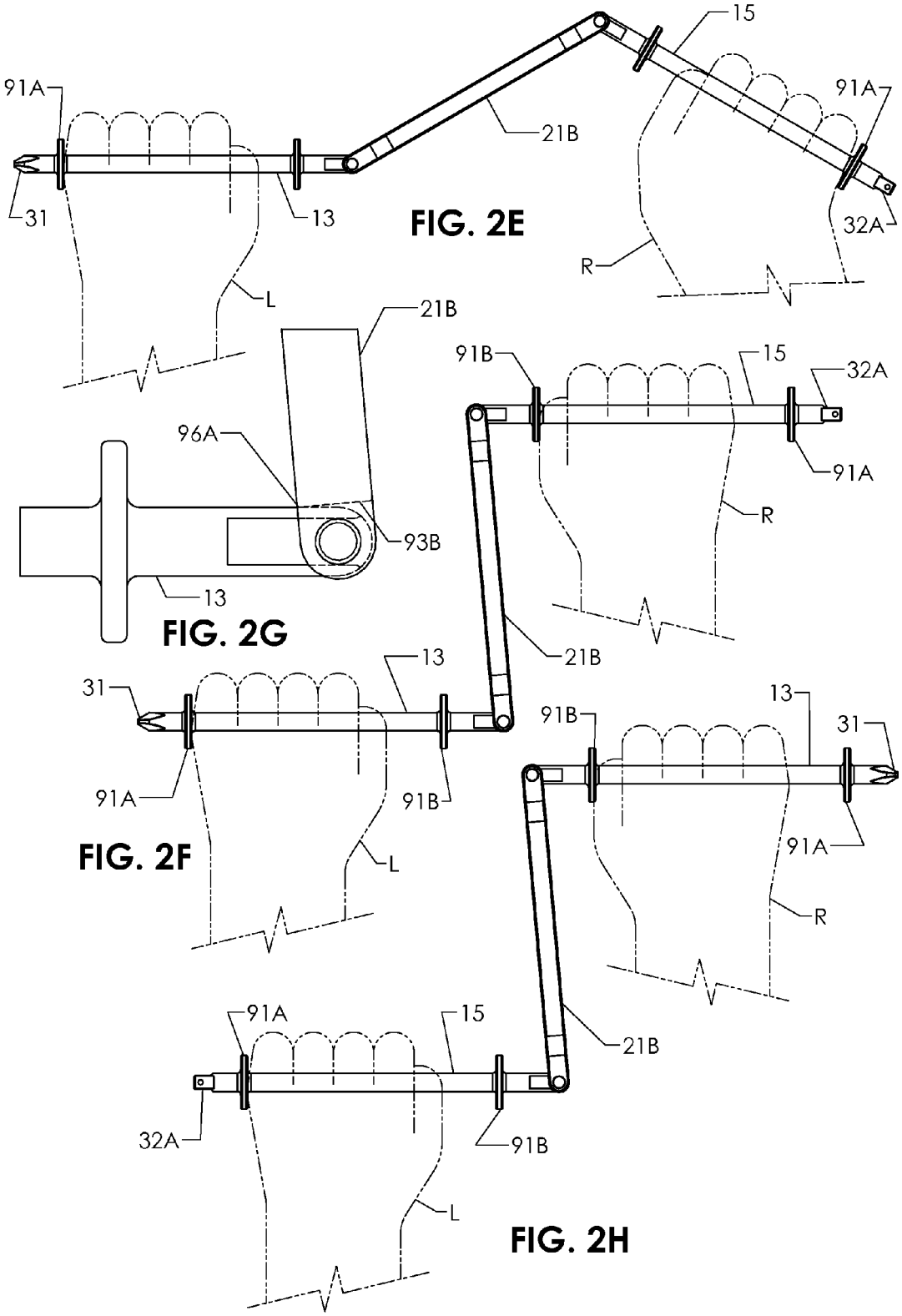
Figure 2J:
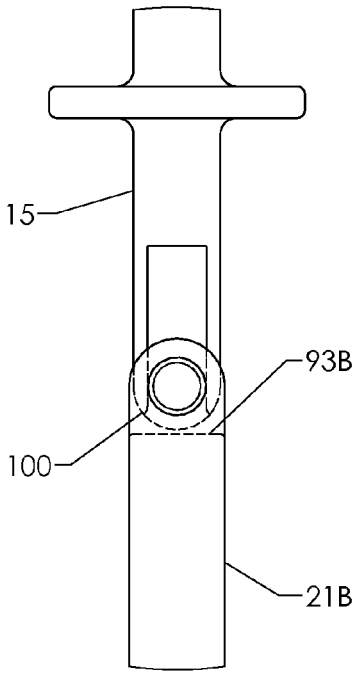
Figure 2I:
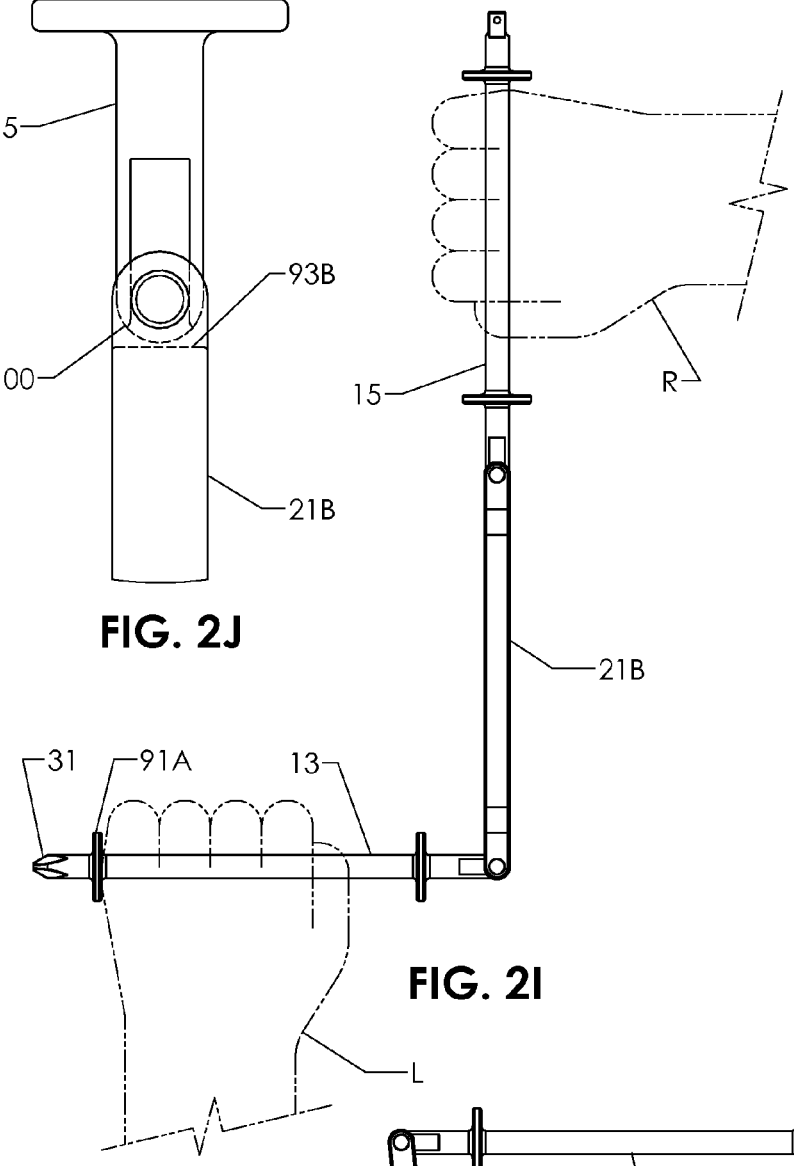
Figure 2L:
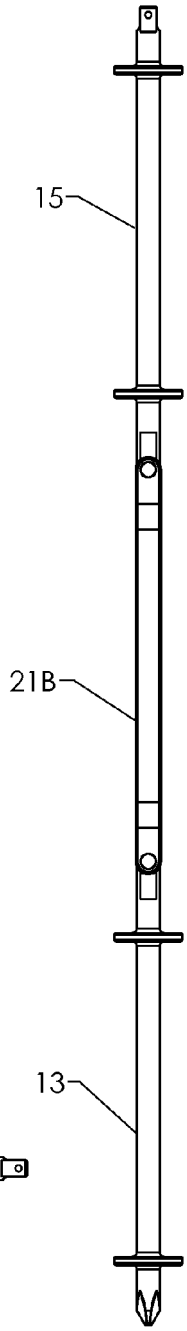
Figure 2K:
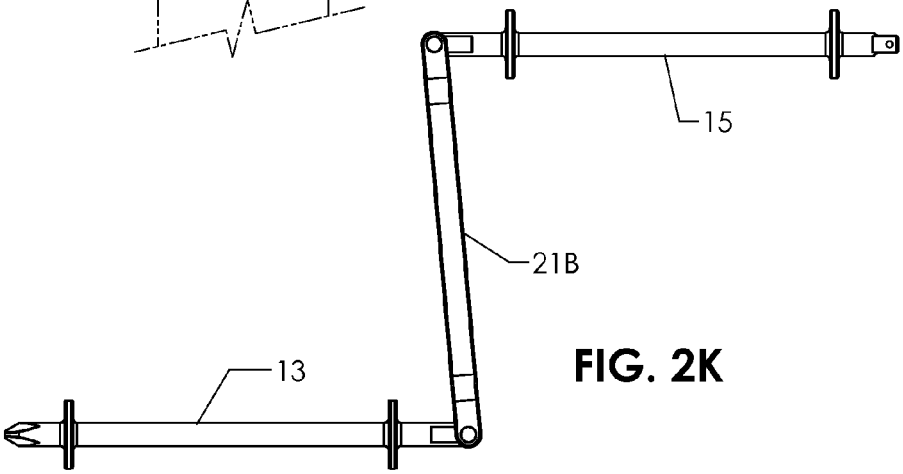

FIG. 2E plan view of operation in high speed configuration, using Phillips tip end FIG. 2F plan view of operation in cranking configuration, using Phillips tip end FIG. 2H plan view of operation in cranking configuration, using square drive end FIG. 2G detail view of pivot engaging rotation stop FIG. 2I plan view of operation in maximum torque configuration, using Phillips tip end FIG. 2J detail view of pivot joint with members in line FIG. 2K plan view of folded storage configuration FIG. 2L plan view of straight storage configuration FIGS. 3A to 3H show views of a third embodiment having connecting member with angled ends.

Figure 3A:
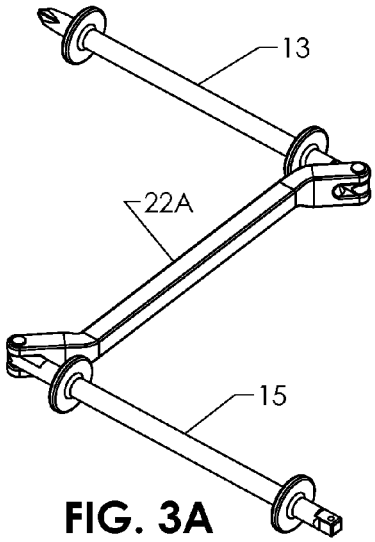

FIG. 3A perspective view in cranking configuration

Figure 3C:
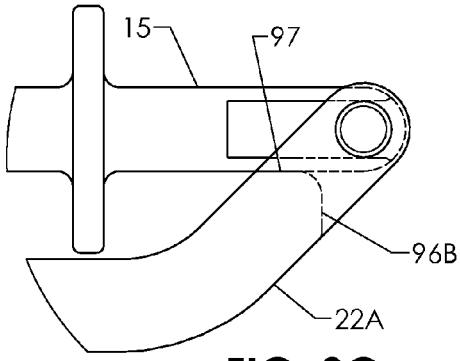
Figure 3B:
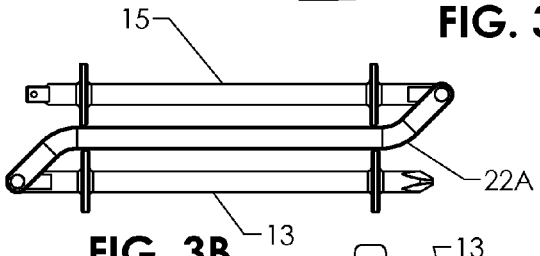

FIG. 3B plan view of folded storage configuration

FIG. 3C detail view of pivot clearance for storage configuration

Figure 3H:
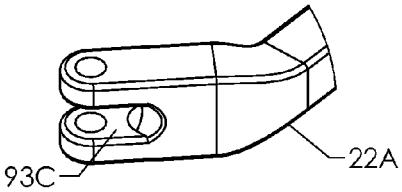
Figure 3E:
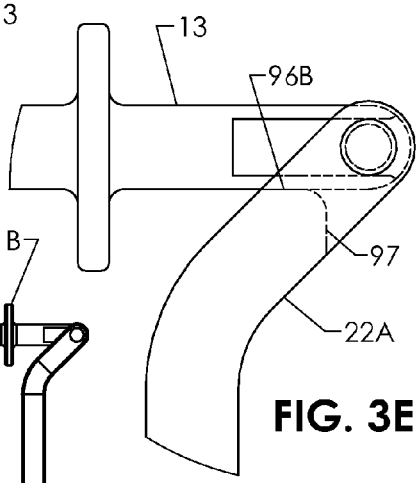
Figure 3G:
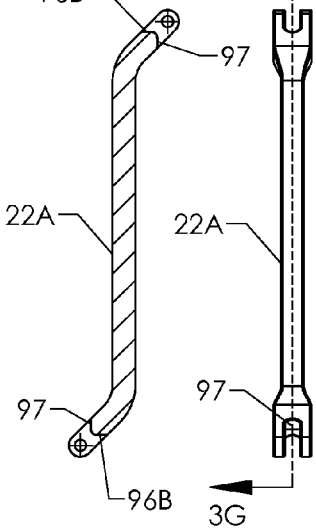
Figure 3F:
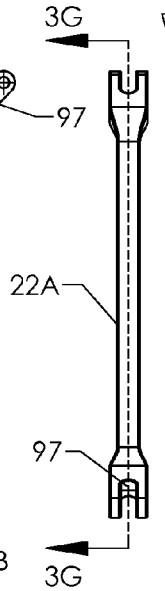
Figure 3D:
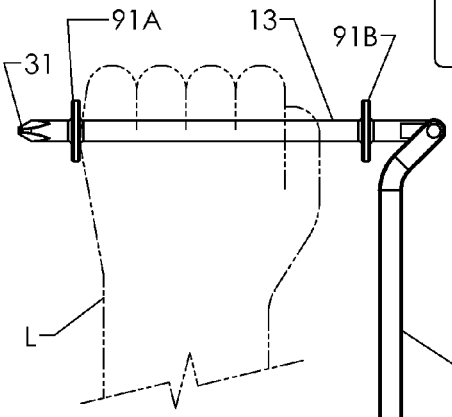
Figure 3D:
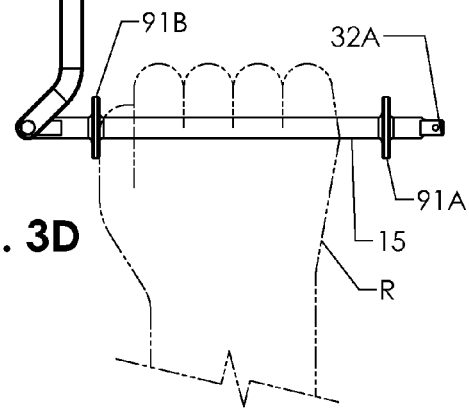

FIG. 3D plan view of operation in cranking configuration

FIG. 3E detail view of pivot engaging rotation stop

FIG. 3F side view of connecting member

FIG. 3G section view of connecting member

FIG. 3H detail view of angled clevis end

Figure 4H:
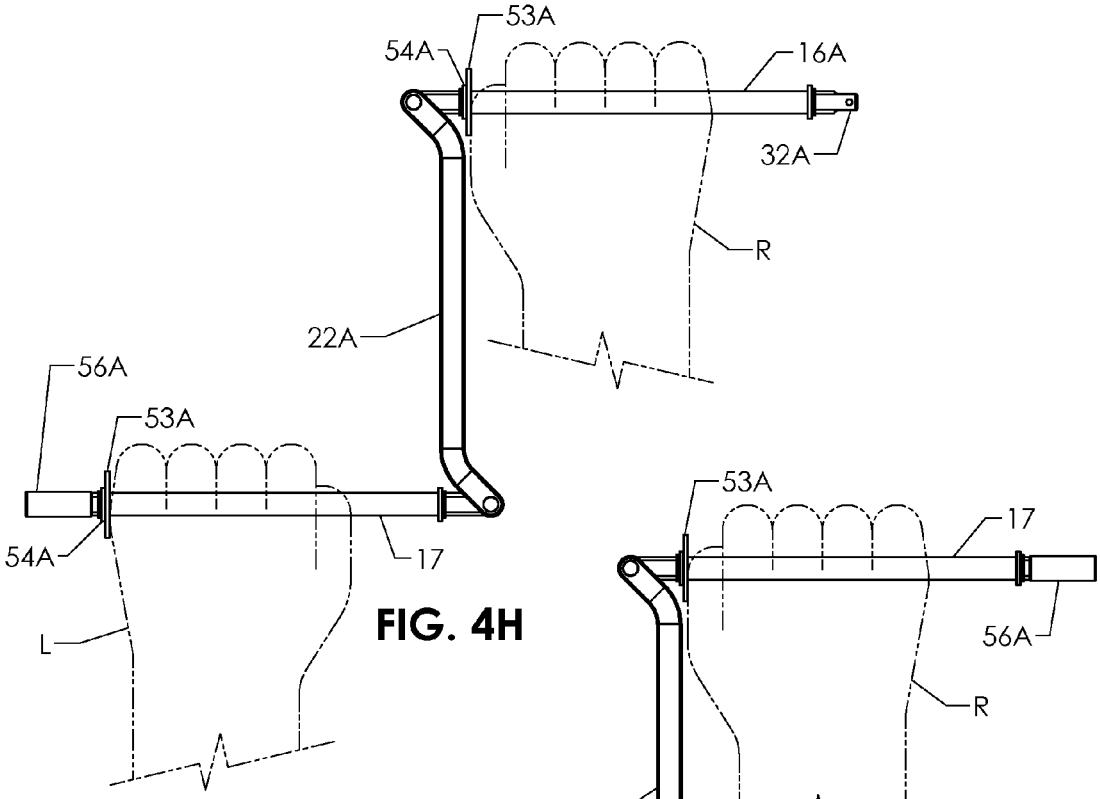
Figure 4I:
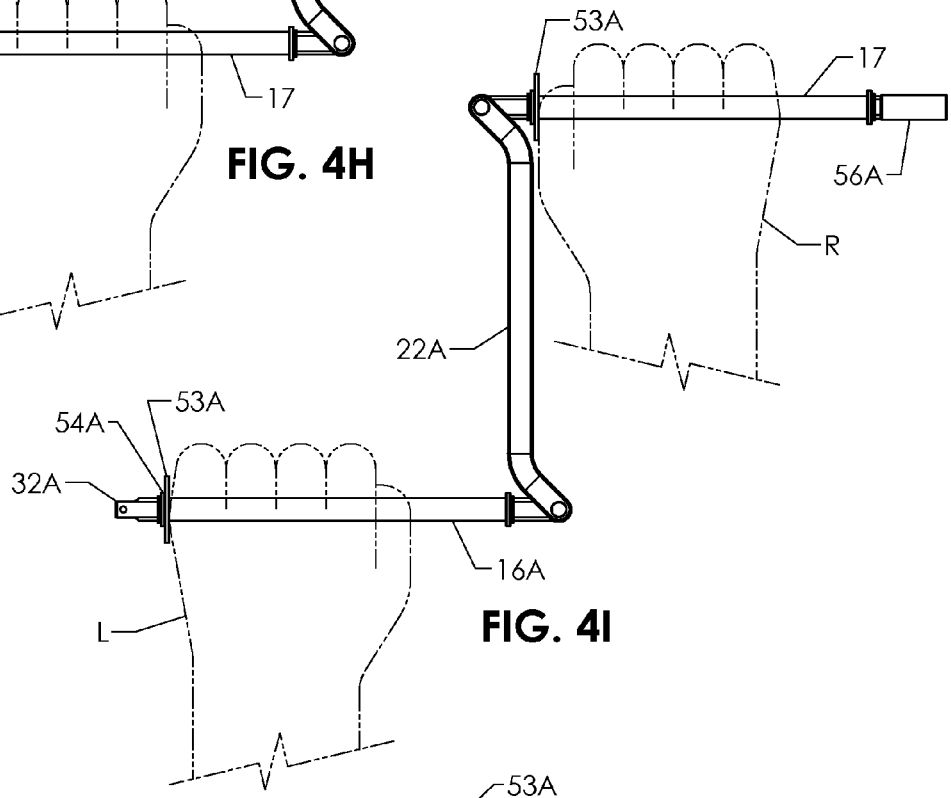
Figure 4J:
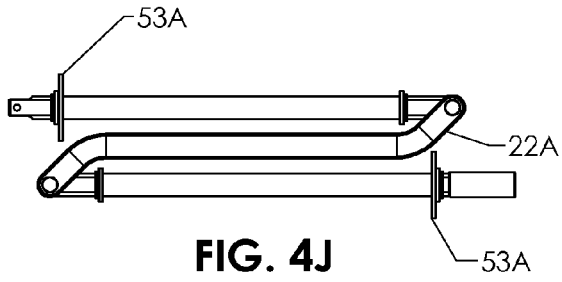

FIGS. 4A to 4J show views of a fourth embodiment with sliding thrust flange FIG. 4A perspective view with thrust flanges slid mid way FIG. 4B perspective view in cranking configuration FIG. 4C exploded perspective view in cranking configuration FIG. 4D detail view of pivot end of end member FIG. 4E detail view of square drive end of end member FIG. 4F detail view of shoulder washer FIG. 4G detail view of hexagon end of end member FIG. 4H plan view of operation in cranking configuration, using hex bit adapter end FIG. 4I plan view of operation in cranking configuration, using square drive end FIG. 4J plan view of folded configuration FIGS. 5A to 5F show views of a fifth embodiment with rotating handle and sliding thrust flange.

Figures 5A, 5B, 5C, 5D, 5E, 5F:
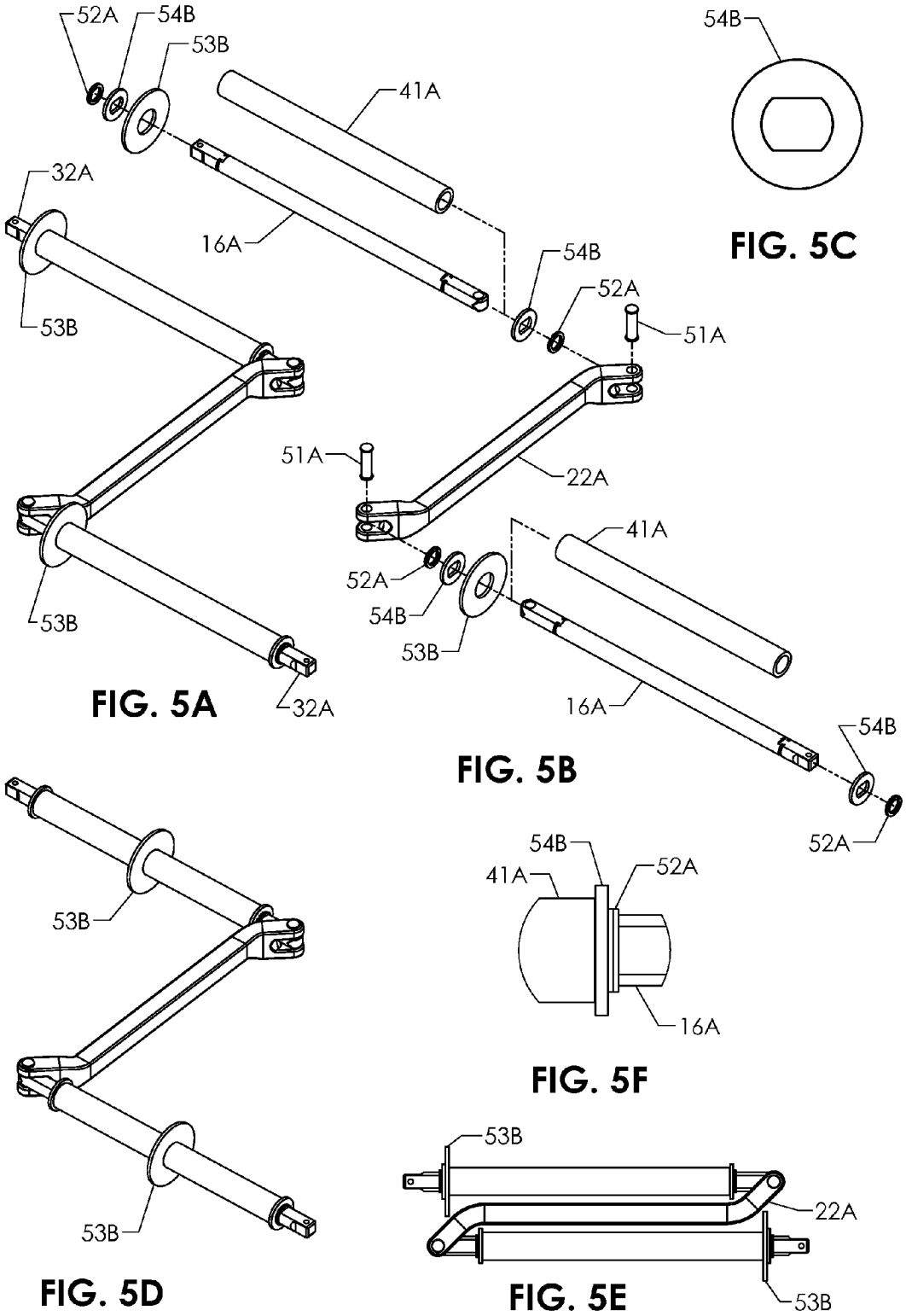

FIG. 5A perspective view in cranking configuration

FIG. 5B exploded perspective view in cranking configuration

FIG. 5C detail view of shoulder washer

FIG. 5D perspective view in cranking configuration, but with thrust flanges slid midway FIG. 5E plan view of folded storage configuration FIG. 5F detail plan view of shoulder washer and snap ring assembly FIGS. 6A to 6D show views of a sixth embodiment with rotating handles.

Figure 6A:
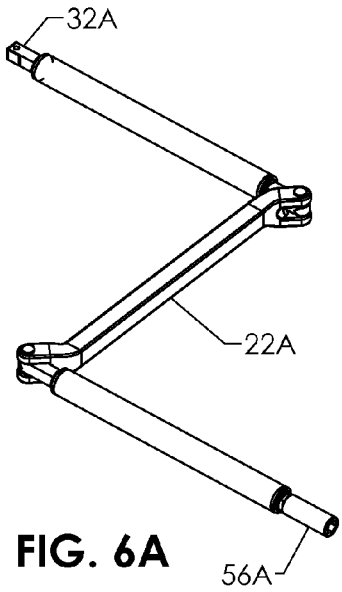

FIG. 6A perspective view in cranking configuration

Figure 6B:
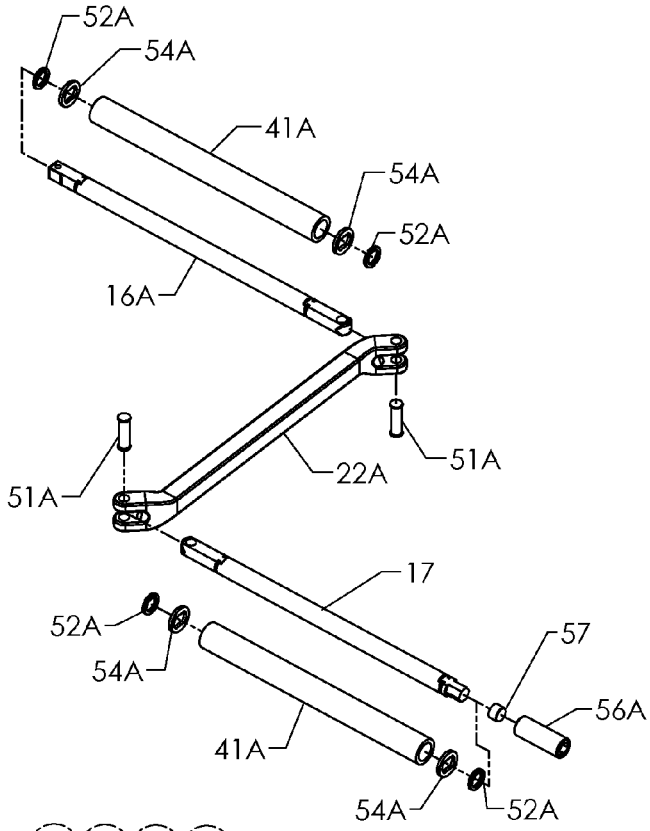

FIG. 6B exploded perspective view in cranking configuration

Figure 6C:
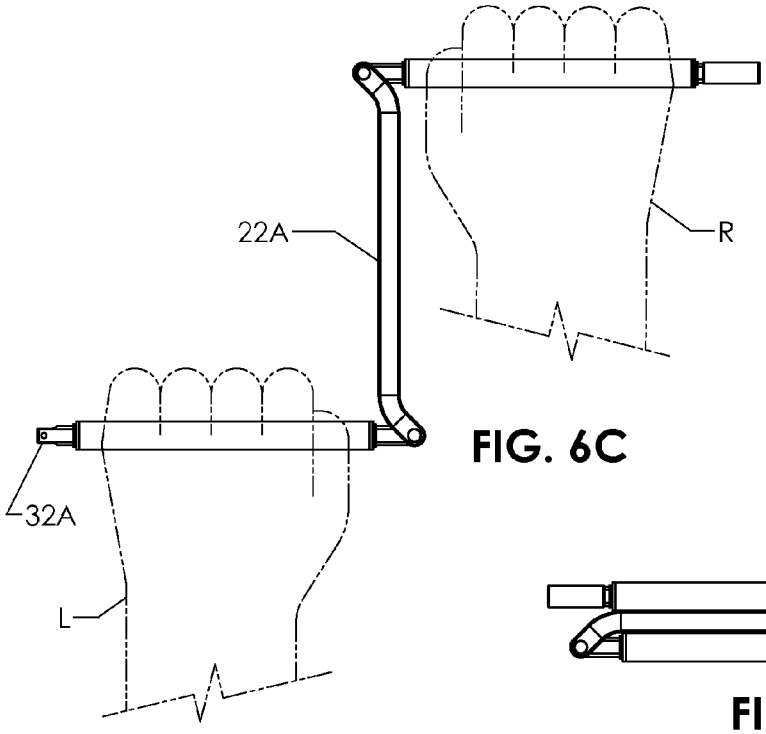
Figure 6D:
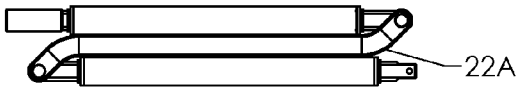
Figure 7N:
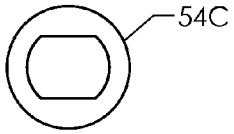
Figure 7D:
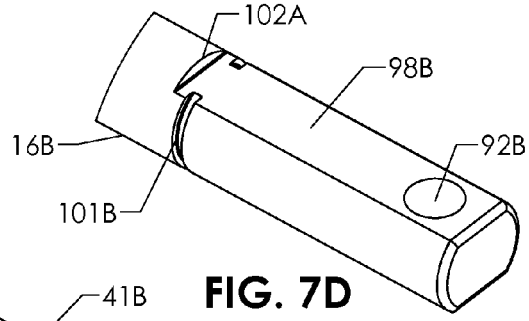
Figure 7A:
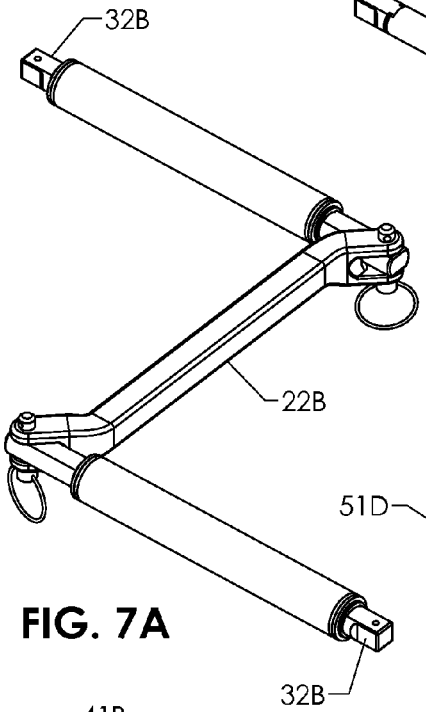
Figure 7B:
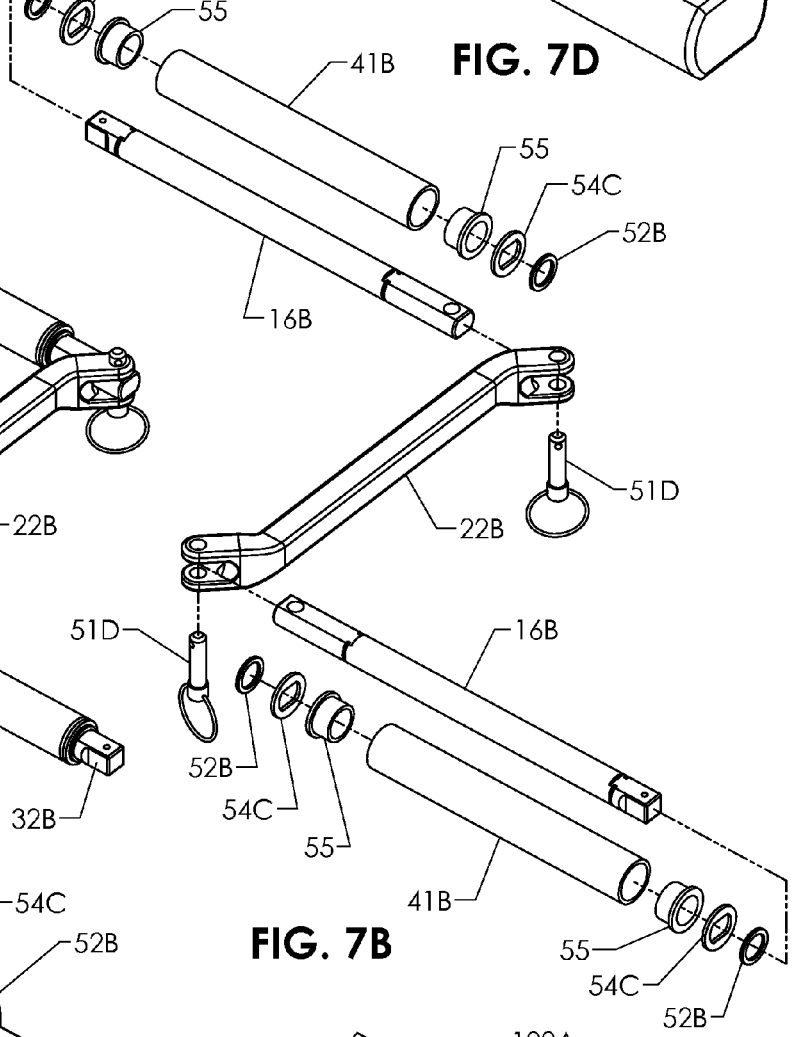
Figure 7C:
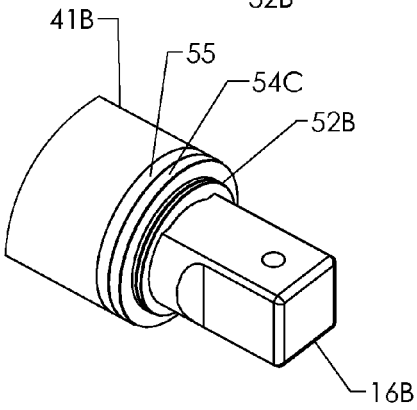
Figure 7E:
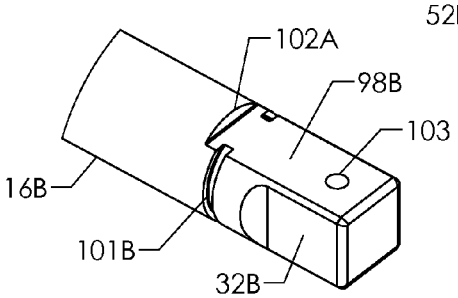
Figure 7J:
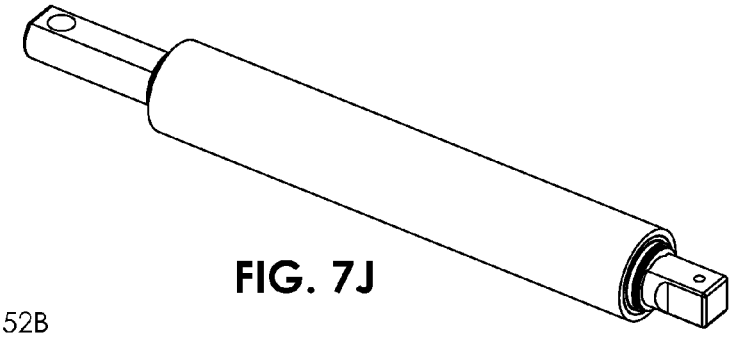
Figure 7K:
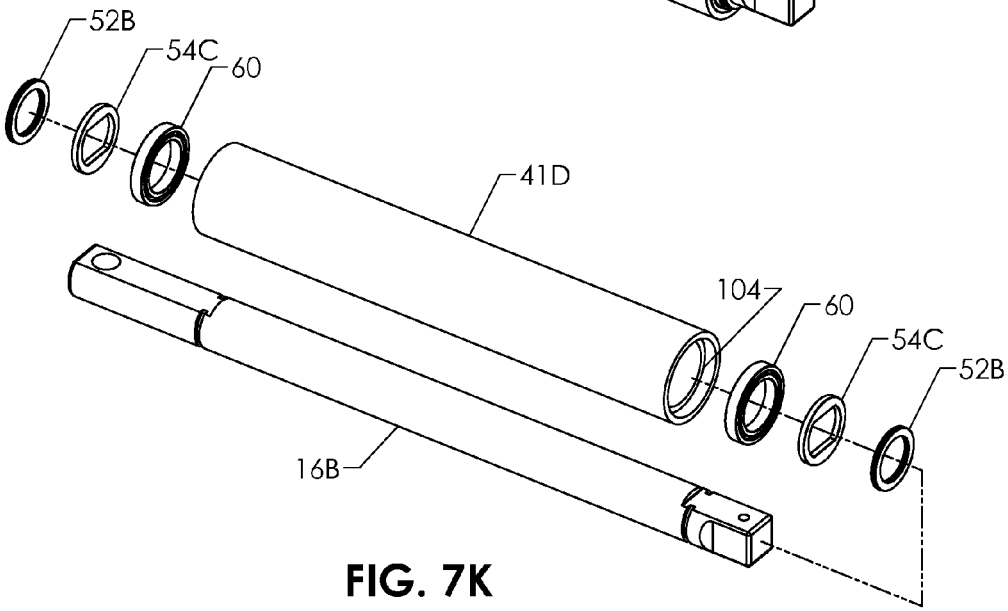
Figure 7L:
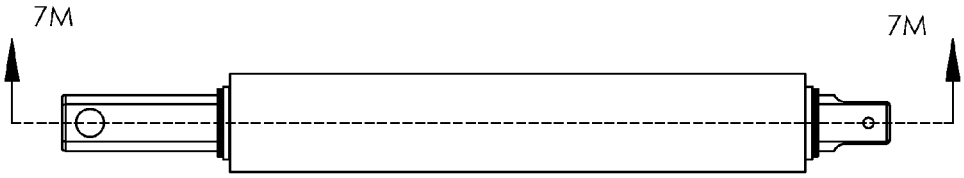
Figure 7M:
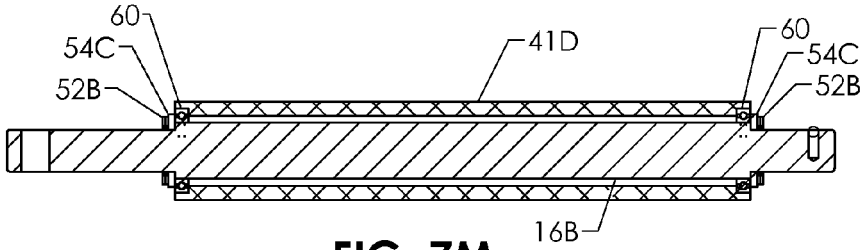

FIG. 6C plan view of operation in cranking configuration, using square drive end FIG. 6D plan view of folded storage configuration FIGS. 7A to 7N show views of a seventh embodiment incorporating bushings or bearings FIG. 7A perspective view in cranking configuration, with flange bushings FIG. 7B exploded perspective view in cranking configuration, with flange bushings FIG. 7C detail perspective view of snap ring, shoulder washer, and flange bushing assembly FIG. 7D detail view of end member's pivot end FIG. 7E detail view of end member's square drive end FIG. 7F perspective view of input/output, with plain bushings and thrust washers FIG. 7G exploded perspective view of 7F FIG. 7H plan view of input/output, with plain bushings and thrust washers FIG. 7I section view of 7H FIG. 7J perspective view of input/output with ball bearings FIG. 7K exploded view of 7J FIG. 7L plan view of input/output with ball bearings FIG. 7M section view of 7L FIG. 7N detail view of shoulder washer FIGS. 8A to 8G show views of an eighth embodiment with single shear pivots and input, connecting, and output members in adjacent planes (on opposite sides of connecting member).

Figure 8A:
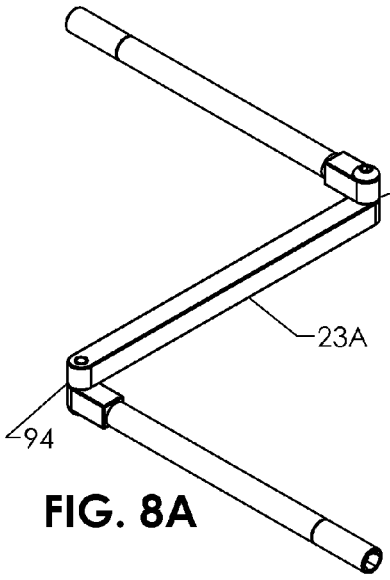

FIG. 8A perspective view in cranking configuration

Figure 8D:
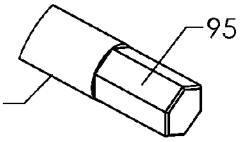
Figure 8B:
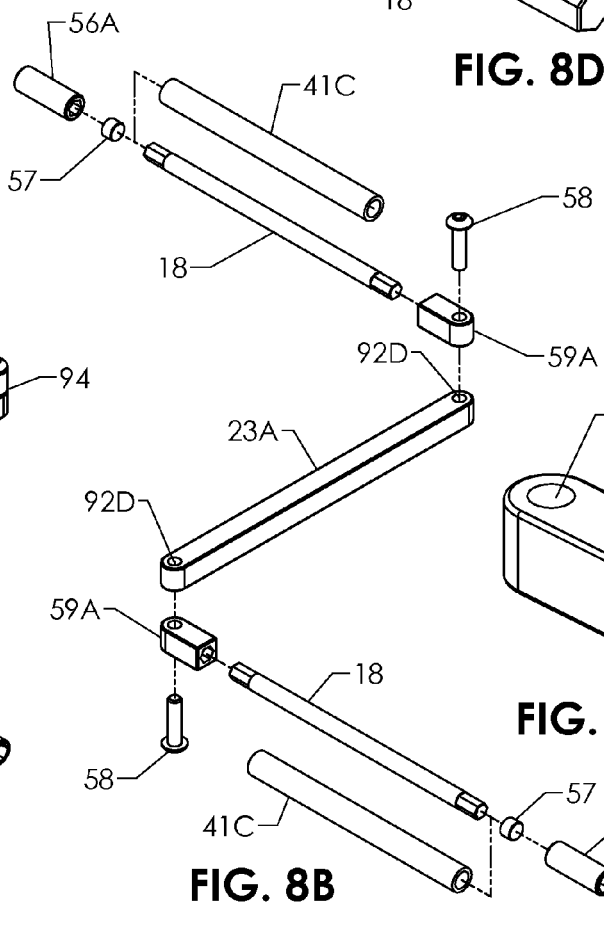

FIG. 8B exploded perspective view in cranking configuration

Figure 8C:
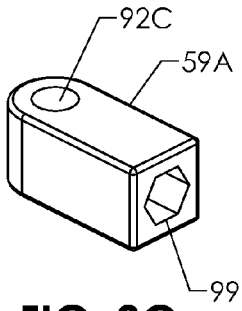

FIG. 8C detail view of pivot end fitting

FIG. 8D detail view of hexagon end of end shaft

Figure 8E:
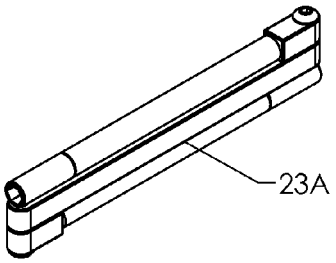

FIG. 8E perspective view of folded configuration

Figure 8F:
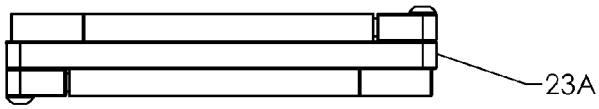

FIG. 8F plan view of folded configuration

Figure 8G:
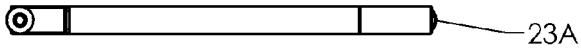

FIG. 8G side view of folded configuration

FIGS. 9A to 9F show views of a ninth embodiment with single shear pivots, rotation stops, and input, connecting, and output members in adjacent planes.

Figure 9A:
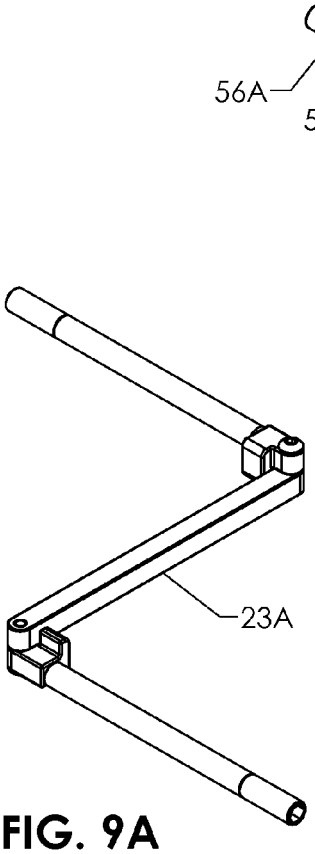

FIG. 9A perspective view in cranking configuration

Figure 9B:
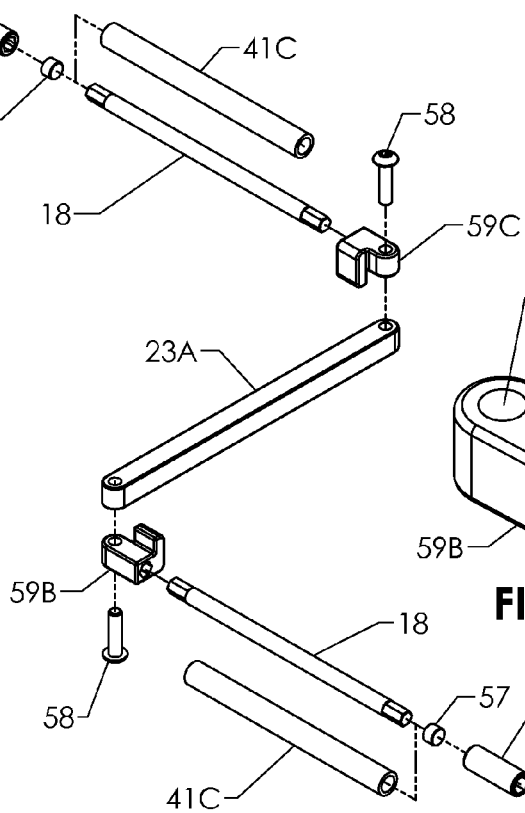

FIG. 9B exploded perspective view in cranking configuration

Figure 9C:
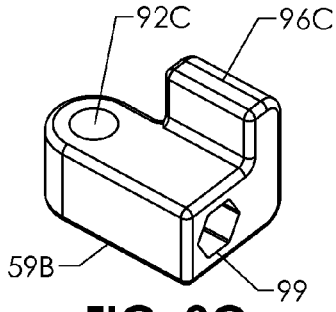

FIG. 9C detail view of pivot end fitting with rotation stop

Figure 9D:
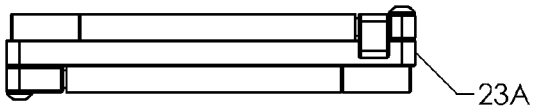

FIG. 9D plan view of folded configuration

Figure 9E:
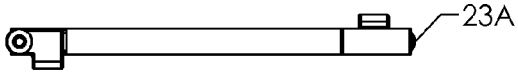

FIG. 9E side view of folded configuration

Figure 9F:
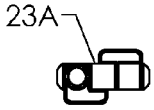

FIG. 9F end view of folded configuration

FIGS. 10A to 10E show views of a tenth embodiment with single shear pivots and input and output in the same plane (on the same side of connecting member).

Figure 10A:
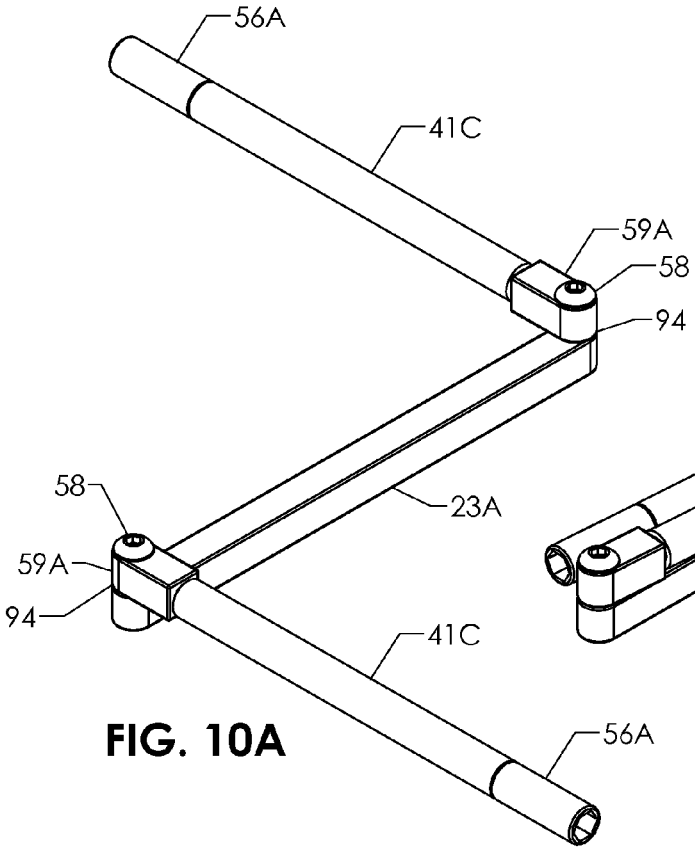

FIG. 10A perspective view in cranking configuration

Figure 10B:
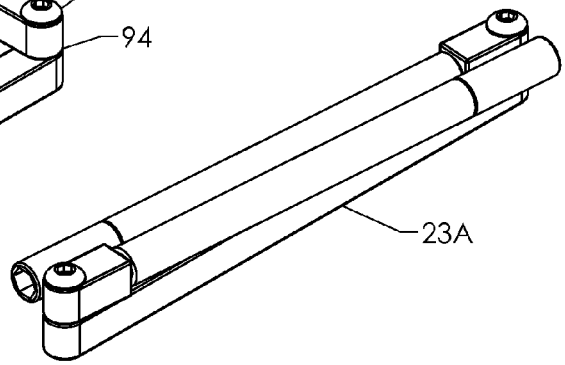

FIG. 10B perspective view of folded configuration

Figure 10C:
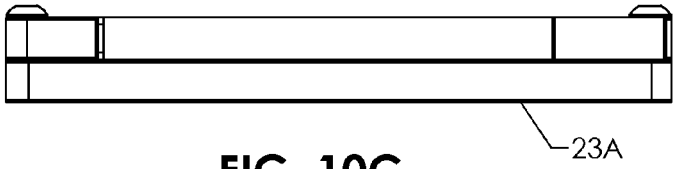
Figure 10D:
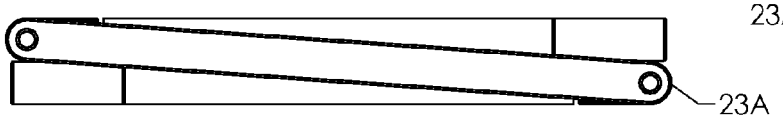
Figure 10E:
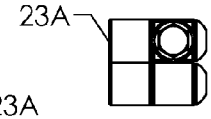
Figure 47A:
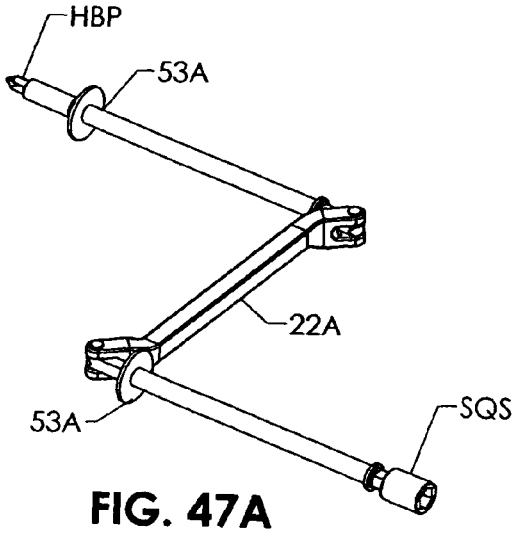
Figure 47B:
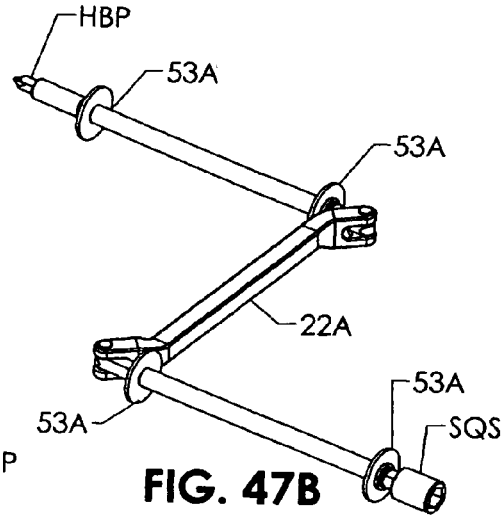
Figure 48:
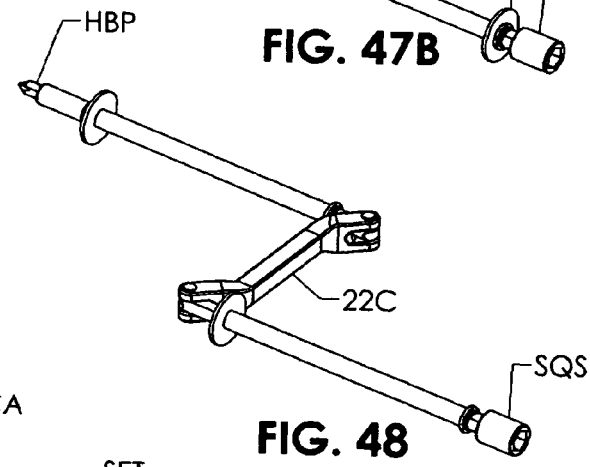
Figure 49:
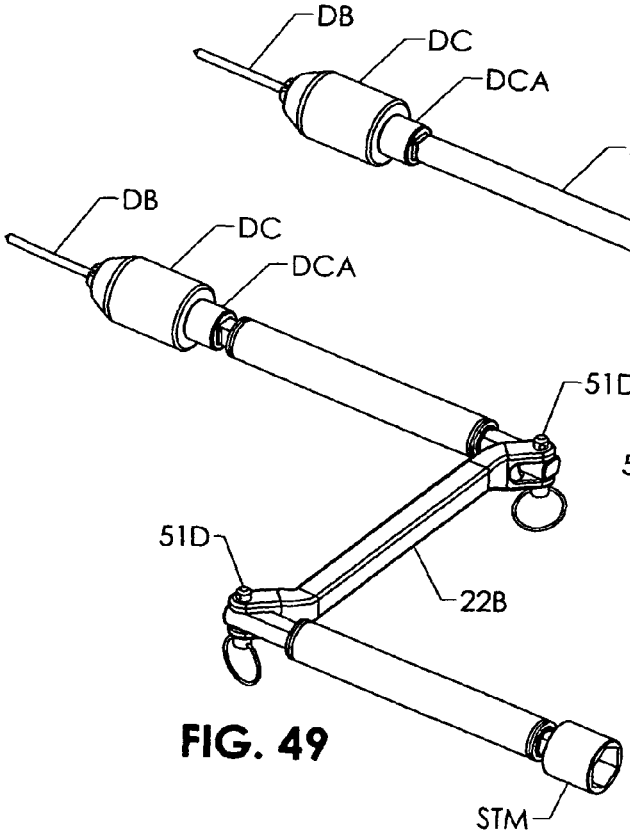
Figure 50:
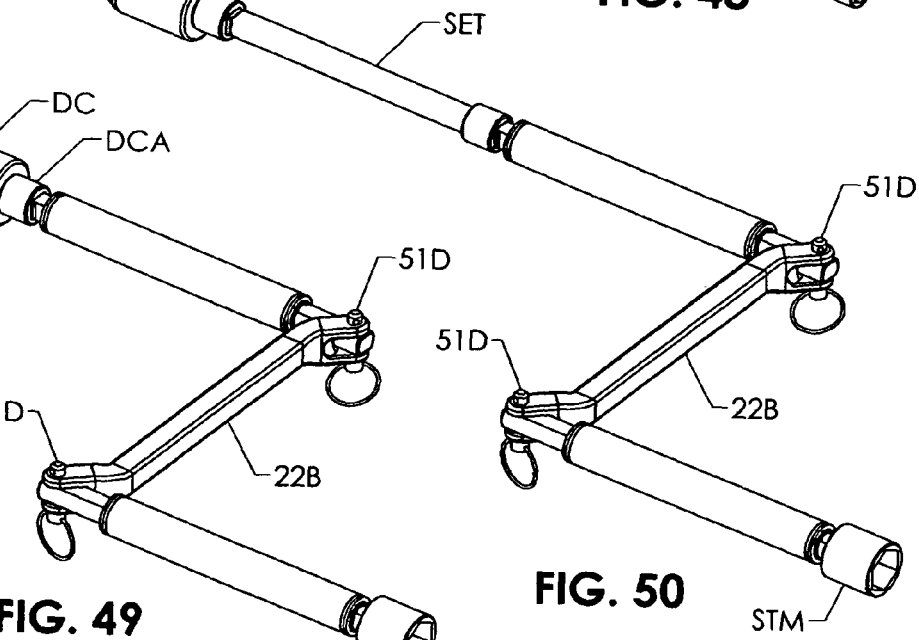
Figure 51:
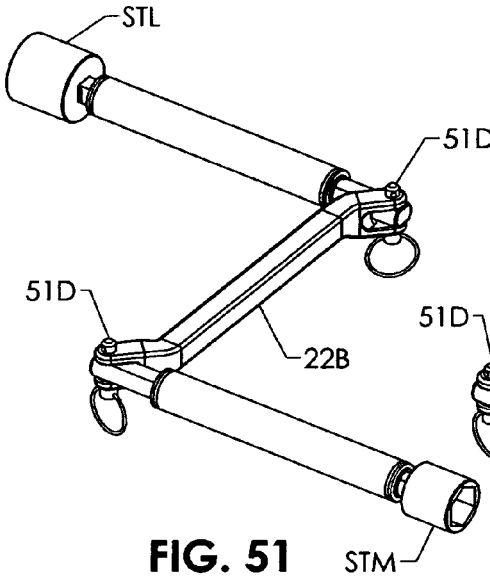
Figure 52:
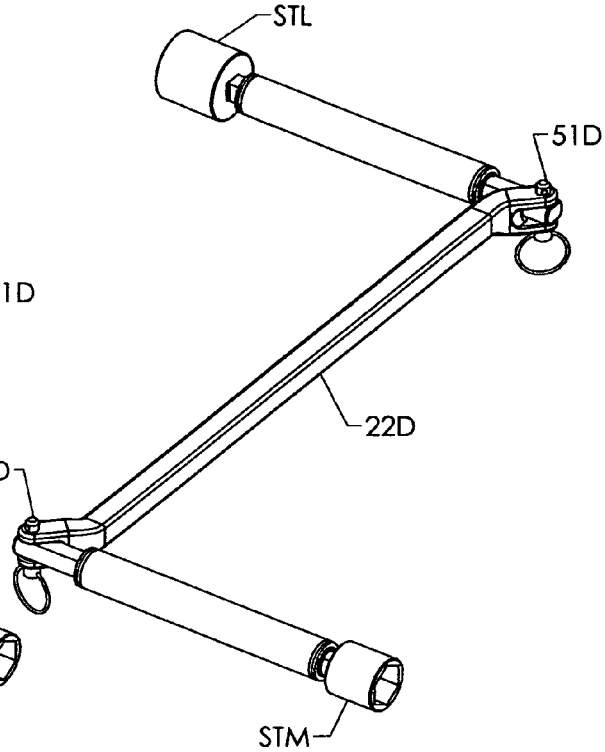
Figure 53A:
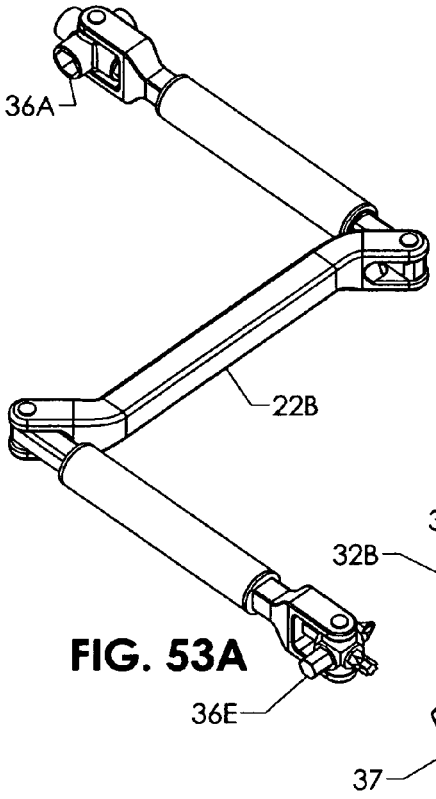
Figure 53B:
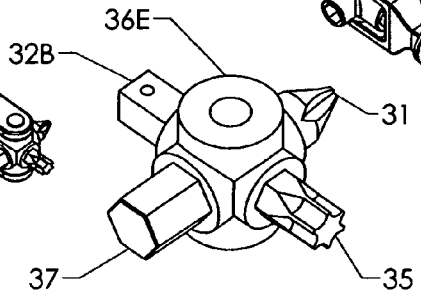
Figure 54:
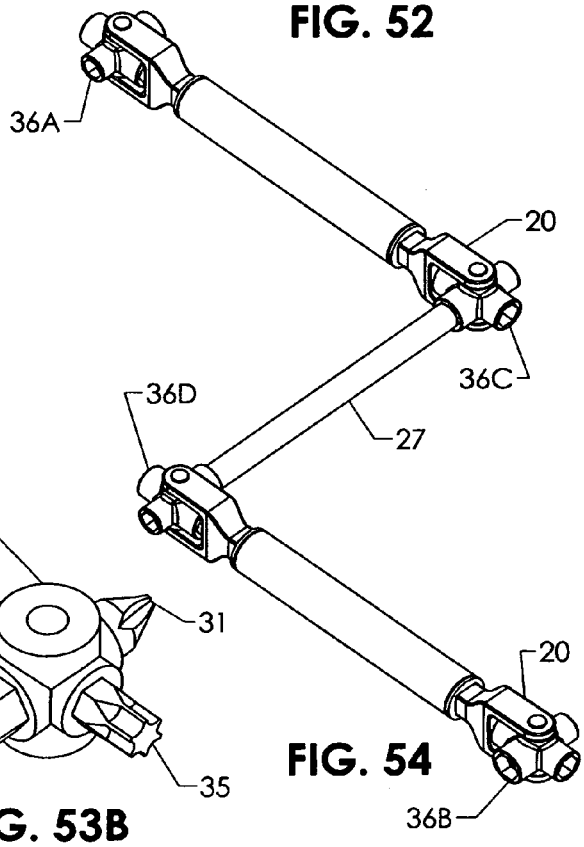
Figure 55:
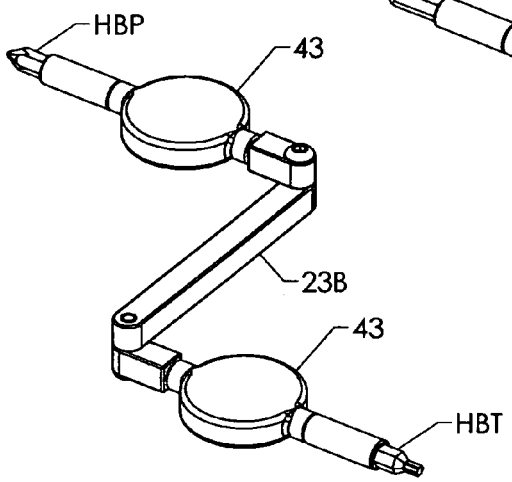
Figure 56:
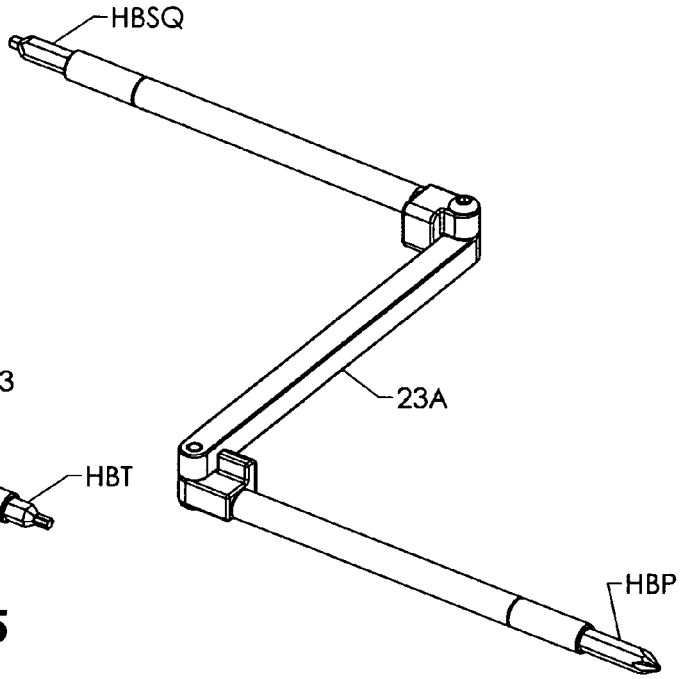
Figure 57:
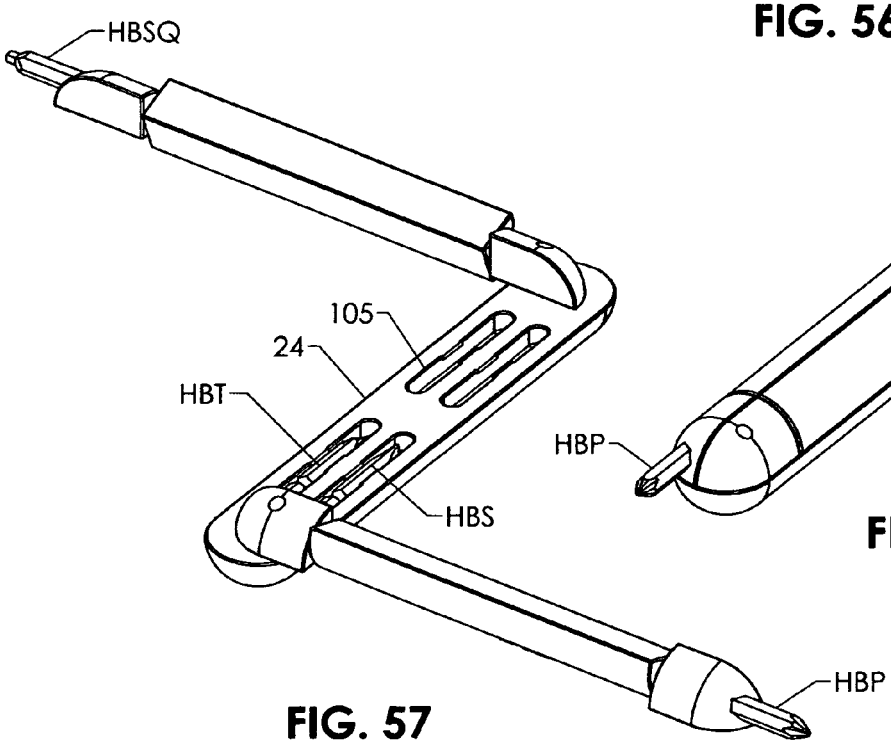
Figure 58:
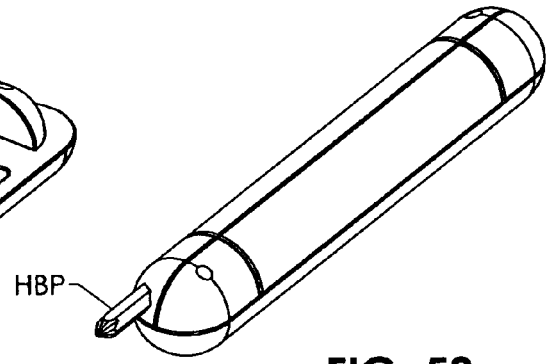
Figure 59:
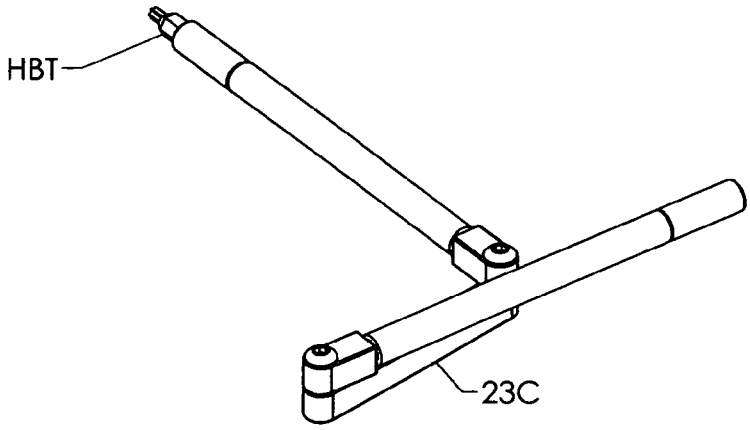
Figure 60A:
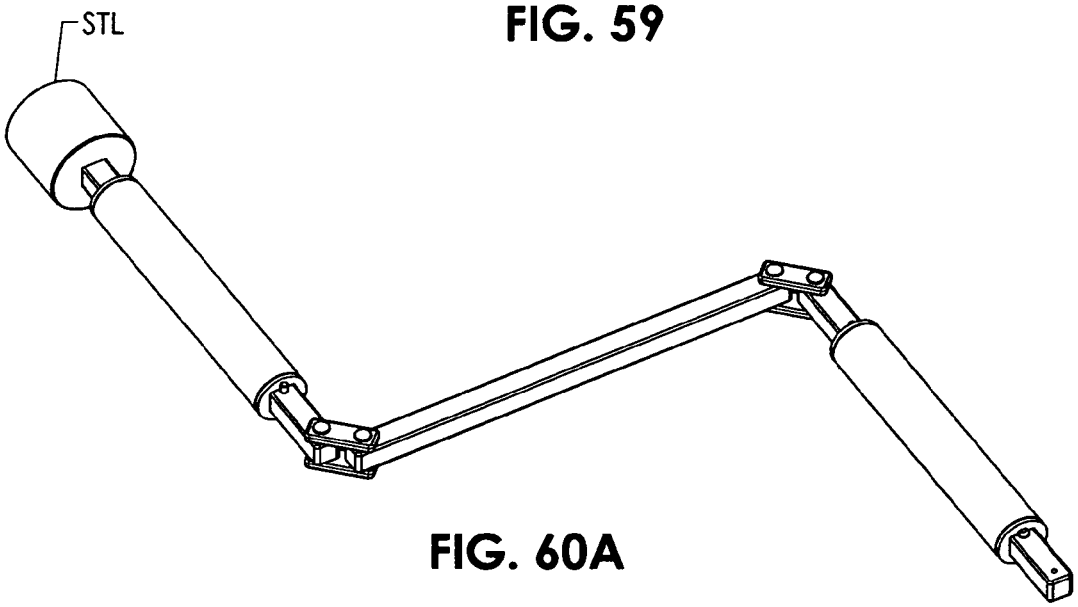
Figure 60B:
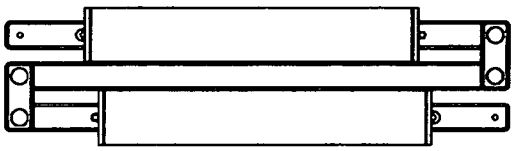

FIG. 10C side view of folded configuration
FIG. 10D bottom view of folded configuration
FIG. 10E end view of folded configuration
FIGS. 11A to 11H show views of an eleventh embodiment with single shear pivots and input and output in the same plane, which folds into a capsule shape.
FIG. 11A perspective view in cranking configuration
FIG. 11B exploded perspective view in cranking configuration
FIG. 11C detail view of pivot end fitting
FIG. 11D perspective view of folded configuration
FIG. 11E plan view of folded configuration
FIG. 11F side view of folded configuration
FIG. 11G bottom view of folded configuration
FIG. 11H end view of folded configuration
FIGS. 12A to 12G show views of a twelfth embodiment with multiple hexagon socket adapter hubs.
FIG. 12A perspective view in cranking configuration
FIG. 12B exploded perspective view of one input/output
FIG. 12C detail view of multiple hexagon socket adapter hub
FIG. 12D plan view of folded configuration
FIG. 12E plan view in maximum torque mode
FIG. 12F plan view in greatest maximum torque mode
FIG. 12G detail view of shoulder washer with square flats on ID
FIGS. 13A to 21 show additional alternate construction methods for the connecting member, all in perspective views
FIG. 13A sheet metal flanges, tubular spacers, and rivets
FIG. 13B is 13A exploded
FIG. 14A sheet metal flanges and sheet metal web spacer
FIG. 14B is 14A exploded
FIG. 15A sheet metal identical 'U', formed and riveted
FIG. 15B is 15A exploded
FIG. 16A sheet metal formed mirror image halves and welded
FIG. 16B is 16A exploded
FIG. 17A tube with welded on formed ends
FIG. 17B is 17A exploded
FIG. 18A bar with sheet metal ends riveted
FIG. 18B is 18A exploded
FIG. 19 single square or rectangular tube
FIG. 20 square or rectangular bar with angled ends
FIG. 21 roller chain
FIGS. 22A to 29 show additional alternate construction methods for end member shafts, all in perspective views, unless otherwise noted as a cross section.
FIG. 22A square bar with broken corners and grooves
FIG. 22B cross section of 22A
FIG. 23 square bar with broken corners and pin holes
FIG. 24A square bar with radiused corners and groove
FIG. 24B cross section of 24A
FIG. 25 square bar with angled (bent) end
FIG. 26 round bar with integral shoulder, snap ring groove, formed clevis, and angled end
FIG. 27 round bar and clevis machined from round stock
FIG. 28 square tube
FIG. 29 hex bar for press on end fittings
FIGS. 30 to 46B show additional alternate handle construction methods, all in perspective views, unless otherwise noted as a cross section
FIG. 30 round handle with spherical ends
FIG. 31 round handle with bulged center with flanged ends
FIG. 32 round handle with valleys for fingers and thumb
FIG. 33 round handle with small flanged ends
FIG. 34 round handle with large flanged ends
FIG. 35A triangular handle with round hole
FIG. 35B cross section of 35A
FIG. 36A square handle with round hole
FIG. 36B cross section of 36A
FIG. 37A hexagon handle with round hole
FIG. 37B cross section of 37A
FIG. 38A quarter circular handle with round hole
FIG. 38B cross section of 38A
FIG. 39A half circle handle with round hole
FIG. 39B cross section of 39A
FIG. 40A less than half circle handle with round hole
FIG. 40B cross section of 40A
FIG. 41A elliptical handle with round hole
FIG. 41B cross section of 41A
FIG. 42 round handle with round hole and diamond groove pattern
FIG. 43 round handle with round hole and grooves
FIG. 44A triangular handle with triangular hole
FIG. 44B cross section of 44A
FIG. 45A square handle with square hole
FIG. 45B cross section of 45A
FIG. 46A hexagon handle with hexagon hole
FIG. 46B cross section of 46A
FIGS. 47A to 60B show perspective views of various embodiments with adapters attached to provide some illustrations as to how the tool may be used and to illustrate some of the many design variations.
FIG. 47A shows the fourth embodiment in cranking configuration, with Phillips hex bit and square drive hexagon socket
FIG. 47B shows the fourth embodiment in cranking configuration, with Phillips hex bit and square drive hexagon socket, but with four sliding thrust flanges
FIG. 48 shows the fourth embodiment in cranking configuration, having a shorter connecting member for emphasis on speed, with Phillips hex bit, and square drive hexagon socket
FIG. 49 shows the seventh embodiment in cranking configuration, with drill chuck adapter, drill chuck, drill bit and square drive hexagon socket
FIG. 50 shows the seventh embodiment in cranking configuration, with socket extension, drill chuck adapter, drill chuck, drill bit and square drive hexagon socket
FIG. 51 shows the seventh embodiment in cranking configuration, with large square drive hexagon socket and medium square drive hexagon socket
FIG. 52 shows the seventh embodiment in cranking configuration, having long connecting member for emphasis on torque, with large square drive hexagon socket, and medium square drive hexagon socket
FIG. 53A shows the twelfth embodiment in cranking configuration, and having two different style multiple adapter hubs
FIG. 53B shows an enlarged view of a hub adapter having multiple types of drives
FIG. 54 shows a variant of the twelfth embodiment in cranking configuration, having adapter hubs on both ends of the input/output members
FIG. 55 shows the eighth embodiment in cranking configuration, having small round handles for grasping with just two fingers and an thumb, with Phillips hex bit and Torx hex bit
FIG. 56 shows the ninth embodiment in cranking configuration, with square tip hex bit and Phillips tip hex bit
FIG. 57 shows the eleventh embodiment in cranking configuration, with square drive hex bit and Phillips hex bit
FIG. 58 shows the eleventh embodiment in folded configuration, for use like a conventional screwdriver, with Phillips hex bit FIG. 59 shows the tenth embodiment having a short connecting member, configured for use like a tee handle FIG. 60A shows a variant of the seventh embodiment in cranking configuration, with a connecting member made of multiple links FIG. 60B is FIG. 60A in folded configuration forces, for enhanced comfort, for styling or for coloring. Either or both of these could be used to improve the ergonomics and appearance of the tool.

DETAILED DESCRIPTION OF USE VARIATIONS.

FIGS. 47A-60B

The tool can be used to rotate or drill a plurality of objects. The tool members can also be made such that they are better suited to particular uses. The purpose of this section is to help illustrate some of the various ways the tool can be made and used.

FIG. 47A shows the fourth embodiment in cranking configuration. The left input/output member has a hex bit adapter tip with a Phillips hex bit HBP in it. The right input/output member has a /1;4" square drive with a /1;4" drive small hex socket SQS attached. This might be used for doing light mechanical work involving Phillips tip screws and small hexagon head fasteners.

FIG. 47B is the same as FIG. 47A but with the addition of a second sliding thrust flange 53A on each input/output member. The second sliding flange 53A can be slid to the opposite end of the handle as the first sliding flange 53A. In high speed mode, if the right hand pulls lightly against the second sliding flange 53A it helps in holding the tool in that shape. Both sliding flanges 53A can be slid outboard to facilitate folding of the tool. Alternatively when applying axial force the flanges could be placed together and let rotate against each other, one turning with the input/output and the other staying fixed against the hand. This may reduce the friction.

FIG. 48 shows the fourth embodiment in cranking configuration. This is the same as FIG. 47A except that a connecting member 22C is shorter to emphasize speed, but at the expense of torque.

FIG. 49 shows the seventh embodiment in cranking configuration. In this case the input/output members are each attached to the connecting member 22B with an easily removable ball detent pin 51D. The left input/output member has a ⅜" square drive to which is attached a drill chuck adapter DCA having ⅜" square drive ×⅜-24 thread (drill chuck thread) to which is attached a keyless drill chuck DC holding a twist drill bit DB. The right input/output member has a ⅜" square drive with a ⅜" drive medium size hex socket STM attached. The drill could be used to drill pilot holes in wood and then the hexagon socket for installing large hexagon head screws (lag bolts) in the holes. The projection of the drill bit does not interfere with the operator's right fore arm when using the other end of the tool with the hexagon socket to rotate and object.

An adapter for square drive to drill chuck DCA can be made adapt to multiple sizes by having stepped square sockets and threads. For example a ½" square socket with a ⅜" square socket in its bottom. The socket sides may include depressions or grooves for engagement by a retaining mechanism on the square drive. The drill chuck mounting end could have 1/2-20 threads inboard and then step down to 3/8-24 threads outboard, for mounting drill chucks with either ½-20 or ⅜-24 size thread. A shoulder at the base of each thread provides a stop against which the drill chuck can be tightened to help prevent its coming loose. The threaded end could also have a smaller tapped center hole, say ¼-20 left hand thread, for a left hand thread retaining screw to assist in retaining the drill chuck when it is being turned in a direction that would loosen it on its mounting threads.

The drill chuck adapter could also be made to attach to a hex bit socket adapter. The end opposite the drill chuck mounting threads would be made of hexagon shape, of a size and length to fit known hex bit socket adapter sizes. The hexagon may include a groove for use by a retaining mechanism in the mating hex bit adapter socket.

FIG. 50 shows the same components as FIG. 49 but adds a standard ⅜" ×6" socket extension SET between the tools ⅜" square drive and the drill chuck adapter. This extra length increases the ability to hold the drill bit in alignment with the hole being drilled. The extension places the steady hand farther from the drill tip, so a given lateral movement causes less angular misalignment of the drill. The longer the extension, the greater the ability to hold the drill in alignment. Also, if a wobble end extension is used, it will allow the drill bit to self align with the hole as long as the extension and tool are kept within the angular limits of the wobble. The wobble may make the drill harder to start at the desired angle (perhaps normal to the work piece) but can greatly reduce the bending stress on the drill bit due to misalignment of the tool with the hole during drilling.

FIG. 51 shows the seventh embodiment in cranking configuration. The left input/output member has a ⅜" square drive with a ⅜" square drive large size hexagon socket STL. The right input/output member has a ⅜" square drive with a ⅜" drive medium size hex socket STM attached. This might be used for medium duty mechanical work involving hexagon nuts and hexagon head fasteners.

The input/output members are each attached to the connecting member 22B with the ball detent pin 51D. These are retained by a sprung ball but easily removable by pulling on the ring and easily installed by pushing into the hole. The removable ball detent pins 51D allow the input/outputs and connecting member to be easily changed. An input/output can be changed to one with of a different size, drive or tip. The connecting member 22B could be changed to a short one to emphasize speed or a long one to emphasize torque.

FIG. 52 shows the same components as FIG. 51 except that a connecting member 22D is much longer. The longer connecting member enables greater torque but at the expense of speed. This may be preferred for heavy duty applications such as large lag screws, high torque fasteners or for driving machinery.

FIG. 53A shows the twelfth embodiment in cranking configuration. The adapter hub 36A with four sizes of hexagon sockets is on the left and an adapter hub 36E with the square drive 32B, a hexagon key drive tip 37, the Phillips drive tip 31, and a Torx drive tip 35 is on the right end. This could be a special purpose tool for working on a specific piece of equipment that requires just those sockets and drive tips.

FIG. 53B shows an enlarged perspective view of the adapter hub 36E with multiple type drive tips.

FIG. 54 shows a variant of the twelfth embodiment in cranking configuration. An end shaft 20 has a clevis on each end holding the four hexagon socket adapter hubs 36A, 36B, 36C, and 36D. The two inboard adapter hubs 36C and 36D and their devises act as the pivots between the connecting member and the input/output members. A connecting member 27 has ends that attach inside one of the sockets of each adapter. The connecting member's attachment to the adapter hubs 36C and 36D must prevent rotation about the axis of the connector and hold the pivot axes parallel.

The attachment could be a square hole at the base of one of the hexagon sockets or a separate dedicated socket on the hub. The connecting member 27 could have square ends that are retained by some known means such as a locking ball detent. Either of the input/output members can be turned end for end and attached to the connecting member 27 so that any desired adapter hub and socket is outboard and available for use.

Since the end shaft 20 has a clevis on both ends, a cylindrical handle cannot be slipped over one end. The handle can be split into two parts for assembly. If made of thermo plastic material and in halves, it could be glued, heat welded or ultrasonically welded together. Handle halves could also be held together with a wrap of adhesive tape, similar to the tape on a tennis racket, baseball bat or golf club.

FIG. 55 shows the eighth embodiment in cranking configuration. The left input/output has a hex bit socket with Phillips hex bit HBP. The right input/output has a hex bit socket with a Torx hex bit HBT in it. Each input/output has a rotating handle 43 that is a small round discs which is held between two fingers and a thumb. A short connecting member 23B is for high speed and light duty work. This might be useful for very light duty work with very small Phillips and torx headed screws, such as a small electronic assembly.

FIG. 56 shows the ninth embodiment in cranking configuration. The left input/output has a hex bit socket with square drive hex bit HBSQ. The right input/output has a hex bit socket with Phillips hex bit HBP. This might be useful for light duty work with square drive and Phillips headed screws.

FIG. 57 shows the eleventh embodiment in cranking configuration. The left input/output member has a hex bit adapter tip with a square drive hex bit HBSQ in it. The right input/output member has a hex bit adapter with a Phillips hex bit in it HBP. This might be used for doing light mechanical or electronic work involving square drive and Phillips headed fasteners.

The connecting member 24 has a Torx hex bit HBT stored in one cavity 105 and a straight hex bit HBS stored in another cavity 105. Two other cavities 105 are empty and can be used for storing the two hex bits being used.

FIG. 58 shows the eleventh embodiment in folded configuration. One of the input/outputs has a hex bit socket with Phillips hex bit HBP. This can be held and used like a conventional screw driver. It might be useful for slight adjustments of a screw or for starting a screw with only one hand while holding the work piece with the other hand.

FIG. 59 shows the tenth embodiment with a short connecting member 23C about half the length of the input/output members. The short connecting member 23C emphasizes speed. It can be folded such that it can be gripped with only one hand and used much like a conventional T-wrench, if desired. One input/output is folded out for use as a T-wrench and has a torx hex bit in it HTB. The other input/output is left folded against the connecting member. The folded input/output and connecting member are grasped with one hand, like a conventional T-wrench, with two fingers on each side of the unfolded input/output. The middle of the folded input/output handle bears against the pivot end fitting of the folded out input/output handle to transmit axial force from the grip though to urge engagement with the object to be rotated. This illustrates one of the multitude of ways the tool can be used, which is in addition to those previously described for the standard operation of the embodiments.

FIG. 60A shows a variant of the seventh embodiment with connecting member having multiple links. It is shown in cranking configuration with a square drive large hex socket STL on the left end and nothing on the right end. The end member shafts and long center link are all made from the same 7" long × 3/8" square section steel bar blanks. All the holes for the pivot pin, shoulder washer retaining pins and ball detent are drilled from the same side of the bar. The four short links are made from ⅛"×⅜×1 ⅛" long blanks. It holes could be punched, drilled or lasered. The links are riveted to the other members but such that all the joints are still free to pivot. The shoulder washers with square holes are retained by groove pins or similar self retained pins. The handle is made of simple round steel tubing. This design uses very economical raw material and requires no lathe work, only drilling. The multiple links make it harder to hold a desired configuration shape during use but do allow the tool to fold compactly. It is shown without pivot rotation stops and the links make their design awkward.

FIG. 60B shows the tool of FIG. 60A in folded configuration without the socket.

DRAWINGS

Reference Numerals

List of reference numerals for parts shown in this application, construction details, and ancillary items used to illustrate use of the invention.

| END MEMBERS AND END SHAFTS | |
|---|---|
| 11 | end member, of round bar with single thrust flange and Phillips tip |
| 13 | end member, of round bar with two thrust flanges and Phillips tip |
| 14 | end member, of round bar with single thrust flange and 1/4" square drive |
| 15 | end member, of round bar with two thrust flanges and 1/4" square drive |
| 16A | end shaft, of round bar grooved and machined for 1/4" square drive |
| 16B | end shaft, of round bar grooved and machined for 3/8" square drive |
| 17 | end shaft, of round bar grooved and machined for hex bit adapter |
| 18 | end shaft, of round bar machined for press fit hex bit adapter |
| 19 | end shaft, with clevis |
| 20 | end shaft, with clevis on each end |

| CONNECTING MEMBERS | |
|---|---|
| 21A | connecting member, of rectangular bar with straight deep clevis |
| 21B | connecting member, of rectangular bar with straight shallow clevis |
| 22A | connecting member, of rectangular bar with angled clevis small |
| 22B | connecting member, of rectangular bar with angled clevis medium |
| 22C | connecting member, of rectangular bar with angled clevis small short |
| 22D | connecting member, of rectangular bar with angled clevis medium long |
| 23A | connecting member, of rectangular bar with tapped ends |
| 23B | connecting member, of rectangular bar with tapped ends short |
| 23C | connecting member, of rectangular bar with tapped ends short for use as tee handle |
| 24 | connecting member, of half round bar with through holes |
| 27 | connecting member, of round bar with ends to attach to four hexagon socket adapter hub |

| DRIVE TIPS, DRIVES AND ADAPTER HUBS | |
|---|---|
| 31 | Phillips drive tip |
| 32A | 1/4" square drive |
| 32B | 3/8" square drive |
| 34 | hex bit socket |
| 35 | torx drive tip |
| 36A | adapter hub, with four hexagon sockets, size range A |

-continued

DRIVE TIPS, DRIVES AND ADAPTER HUBS

| | |
|---|---|
| 36B | adapter hub, with four hexagon sockets, size range B |
| 36C | adapter hub, with four hexagon sockets, size range C |
| 36D | adapter hub, with four hexagon sockets, size range D |
| 36E | adapter hub, with four different drive types |
| 37 | hex key drive tip |

ROTATING HANDLES

| | |
|---|---|
| 41A | rotating handle, of small round tube |
| 41B | rotating handle, of medium size round tube, for bushings |
| 41C | rotating handle, of small round tube, for use on shaft with press on end fittings |
| 41D | rotating handle, of medium tube, for ball bearings |
| 41E | rotating handle, of medium tube, plain |
| 42 | rotating handle, of quarter circle cross section |
| 43 | rotating handle, of small round discs |

MISCELLANEOUS COMPONENTS AND HARDWARE

| | |
|---|---|
| 51A | headed pin, small |
| 51B | headed pin, medium |
| 51C | headed pin, for adapter hub |
| 51D | ball detent pin, removable |
| 52A | spiral snap ring, small |
| 52B | spiral snap ring, medium |
| 52C | spiral snap ring, large |
| 53A | sliding thrust flange |
| 53B | sliding thrust flange, for use with rotating handle |
| 54A | shoulder washer, small with two flats on inside, for small size shaft |
| 54B | shoulder washer, medium with two flats on inside, for small size shaft |
| 54C | shoulder washer, medium with two flats on inside, for medium size shaft |
| 54D | shoulder washer, medium with four flats on inside |
| 55 | flange bushing |
| 56A | hex bit adapter, round body |
| 56B | hex bit adapter, quarter circle body |
| 57 | magnet |
| 58 | screw, for pivot |
| 59A | pivot end fitting, press on to shaft |
| 59B | pivot end fitting, press on, with stop, right hand |
| 59C | pivot end fitting, press on with stop, left hand |
| 59D | pivot end fitting, press on, quarter circle body |
| 60 | ball bearing |
| 61 | thrust bearing washer |
| 62 | plain bushing |

CONSTRUCTION FEATURES

| | |
|---|---|
| 91A | outer fixed thrust flange |
| 91B | inner fixed thrust flange |
| 92A | pin hole, in clevis, any size |
| 92B | pin hole, in end member or shaft, any size |
| 92C | screw hole, in pivot end fitting |
| 92D | threaded hole, for screw in connecting member |
| 92E | counterbored screw hole, in connecting member |
| 92F | threaded hole, for screw in pivot end fitting |
| 93A | clevis, with deep opening |
| 93B | clevis, with shallow opening |
| 93C | clevis, on angled end |
| 94 | single shear pivot |
| 95 | hexagon shaped end, of end member |
| 96A | pivot rotation stop, of straight shallow clevis |
| 96B | pivot rotation stop, face at root of angled clevis |

-continued

CONSTRUCTION FEATURES

| | |
|---|---|
| 96C | pivot rotation stop, block on press on end |
| 97 | clearance face, face at root of angled clevis |
| 98A | parallel flats, 1/4" apart |
| 98B | parallel flats, 3/8 apart |
| 99 | hexagon hole, for press fits |
| 100 | full radius, end on any end member |
| 101A | snap ring groove, in small round shaft |
| 101B | snap ring groove, in medium round shaft |
| 101C | snap ring groove, in square shaft corners only |
| 102A | shoulders, for shoulder washer on round member, any size |
| 102B | shoulders, for shoulder washer on square member, any size |
| 103 | sprung ball, for engaging detent on attachment, such as a socket, any size |
| 104 | counterbore, for bearing |
| 105 | cavity, for storage of hex bits |
| 106 | clevis, for adapter hub |

COMPONENTS OF CONNECTING MEMBER VARIATIONS

| | |
|---|---|
| 201 | flange, for rivets |
| 202 | tubular spacer |
| 203 | rivet, for flanges |
| 204 | flange, for plate web |
| 205 | plate web |
| 206 | rivet, for pivot |
| 207 | U, for I beam |
| 208 | rivet, for U |
| 209 | rivet, for pivot |
| 210 | spacer, for pivot |
| 211A | U, for tube, mirror image of 211B |
| 211B | U, for tube, mirror image of 211A |
| 212 | square tube |
| 213 | clevis, for pivot |
| 214 | rivet, for pivot |
| 215 | rectangular bar |
| 216 | L lug |
| 217 | rivet, for pivot and attaching L shaped lugs |
| 220 | rectangular tube |
| 221 | bent rectangular bar |
| 222 | roller chain |

END MEMBER SHAFT VARIATIONS

| | |
|---|---|
| 301 | square shaft, with broken corners and snap ring grooves |
| 302 | square shaft, with broken corners and pin holes |
| 303 | square shaft, with radius corners |
| 304 | square shaft, with broken corners and bent end |
| 305 | round shaft, with formed angled clevis end |
| 306 | round shaft, with clevis machined |
| 307 | square tube shaft, with rounded corners |
| 308 | hexagon shaft |

HANDLE VARIATIONS

| | |
|---|---|
| 401 | round handle, with spherical ends, round hole |
| 402 | round handle, with bulged center with flanged ends, round hole |
| 403 | round handle, with valleys for fingers and thumb, round hole |
| 404 | round handle, with small flanged ends, round hole |
| 405 | round handle, with large flanged ends, round hole |
| 406 | triangular cross section handle, round hole |
| 407 | square cross section handle, round hole |
| 408 | hexagonal cross section handle, round hole |
| 409 | quarter circular cross section handle, round hole |
| 410 | half circular cross section handle, round hole |
| 411 | less than half circular cross section handle, round hole |

-continued

| HANDLE VARIATIONS | |
|---|---|
| 412 | elliptical cross section handle, round hole |
| 413 | round handle, with diamond pattern, round hole |
| 414 | round handle, with grooves, round hole |
| 415 | triangular handle, triangular hole |
| 416 | square handle, square hole |
| 417 | hexagon, hexagon hole |

| ANCILLARY ITEMS USED TO ILLUSTRATE OPERATION | |
|---|---|
| DB | drill bit |
| DC | drill chuck |
| DCA | drill chuck to square drive adapter |
| HBP | Phillips hex bit |
| HBS | hex bit straight blade |
| HBSQ | square drive hex bit |
| HBT | Torx hex bit |
| L | left hand |
| R | right hand |
| SET | socket extension, three eights inch drive |
| SQS | hex socket, quarter inch drive, small size |
| STL | hex socket, three eighths inch drive, large size |
| STM | hex socket, three eighths inch drive, medium size |

| GLOSSARY | |
|---|---|
| adapter hub | A rotatable hub having multiple drive tips or drives extending radially from it. |
| configuration | A position or shape the members are placed in for a specific operation such as high speed, cranking, maximum torque or storage. |
| connecting member | The middle member or assembly that is between and connects to the two end members. |
| drive tip | An end boss or socket of a specific size and shape for direct engagement of an object which has a mating size and shape socket or boss. Examples include Phillips, Torx, and hex key. |
| drive | A boss or socket of a specific size and shape for engaging a specific type of adapter which will drive an object. Examples are 3/8" square drive and hex bit socket. |
| end member | One of the outer disposed members, in particular one that does not accept a rotating handle. |
| end shaft | One of the outer disposed members, in particular one that accepts a rotating handle or sliding thrust flange. |
| engagement | Two objects fitting together so as to be rotationally coupled, their rotation with respect to each other is fixed. Normally the engagement is maintained and enhanced by pushing the objects together and released by pulling them apart. |
| hex bit | A member of hexagonal cross section with drive tip on one or both ends. The most common size hex bits are 1/4" across the hexagon flats. |
| hex drill | A hex bit with integral drill bit extending from one end. |
| ID | inside diameter |
| input member | Any input/output member being used as an input. |
| input/output member | Either of the outer disposed members. It can be used as either an input to effect rotation or as an output to couple to something. |
| OD | outside diameter |
| output member | Any input/output member being used as an output. |
| Phillips | A specific drive tip that is shaped as a tapered cross (four lobes). Also refers to the corresponding cavity that couples with that shape. |
| pivot stop | A means of limiting the pivot angle between the connecting member and an input/output member. |
| pivotably | A means of connecting members such that they can pivot or rotate about a common axis with respect to each other but not translate along the axis with respect to each other. |

-continued

| GLOSSARY | |
|---|---|
| sliding thrust flange | A sliding and rotating flange on an end shaft that can be repositioned between sliding travel limits and then pressed against to apply axial force. |
| thrust flange | A fixed flange on and end member that can be pressed against to apply axial force. |
| Torx | A specific drive tip shape with six lobes and six recesses. Also refers to the corresponding cavity that couples with that shape. |

DETAILED DESCRIPTION

While the application will be described in connection with several particular embodiments, including sizes, materials, and combinations, it will be understood that it is not intended to limit the application to those embodiments. On the contrary, it is intended to cover all alternatives, modifications, combinations, equivalents, sizes, and materials as may be included within the spirit and scope of the application as defined by the appended claims. Also, the described preferred methods of grasping and using the tool are not intended to limit the ways in which it can be used and other means and other methods of use are intended to be included. The objects to be rotated are given as examples and the intention is to encompass all objects that can be manually rotated or manually have a torque applied.

The descriptions of the embodiments will start with the most basic and then successive embodiments will add further features or parts or vary the parameters and arrangement, which changes the functionality or performance of the tool. Then various alternative construction methods of selected parts and sub assemblies will be shown and described. Lastly, examples of tool variations and uses will be shown and described, including selected attached adapters.

DETAILED DESCRIPTION

First Embodiment—FIGS. 1A to 1D

A first embodiment is shown in FIGS. 1A to 1D. FIG. 1B shows that it is comprised of three main elongated members that are pivotably connected: a connecting member 21A, a first end member 11 and a second end member 14. The connecting and end members are each pivotably connected together with a rivet or headed pin 51A to allow the joints to pivot.

FIG. 1B shows that the connecting member 21A is a solid steel bar approximately 6" long of rectangular cross section approximately ⅜"×⅝". FIG. 1D shows an enlarged view of the connecting member's end. Both ends of the connecting member have a clevis 93A machined about ⅝" deep and of inside width to accept a ¼" thick member. Each of the clevises 93A have an ⅛" diameter pin hole 92A drilled on the center of the ⅜" face of the bar and 3/16" in from the end. The axes of the holes 92A in the two clevises area are parallel to each other and approximately perpendicular to the member's centerline. Between the clevises, the bar is shown milled down on two sides so it is ⅜"×⅜" in cross section and then tapers up to the ⅜"×⅝" cross section of the clevis ends. This milling down is only to lighten the tool and not otherwise necessary. The connecting member 21A could be formed to near net shape by forging, casting or other means. Steel performs well but any other substantially rigid material, including but not limited to, aluminum or titanium, would also work.

FIG. 1B shows the first end member 11 is a solid smooth steel bar of circular cross section approximately 6 inches long and approximately ⅜" in diameter. FIG. 1C shows an enlarged view of the end member's inboard end. This end has a pair of parallel flats 98A machined on two sides to make it approximately ¼" thick there. The flat area has an ⅛" diameter pin hole 92B drilled through it normal to the flats, centered on the flat and about 3/16" in from the end. The other end is machined or formed into a Phillips drive tip 31, of known shape and dimensions. However, the outboard tip could be comprised of any drive type including known drive tips such as Torx (star drive) and hex key. The outboard end of the end member may also have means to drive known tools or adapters such as square drive, hexagon socket or drill chuck. It may have a means to couple to a shaft drive such as, a round socket with notch for shaft with cross pin, coupling fingers, spline, etc. An outer fixed thrust flange 91A of about 1" outside diameter, ⅜" inside diameter, and ⅛" thick is slid onto the member about 1" from the end with the Phillips tip 31 and then welded to the bar with a 1/16" fillet weld all around and on each side. Alternatively the first end member 11 could be turned and machined from a solid bar about 1" in diameter×6" long. The bar and flange should be relatively smooth and with rounded flange edges. Steel performs well but other substantially rigid materials, including but not limited to, aluminum or titanium, would also work.

FIG. 1B shows the second end member 14 is a solid smooth steel bar of circular cross section approximately 6 inches long and approximately ⅜" in diameter. FIG. 1C shows an enlarged view of the end member's inboard end, which is the same as the first end member's inboard end. The outboard end of the second end member is machined into a ¼" square drive 32A of known dimensions. It includes a sprung ball 103 of known design for engaging adapters such as a socket. As with the first end member, the outboard tip could be comprised of any drive type or adapter.

The first end member 11 and second end member 14 are attached to the connecting member 21A by inserting the ends with flats 98A and pin hole 92B into the clevises 93A and lining up the holes. The headed steel pin 51A of slightly less than ⅛" diameter and ¾" long is inserted through the hole 92A in the clevis and the hole 92B in the end member. The pin's non headed end is then punched or formed to retain it in the clevis but not so much that it causes the clevis opening to narrow and bind the pivot joint. The end members should pivot, or swivel, freely on the connecting member 21A and move easily with little or no resistance. When pivoting, all three members remain in substantially the same plane.

OPERATION

First Embodiment—FIGS. 1E to 1J

FIG. 1E shows the operation in high speed configuration (shape). To produce high speed rotation the first end member 11 is grasped by the left hand L, preferably with thumb towards the pivoted joint. The grasp must be firm and tight enough to hold the member steady but loose enough to allow it to rotate within the grasp. The second end member 14 is grasped by the right hand R, preferably with thumb towards the pivoted joint. The grasp must be tight and firm enough to urge the member but loose enough to allow the member to rotate within the grasp. The first end member's outboard end of the Phillips tip 31 engages the object to be rotated. The left hand L on the output member pushes against the adjacent thrust flange 91A to urge the tool against the object to be rotated so as to maintain the engagement and also holds the output end member 11 in axial alignment with the object to be rotated. The right hand Ron second end member 14 provides the rotational input. FIG. 1E shows that for rapid rotation with little torque, the connecting member 21A and the second end member 14 are each held at small angles, say 30 degrees, in opposite directions to the first end member 11. The second end member 14 is then rapidly swiveled with a wrist motion using the right hand R. The second end member's 14 inner disposed end orbits about the axis of the first end member 11 and the second end member's outer disposed end stays approximately in line with the axis of the first end member 11. The first end member 11 rotates in the left hand L. The first end member 11 with Phillips tip acts as an output member, to rotate the object, and the second end member 14 acts as an input member, creating the rotation.

FIG. 1F shows the operation in cranking configuration (shape) for using the Phillips tip 31 end to rotate something. The cranking configuration is used to produce more torque but at less rotational speed. As before, the first end member 11 is grasped by the left hand L and second end member 14 is grasped by the right hand R, and each member is pivoted to be approximately perpendicular with the connecting member 21A. The left hand L pushes against the adjacent thrust flange 91A to urge the tool against the object to be rotated so as to maintain the engagement and also holds the output end member 11 in axial alignment with the object to be rotated. The second end member 14 is then cranked about the first end member 11 with the right hand R. The first end member 11 with Phillips tip 31 acts as an output member, to rotate something, and the second end member 14 acts as an input member, creating the rotation and torque.

FIG. 1G shows the operation in cranking configuration (shape) for using the square drive 32A end to rotate something. The second end member 14 and first end member 11, are grasped by left hand L and right hand R respectively and pivoted to be approximately perpendicular with the connecting member 21A. The left hand L pushes against the adjacent thrust flange 91A to urge the tool against the object to be rotated so as to maintain the engagement and also holds the second end member 14 in axial alignment with the object to be rotated. The right hand R is used to crank the first end member 11 about the second end member 14. The second end member 14 with square drive 32A acts as the output member, to rotate something, and the first end member 11 acts as the input member, creating the rotation and torque.

FIG. 1H shows the operation in maximum torque configuration (shape) for using the Phillips tip 31 end to rotate something. To produce maximum torque the second end member 14 and the connecting member 21A are held in line with each other and both are then held approximately perpendicular to the first end member 11. The left hand L grasps the first end member 11 and pushes against the adjacent thrust flange 91A to urge the tool against the object to be rotated, so as to maintain the engagement, and also holds the first end member 11 in axial alignment with the object to be rotated. The second end member 14 is grasped by the right hand R which pushes or pulls (into or out of the page) to create the torque.

An example of using the tool is, screwing a Phillips head screw (not shown) into wood (not show). At first the screw turns easily and the tool is used in the high speed configuration FIG. 1E. As the screw goes in, it gets harder to turn. While continuing to rotate the tool, its configuration can be fluidly changed from high speed configuration into the cranking configuration FIG. 1F. As the screw gets harder to turn, more axial force can be applied with the left hand L against the thrust flange 91A to urge engagement of the Phillips tip 31 with the Phillips head screw and to prevent it from caming out and damaging the screw or Phillips tip 31. For a final tightening of the screw, the tool can be used in the maximum torque configuration FIG. 1H. The left hand L grasps the first end member 11 and pushes against the thrust flange 91A to urge the tool against the Phillips head screw and maintain engagement. The left hand L also holds the first end member 11 in axial alignment with the screw. The right hand R pushes (into the page) to create the torque to tighten the screw. Since the joints are free to pivot, the tool can easily and smoothly morph or change from one configuration to another as the torque requirements change. Thus, allowing the optimum combination of torque and speed to be used, without stopping, while installing the screw.

Another example of the operation is to remove a Phillips head screw (not show) that is fully screwed into wood (not show). At first the screw is very hard to turn and the maximum torque configuration FIG. 1H could be used for the initial loosening. The left hand L grasps the first end member 11 and pushes against the thrust flange 91A to urge the tool against the Phillips head screw and maintain engagement. The left hand L also holds the first end member 11 in axial alignment with the screw. The right hand R grasps the second end member 14 pulls (out of the page) to create the torque to loosen the screw. Next the cranking configuration FIG. 1F is used to further rotate the screw. As the screw comes out it gets easier to turn. While continuing to rotate the tool, its configuration can smoothly be morphed from the cranking configuration into the high speed configuration FIG. 1E to rapidly finish removal of the screw.

Since the joints are free to pivot, the tool can easily and fluidly morph or change from one configuration to another as the torque requirements change. Thus, allowing the user to optimize the combination of torque, rotational speed, and or axial force applied, without stopping, while installing or removing the screw.

Either end of the tool can be used to rotate an object by simply swapping hands on the end members. That is if the person is right handed, where it is most ergonomic to steady with the left hand L and create the rotation and torque with the right hand R. A left handed person may hold the tool just opposite. An ambidextrous person could use either end of the tool without swapping hands.

This embodiment illustrates that two different types of drives can be used without changing any adapters. This increases the efficiency and usefulness of the tool by allowing either end to be used. The drive ends can be the same on both end members or different. If two of the same drives are employed, then if one fails or wears out then the other can be used. For example both drive ends could be ¼" square drive 32A or one end Phillips tip 31 and the other flat blade or one end hex bit socket and the other ¼" square drive 32A or one end ¼" square drive 32A and the other end ⅜" square drive, a Phillips tip 31 on one end and on the other a drill chuck with pilot drill bit, etc.

NAMING CONVENTION FOR END MEMBERS

Every tool embodiment has a first end member and a second end member and they may be of the same or different size and design. The above examples illustrate that either of the two outboard ends of the tool can be used to rotate an object. Either the first or second end member can act as the output, which engages the object to be rotated, and holds the tool in alignment. Either the first or second end member can act as the input which is swiveled, cranked or used as a lever to create rotary motion and torque. Either end can be used by swapping the tool end for end in the hands. Hereupon, any first and second end members will collectively be referred to as "input/output members". When one is used to engage an object to be rotated it will be referred to as the "output member" (normally held by the left hand). When one is orbited around the other to create rotary motion or torque it will be referred to as the "input member" (normally held by the right hand).

STORAGE

First Embodiment—FIGS. 1I and 1J

FIG. 1J shows that for storage the members can all be put in a straight line to fit within a cylindrical volume approximately 1" diameter and 18⅜" long. It could be hung on the wall this way. Alternatively, FIG. 1I shows that for storage the members can be pivoted until the end members 11 and 14 contact the root of the connecting member's 21A clevis 93A to form a Z configuration and will fit within a rectangular volume approximately 1"×5"×8½".

DETAILED DESCRIPTION

Second Embodiment—FIGS. 2A-2D, 2G and 2J

FIG. 2A shows a second embodiment that is similar to the first embodiment. An inboard fixed thrust flange 91B of about 1" outside diameter, ⅜" inside diameter, and ⅛" thick is slid onto each input/output member about 1" from the end with the pivot hole and then welded to the bar with a 1/16" fillet weld all around and on each side. The flange is of sufficient size and smoothness that an axial force can be applied against it with the hand while the tool is rotated. FIG. 2C shows that pivot ends of a first end member 13 and a second end member 15 have a full radius 100 of about 3/16" about the pin hole 92B center line or axis. The radius 100 provides clearance for the end to pivot in a shallow clevis 93B of a connecting member 21B. FIGS. 2D and 2J show the shallow clevis 93B, not as deep as the first embodiment. The clevis depth is about 13/64" past the pin hole centerline. The clevis depth is slightly more than the end member's full radius 100. FIGS. 2I and 2J show the pivoted joint with the connecting member 21B and second end member 15 in a straight line and the radius 100 clearing the bottom of the shallow clevis 93B. FIGS. 2F and 2G show the tool in cranking configuration. The shallow clevis 93B acts as a pivot rotation stop 96A, when either input/output member and the connecting member 21B are pivoted approximately slightly past being perpendicular to each other.

Alternatively the input/output members could be turned and machined from a solid bar about 1" in diameter×6" long. The bar and flange should be relatively smooth and with rounded flange edges. Steel performs well but other substantially rigid materials, including but not limited to, aluminum or titanium, would also work.

OPERATION

Second Embodiment—FIGS. 2E, 2F, 2H, and 2I

FIGS. 2E, 2F, 2H, and 2I show the operation of the second embodiment. FIG. 2E shows it in the configuration for rapid rotation when using the first end member 13 with Phillips 31 tip end as the output member. The left hand L grasps the first end member 13 and pushes against its outboard thrust flange 91A to urge engagement with an object to be rotated (not shown). The right hand R grasps the second end member 15 and with a wrist motion swivels to create rapid rotary motion, acting as the input. To maintain the rapid rotation configuration shape while swiveling, it is helpful to pull lightly against the outboard thrust flange 91A on the input end member 15 with the right hand R.

FIG. 2F shows the operation in cranking configuration when using the Phillips tip 31 end as the output end member 13. The output end member 13 is grasped with the left hand L against its outboard thrust flange 91A and thumb pointed toward the pivot. The input end member 15 is grasped with the right hand R against its inner thrust flange 91B and thumb pointed towards the pivot.

Both the input 15 and output 13 members are pivoted until they contact the root of the connecting member's clevis 93B and stop. FIG. 2G shows that the root of the clevis 93B acts as the pivot rotation stop 96A. This allows axial force from the right hand R on the input member 15 to be transferred through the connecting member 21B, to the output member 13 and apply additional or secondary axial force urging engagement with the object being rotated. The pivot rotation stop 96A does not limit the smooth morphing of the tool when going between high speed, cranking, and high torque configurations.

The left hand L presses against the outer thrust flange 91A to impart primary axial force urging engagement with the object to be rotated and holds the output member 13 in axial alignment with the object to be rotated. The right hand R orbits about the output member 13 in a cranking motion to create rotary motion and torque, and also applies additional axial engagement force.

FIG. 2H shows using the ¼" square drive 32A end as the output member 15 in cranking mode. A ¼" drive socket or other adapter (not shown) may be affixed to the square drive 32A. The output member 15 is grasped with the left hand L against its outboard thrust flange 91A and thumb pointed toward the pivot. The input member 13 is grasped with the right hand R against its inner thrust flange 91B and thumb pointed towards the pivot.

Both the input 13 and output 15 members pivot until they contact the root of the connecting member's clevis 93B and then stop. The root of the clevis acts as the pivot rotation stop 96A. This allows axial force from the hand on the input member 13 to be transferred through the connecting member 21B, to the output member 15 and apply additional or secondary axial force urging engagement with the object being rotated. The pivot rotation stop 96A does not limit the smooth morphing of the tool when going between high speed, cranking, and high torque configurations.

The left hand L presses against the thrust flange 91A to impart primary axial force urging engagement with the object to be rotated and holds the output member 15 in axial alignment with the object to be rotated. The right hand R orbits about the output member 15 in a cranking motion to create rotary motion and torque and apply additional axial engagement force.

FIG. 2I shows the configuration for maximum torque when using the Phillips tip 31 end as the output member 13. The connecting member 21B and input member 15 are placed in line and both of them held perpendicular to the output member 13. The left hand L grasps the output member 13 and holds it in axial alignment with the object to be rotated. The left hand L also pushes against the outer thrust flange 91A to impart axial force urging engagement with the object to be rotated. The right hand R grasps the ¼" drive input member 15 and pushes or pulls (into or out of the page) to impart torque to the object being rotated.

If only one pivot stop 96A and one inboard thrust flange 91B are to be incorporated, then for the secondary axial force to be most easily transmitted through to the output member, it is preferable that the pivot stop be on the output member's pivot. This holds the connecting member 21B at a fixed angle to the output member and allows the input member to press against the connecting member, but still pivot (if desired). If the single pivot stop was placed on the input member's pivot, then to transfer force to the output member the input member would need to be held constantly against the stop and the input handle steadied to do so, this is more awkward for the user. In either case, the inboard thrust flange 91B must be on the input member. If the inner thrust flange were on the output member then the input member would have no flange to press against to create secondary axial force.

FIG. 2L shows that for storage the members can all be put in a straight line to fit within a cylindrical volume approximately 1" diameter and 18⅜" long. Alternatively, FIG. 2K shows that the members can be pivoted until the end members contact the root of the clevis opening to form a Z configuration and will fit within a rectangular volume approximately 1"×6¾"×13". This volume is larger than the first embodiment, due to the shallow clevis 93B acting as the pivot rotation stop 96A.

DETAILED DESCRIPTION

Third Embodiment—FIGS. 3A to 3H

FIGS. 3A to 3H show a third embodiment with input/output members the same as the second embodiment. FIGS. 3G and 3H show that a connecting member 22A has an angled clevis 93C on each end that is angled at approximately 45 degrees to the middle section of the member. The clevis ends are each angled in a direction opposite the other, so that they are approximately parallel. The clevis 93C is a little deeper than the second embodiment's and its root has two surfaces or faces at 90 degrees to each other. Each clevis has a root face that acts as a pivot rotation stop 96B and it is approximately perpendicular to the center axis of the middle section of the connecting member 22A. It acts as the pivot rotation stop 96B in the cranking configuration as shown in FIG. 3D and detail FIG. 3E. Each clevis has a second root face that acts as a clearance face 97 and it is approximately parallel to the center axis of the middle section of the main body of the connecting member 22A and allows clearance for folding compactly as shown in FIG. 3B and detail FIG. 3C. FIG. 3F shows a side view of the connecting member 22A. FIG. 3G shows a section view of the connecting member 22A and points out the rotation stop faces 96B and clearance faces 97. The normal distance from either root face to the pivot axis is approximately equal to half the diameter of the end member's pivot end.

The connecting member can be made via different methods including: from a bar approximately ⅜"×⅝" by 7¾" long by bending the ends to approximately 45 degrees, the angled shape can be machined from a larger bar, and casting or forging to near net shape. Steel performs well but any other substantially rigid material, including but not limited to, aluminum or titanium, would also work.

FIGS. 3D and 3E, show how the clevis root face 96B acts as a rotation stop in the cranking configuration, allowing additional axial force from the hand on the input member 15, to be transmitted through the connecting member 22A, through to the output member 13, and to additionally urge engagement with the object to be rotated.

OPERATION

Third Embodiment—FIG. 3D

The operation is similar to that of the second embodiment. The same configuration shapes and hand positions are used for the speed, crank, and torque modes of operation. FIG. 3D shows cranking configuration and hand placement when using the Phillips tip 31 end to rotate an object.

For storage this embodiment folds compactly as shown in FIG. 3B. It will fit compactly within a rectangular volume approximately 1"×2½"×7⅜". Alternatively the end members can be put in a straight line and will fit within a cylindrical volume approximately 1" diameter and 18⅜" long (not shown). The connecting member will be angled slightly to the end members.

Angling the connecting member ends allows the tool to be folded compactly. Alternatively the connecting member could remain straight and the input/output member's inner ends could be angled or bent to allow compact folding (not shown). The angles of the clevis root faces would need to be adjusted accordingly to allow clearance when folded and act as act as stops when cranking. Another alternative to achieve compact folding is for both the connecting member's ends to be angled and both input/output member's inner disposed ends to be angled (not shown).

DETAILED DESCRIPTION

Fourth Embodiment—FIGS. 4A-G

FIGS. 4A to 4G show a fourth embodiment. The connecting member 22A is the same as the third embodiment. The input/output members are different from the third embodiment. A single sliding thrust flange 53A is on each input/output.

FIG. 4C shows that one of the input/output members has a first end shaft 17 and the other a second end shaft 16A that are approximately ⅜" OD and 7" long and made of steel or some other substantially rigid material. FIG. 4D shows that both the shafts have an inner disposed end with a full radius 100 and a pair of parallel flats 98A ¼" apart and extending 1" in from the end, leaving a pair of shoulders 102A on the shaft. A snap ring groove 101A is machined 1/16" from the inboard edge of the shoulders 102A. The groove 101A is of known dimensions to accept a spiral snap ring 52A of ½" OD or other type snap ring. A pin hole 92B that is slightly larger diameter than the pin 51A is centered in the full radius 100 and perpendicular to the flats 98A.

FIG. 4G shows that the first end shaft 17 has an outward disposed hexagon shaped end 95 for attachment of a hex bit adapter 56A. It also has a pair parallel of flats 98A ¼" apart and extending ¾" in from the end, leaving a pair of shoulders 102A on the shaft. A snap ring groove 101A is machined 1/16" from the inboard edge of the shoulders 102A. The groove 101A is of known dimensions to accept the spiral snap ring 52A or other type snap ring.

FIG. 4E shows that the second end shaft 16A has a ¼" square drive 32A of known dimensions. It has a sprung ball 103 of known design for retaining an adapter. It also has a pair of parallel flats 98A ¼" apart and extending ¾" in from the end, leaving a pair of shoulders 102A on the shaft. A snap ring groove 101A is machined 1/16" from the inboard edge of the shoulders 102A. The groove 101A is of known dimensions to accept the spiral snap ring 52A or other type snap ring.

FIG. 4F shows an enlarged view of a shoulder washer 54A ½" OD, slightly larger than ⅜" ID and 1/16" thick, made of steel or some other substantially rigid material. The shoulder washer has two parallel flats on the ID, slightly more than ¼" apart. The washer's flats engage the shafts flats to keep the shoulder washer 54A from rotating with respect to the snap ring 52A, which could otherwise act to dislodge the ring 52A or wear it down. FIG. 4C shows that each end shaft has two of the shoulder washers 54A Each of the shoulder washers 54A are retained with the spiral snap ring 52A in the adjacent grooves 101A.

FIG. 4C shows that the hex bit adapter 56A has a hex bit socket 34 for accepting hex bits. Its OD is about ½" and it is about 1" long. The hex bit socket 34 hexagon hole extends all the way through the adapter 56A and is used to connect it to the shaft 17 via an interference press fit, brazing, soldering or by other means. The hex bit adapter 56A may incorporate known means to retain the hex bit, in this case a magnet 57 (a known means) but other known means such as a ball detent or collet could be used. The magnet 57 can be pressed into, glued into or fit into a recess in the hex bit adapter 56A to retain it. The hex bit adapter 56A is made of steel but other substantially rigid materials would work.

Alternatively, the hex bit adapter 56A could be machined as an integral part of the shaft 17, if made from a ½" diameter blank. It could then act as the outboard shoulder, eliminating the shoulder washer 54A and the snap ring 52A at that end.

The sliding thrust flange 53A has slightly larger than ⅜" ID, 1" OD, and is ⅛" thick. It is made of steel or some other substantially rigid material. One is placed on each input/output member before the shoulder washers 54A and the snap rings 52A are installed.

The sliding thrust flange 53A can slide on the end shaft until it hits one of the shoulder washers 54A which is fixed to the shaft with flats and the snap ring 52A. During operation the sliding thrust flange 53A is intended to stay fixed against the hand but rotates with respect to the end member and shoulder washer 54A.

This embodiment is shown with the hex bit adapter 56A on one end and the ¼" square drive 32A on the other end but could have any type of drive on either end.

It should be noted that the end member shaft design with snap ring grooves 101A allows them to be machined from economical simple small round bar stock but the grooves do create a stress riser when under bending loading. This should be taken into consideration when designing a tool. Use of a larger diameter bar or other construction methods may yield greater strength and or longer life span. Also, on each shaft, the inner disposed snap ring groove (nearest the pivot) is a region of higher bending stress than the outer disposed groove. Therefore, if on a shaft one groove can be eliminated but one must be left for assembly purposes, it is better to eliminate the inner disposed snap ring groove.

OPERATION

Fourth Embodiment—FIGS. 4H-4J

FIGS. 4H and 4I show using the tool in cranking mode. FIG. 4H shows using the end with the hex bit adapter 56A as the output member in cranking configuration. Its thrust flange 53A is slid towards the outboard end against the shoulder washer 54A. The left hand L grasps the output member 17 tightly enough to steady it and keep it in alignment with the object being rotated but loose enough to allow rotation. The left hand L will also press against the sliding thrust flange 53A to impart primary axial force, urging engagement with the object being rotated. The end with square drive 32A will serve as the input member. It's thrust flange 53A is slid towards the pivoted joint and against the shoulder washer 54A. The right hand R grasps the input member 16A tightly enough to impart force but loose enough to allow rotation. The right hand should be against the thrust flange 53A to impart additional axial force urging engagement with the object being rotated.

FIG. 4I shows using the ¼" square drive 32A end as the output member in cranking mode. Slide its thrust flange 53A towards its outboard end and against the shoulder washer 54A. The left hand L grasps the output member 16A tight enough to steady it but loose enough to allow rotation. The left hand L will press against the sliding thrust flange 53A to impart axial force. The hex bit adapter 56A end shaft 17 will serve as the input member. Slide its thrust flange 53A towards the pivoted joint and against its inboard shoulder washer 54A. The right hand R grasps the input member 17 tightly enough to impart force but loose enough to allow rotation. The thumb side of the right hand R can push against the sliding thrust flange 53A to impart additional axial force urging engagement with the object to be rotated.

FIG. 4J shows the tool folded compactly for storage. To fold the tool for storage, slide both thrust flanges 53A to their outboard positions on both input/output members. This allows the tool to fold compactly into a volume about 1"×2⅛"×7⅝".

The thrust flange's 53A ability to slide allows it to be put outboard for compact folding or put inboard on the input member during cranking, where it can be pushed against to provide additional engagement force. During high speed mode the thrust flange 53A can be slid outboard on the input member in order to pull lightly against it, which is helpful in maintaining the shape for high speed operation.

DETAILED DESCRIPTION

Fifth Embodiment—FIGS. 5A-5F

FIGS. 5A to 5F show a fifth embodiment. FIG. 5B shows that both input/outputs have the same end shaft 16A with the ¼" square drive 32A ends. The same one as one used on the fourth embodiment. This embodiment incorporates a larger shoulder washer 54B, a larger sliding thrust flange 53B and a rotating handle 41A.

FIG. 5C shows an enlarged view of the shoulder washer 54B. It is 1/16" thick, ¾" outside diameter, and slightly larger than ⅜" inside diameter with two parallel flats on the ID slightly more than ¼" apart. The flats on the ID keep the shoulder washer 54B from rotating with respect to the snap ring 52A which could otherwise act to dislodge it or wear it down. Its outside diameter is larger than the thrust flange's 53B inside diameter in order to retain the sliding thrust flange 53B on the handle 41A. It is made of steel or some other substantially rigid material.

The sliding thrust flange 53B is about ⅛" thick and has outside diameter about 1⅛" diameter. It has an inside diameter slightly larger than the ½" outside of the handle 41A so that it can slide on the handle 41A. It is made of steel or some other substantially rigid material.

The rotating handle 41A is added to each input/output end shaft 16A. It is a simple smooth cylindrical tube slightly larger than ⅜" inside diameter by ½" outside diameter and about 5⅛" long. It is free to rotate on the end shaft 16A and so it is of length slightly less than the spacing between the shoulder washers 54B.

The handle's 41A material should preferably be a substantially rigid material, such as steel or aluminum but it could be a softer material such as plastic, rubber or a length of hydraulic hose. The handle 41A may be of a material that reduces friction with the main member, such as aluminum, copper, brass, bronze, plastic, sintered metal etc. To further reduce friction a surface treatment or lubricant can be applied between the handle 41A and the end shaft 16A, such as polishing, burnishing, plating, hardening, heat treating, nitriding, oil, grease, silicone etc.

The rotating handle 41A could have a textured, knurled or patterned surface to assist in transmitting the grips axial forces and for increased comfort. It can include an elastic outer layer for improved transmission of grip axial force and improved comfort. In any case, its outside diameter must remain small enough to allow the thrust flange 53B to slide along its full length.

One shoulder washer 54B is slid onto the pivot end of the input/output shaft 16A and then secured with the snap ring 52A in the adjacent groove. The input/output end shaft 16A member is inserted through the handle 41A. The sliding thrust flange 53A is slid onto the handle 41A. A second shoulder washer 54B is slid onto the outer end and secured with another snap ring 52A.

OPERATION

Fifth Embodiment

The operation of the fifth embodiment is similar to that of the fourth embodiment. FIG. 5A shows the positions of the sliding thrust flanges 53B when using the end shown at upper left to impart rotary motion. To use one end as the output member, slide its thrust flange 53B to the outboard end. Grasp its rotating handle 41A with the left hand L with thumb pointing towards the pivot and side of hand against the sliding thrust flange 53B. On the other end to be used as the input, slide its thrust flange 53B inboard towards the pivot. Grasp its rotating handle 41A with the right hand R, thumb pointing towards the pivot and thumb side of hand up against the thrust flange 53B. Use the left hand to steady the output member and keep it in axial alignment with and engaged with the object to be rotated. Use the right hand to position the input member in the desired configuration for speed, cranking, max torque or anything in-between and create the rotary motion and torque. In the cranking configuration, the right hand can push against the thrust flange 53B to apply additional axial force to urge engagement with the object to be rotated.

To use the other end of the tool to impart rotary motion, use the same procedure as described above but just swap the tool end for end and slide the thrust flanges 53B to the opposite ends of the handles 41A. If ambidextrous, then just slide the flanges 53B to the opposite end of each handle 41A and grip each handle as before but with hands against the thrust flanges 53B in their new locations.

This embodiment allows the handles 41A to be grasped tightly in order to create torque and or axial force, but still allows substantially free rotation of the handles 41A on the end shafts 16A. The sliding thrust flange 53B allows some of the axial force to be transferred through it, thus allowing the required grips on the handles 41A to be relaxed a little and cause less user fatigue. If the operator does grip the handles 41A tightly, they will still easily rotate on the end shafts 16A. The larger diameter handle 41A also distributes the forces imparted on the end members more comfortably to the hand. This causes less wear and tear on the hands and fingers. It allows more cranking and or axial force being applied by the hands to be transmitted to the output member drive tip and to the object to be rotated. Less effort is lost as friction so more can go to torque, axial force, and rotational speed. Operator work and fatigue are reduced.

FIG. 5E shows that the sliding thrust flange 53B allows the tool to be compactly folded. To fold the tool for storage, slide both thrust flanges 53B to their outboard positions. This allows the tool to fold compactly into a volume about 1"×2⅛"×7¼.

The thrust flange's 53B ability to slide allows it to be put outboard on the output member for applying axial force or put inboard on the input member during cranking, where it can be pushed against to provide additional engagement force or both slid outboard for compact folding. Additionally, during high speed mode the thrust flange 53B can be slid outboard on the input member in order to pull against it lightly, which is helpful in maintaining the shape for high speed operation. The rotating handle 41A reduces frictional losses and increases operator comfort.

DETAILED DESCRIPTION

Sixth Embodiment—FIGS. 6A-D

FIGS. 6A-D shows a sixth embodiment that has shafts and connectors the same as the fourth embodiment but the sliding thrust flanges have been omitted and handles 41A have been added. The shoulder washers 54A, same as the fourth embodiment, have an outside diameter equal to the outside diameter of the handle 41A.

FIG. 6A shows this embodiment with the square drive 32A end and the hex bit adapter end 56A. FIG. 6B shows an exploded view of the assembly. The input/output end shafts 16A and 17 are the same as in the fourth embodiment.

The handle 41A may be textured, knurled or have an elastomeric coating to increase the axial force that can be transmitted for a given grip, that is, increase the friction between the handle and hand. Since it need not accommodate a sliding thrust flange, the handle 41A may be shaped to provide a comfortable and efficient grip.

OPERATION

Sixth Embodiment

The operation of the sixth embodiment is similar to that of the fifth embodiment except that each hand is not placed against a thrust flange. Each handle 41A can be gripped anywhere along its length and tightly enough to impart the desired axial force via the friction between hand and handle 41A. FIG. 6C shows the tool in cranking configuration and with the square drive 32A end imparting the rotary motion.

FIG. 6D shows that it can be very compactly folded for storage into a volume approximately ½"×1⅜"×7".

This embodiment is simple and comfortable to use and reduces frictional losses. It folds very compactly. All the axial force must be transmitted by the friction of the users grip on the handles 41A.

DETAILED DESCRIPTION

Seventh Embodiment—FIGS. 7A-M

FIGS. 7A-7E show a seventh embodiment. This embodiment is similar to the sixth embodiment but is larger, and has identical input/outputs, adds a flange bushing 55 pressed into each end of a rotating handle 41B, and each pivot has a removable ball detent pin 51D of known design The flange bushing 55 dimensions are inside diameter of slightly larger than ½", outside sleeve diameter of slightly larger than ⅝" and about ⅜" long. Its flange is 1/16" thick and ¾" outside diameter. The flange bushing 55 is best made of a material with good lubricity such as sintered bronze or engineered plastic, but other materials can be used.

FIG. 7N shows a shoulder washer 54C is ¾" outside diameter to match the OD of the flange on the bushing 55. The bushing flange rotates on it and pushes against it to transfer the axial force. The shoulder washer 54C has an ID of slightly larger than ½" but with two flats slightly more than ⅜" apart. It is made of steel but any other substantially rigid and strong materials such as aluminum or titanium would work.

The handle 41B has a ⅝" inside diameter and ¾" outside diameter. The end face of the handle provides support for the bushing's flange. The flange bushings 55 are press fit into both handle ends so that it will rotate with the handle 41B on the end member 16B. The length of the handle 41B with two bushings 55 installed is slightly less than the distance between the two shoulder washers 54C, to allow free rotation and not bind. The handle 41B is made of steel but any other substantially rigid and strong materials such as aluminum or titanium would work.

FIG. 7B shows an end shaft 16B which is ½" OD and about 7" long. This same shaft is used on both ends of the tool. FIGS. 7D and 7E show enlarged details of the end shaft's ends. Similar to the fourth embodiment, the ends all have a snap ring groove 101B, snap ring 52B and shoulder washer 54C to create a shoulder for retaining the handle. In this embodiment the input and output members have a pair of parallel flats 98B ⅜" apart machined ¾" in from the outboard end and 1½" in from the inboard end, leaving a pair of shoulders 102A on the shaft. The snap ring groove 101B is machined 1/16" outboard of shoulders 102A. The input/output shaft outboard end has a ⅜" square drive 32B of known design and dimensions, including a sprung ball 103 for retaining adapters or sockets. The shafts are made of steel but any other substantially rigid and strong materials such as aluminum or titanium would work.

FIG. 7B shows a connecting member 22B that is of similar design to the connecting member 22A but is of larger proportions. It is made of ½"×¾" bar approximately 8" long. The middle section between the two clevises is machined down to ½"×½" for weight reduction. The clevis opening will accept a ⅜" thick member and the pin holes are for a ball detent pin 51D of ¼" diameter. The clevis ends are angled at about 45 degrees to the center section. It is made of steel but any other substantially rigid and strong materials such as aluminum or titanium would work.

FIGS. 7F-7I shows a variation where a plain bushing 62 and a thrust bearing washer 61 are used in place of the flange bushing 55. FIG. 7G shows an exploded view of the input/output member sub assembly. FIG. 7I is a section view of the input/output member sub assembly that shows how the parts fit together. The plain bushing 62 dimensions are inside diameter of slightly larger than ½", outside diameter of slightly larger than ⅝" and about ⅜" long. The bushings 62 are press fit into each end of the handle 41B until they are flush with the end. The thrust bearing washer 61 is 1/16" thick, slightly larger than ½" inside diameter, and ¾" outside diameter. The plain bushing 62 and the thrust bearing washer 61 are best made of a material with good lubricity such as sintered bronze or engineered plastic, but other materials can be used.

FIGS. 7J-7M show using a ball bearing 60 rather than the flange bushing 55. The ball bearing 60 has an inside diameter of ½", outside diameter of ¾", and a length of about ⅛". A rotating handle 410 is ⅝" inside diameter and ⅞" outside diameter. Each end has a counterbore 104 that is ¾" diameter and ⅛" deep, to receive the ball bearing 60. The ball bearing's outer race fits in the handle's counterbore 104 and its inner race fits on the end shaft 16B and against the shoulder washer 54C. The ball bearing 60 has even lower frictional resistance than a bushing. The bearing 60 needs to have a sufficient radial and thrust load rating to withstand the forces imparted during use. A larger ball bearing may last longer but will require a larger handle and counterbore. It would also be good to use a ball bearing with integral seals to keep out dirt and moisture.

OPERATION

Seventh Embodiment

The operation is the same as the sixth embodiment. This embodiment further reduces the energy lost to friction and allows the tool to be used with greater ease. The bushings or bearings also act as the wearing parts that can be replaced.

The removable ball detent pin 51D allows fast and easy changing of the input/outputs or the connecting member 22B. The connecting member 22B could be changed to a shorter one to emphasize speed or a longer one to emphasize torque. Either input/output could be changed to one of a different drive size or type drive.

At present I believe that this seventh embodiment, with rotating handles 41B, flange bushings 55, and removable pins 51D gives the best combination of functionality and manufacturability for general use, but other embodiments are also satisfactory and their merit is best measured with respect to the end user's application and requirements and secondarily with respect to manufacturing and materials preferences.

DETAILED DESCRIPTION

Eighth Embodiment—FIGS. 8A to 8G

FIGS. 8A to 8G show an eighth embodiment. In this embodiment each of the input/outputs are pivotably connected by a single shear pivot 94 to the connecting member, rather than the double shear clevis type pivot of previous embodiments. The input and output members pivot or swing in closely adjacent parallel planes. This embodiment folds very compactly into a flat rectangular volume.

FIG. 8B shows an exploded view. Both input/outputs use an end shaft 18 of round bar about 5/16" diameter. FIG. 8D shows that both ends are a ¼" hexagon shaped end 95 that press fits into two different end fittings. The hexagon engagement needs to be long enough to provide bending strength to the joint and is about ½" long. The hexagon shape provides for good torsional strength of the joint, but other shapes could be used or the end fittings could be affixed by other means such as solder or welding. The end shaft 18 is made of steel but other substantially rigid materials would work.

One end fitting is the hex bit adapter 56A with a hex bit socket 34 for accepting hex bits. Its OD is about ½" so its end will provide a good bearing surface for the output handle 41C when axial force is applied. The hex bit socket 34 hexagon hole extends all the way through the adapter 56A and on the inner disposed end is used for an interference press fit to the shaft. The hexagon boss on the shaft 95 is made slightly larger than the hex bit socket 34, to effect the press fit, which needs to be sufficient to retain the members together. An alternate way to effect the press fit is for the hex bit socket hole to have slightly filleted corners in the area of the press fit, but not in the area where the hex bits are to be received. Chamfering the end of the hexagon boss 95 and or the edge of the hex bit socket 34 hole will facilitate their assembly. The hex bit adapter 56A is made of steel but other substantially rigid materials would work. The hex bit adapter 56A has the magnet 57 to retain the hex bit (a known means) but other known means such as a ball detent or collet could be used.

FIG. 8C shows an enlarged view of the other end fitting, a pivot end fitting 59A which forms half of the single shear pivot or hinge. The pivot end fitting 59A is about 1" long and has a ½" square cross section to match up to the outside diameter of a handle 41C. It has a full radius outer end and a screw hole 92C slightly larger than a #10 screw, centered in the radius. The pivot end fitting 59A also has a hexagon hole 99 used to effect a press fit to the end shaft 18. The hole 99 is about ½" deep into the pivot end fitting 59A and can be the same dimensions as the hex bit socket 34. The pivot end fitting 59A is made of steel but other substantially rigid materials would work.

The handle 41C has a slightly larger than 5/16" inside diameter and ½" outside diameter. The rotating handle 41C is put on the input/output end shafts 18 before the end fittings are pressed on. It is slightly shorter than the resulting distance between the affixed pivot end fitting 59A and affixed the hex bit adapter 56A, so that it can rotate freely on the end shaft 18. The outboard end fitting's inboard end needs to be of sufficient size for the end of the handle 41C to bear against it when in operation and axial force is being applied. The handle 41C is made of steel but other substantially rigid materials, such as aluminum or brass, would work.

Alternatively, the end shaft 18 and either end fitting 59A or the hex bit adapter 56A could be machined or formed from a single part. For example if incorporating the pivot end fitting 59A then turned down from ½" square bar or if incorporating the hex bit end 56A then turned down from ½" diameter bar. But one member should be a separate part in order to allow assembling the rotating handle 41C on the end shaft 18.

Alternatively the input/output shaft could be a hexagon bar, merely cut to length with no additional machining. The shaft would not have a shoulder to stop and position the hex bit adapter 56A so care would need to be taken not to press it on too far and bind the handle 41C, so as not to hindering or prevent its rotation.

FIG. 8B shows a connecting member 23A machined from a ½" square cross section bar which has a full radius on both ends. Each end has a threaded hole 92D with #10-24 thread, centered in each end radius, parallel to each other and perpendicular to one of the flat sides. Both the input/outputs have their pivot end fittings 59A attached to the connecting member with a round head #10×1" long screw 58. The screws 58 area held in place by a thread locking compound applied to the connecting member,s threads (don't get locking compound elsewhere in the joint). Alternatively, the threads of the connecting member's threaded holes 92D could be upset or deformed, so as to lock the screws 58 in place. The screw 58 is tightened so that the head of the screw presses the end fitting 59A against the connecting member 23A and reduces the slop in the joint. The screw tightness is adjusted to minimize the slop in the joint but still allow it to freely pivot. Alternatively, the screws could be a shoulder type (not shown) where the end fitting's screw hole 92C fits closely to the screw shank to reduce slop in the joint. The connecting member 23A is made of steel but other substantially rigid materials would work.

Alternatively, a flat head rivet (not shown) could be used to connect the members if the rivet's flat heat seats flush in countersunk holes in the connecting member and the rivet unheaded end goes through the pivot end fitting 59A and is then headed over in such a manner so as to not clamp and bind the joint. Adding a close fitting washer to the rivet end before heading it may assist in keeping the joint from binding. The connecting member's holes would have their countersinks on opposite sides so that the rivet's shank would protrude though the pivot end fittings, located on opposite sides of the connecting member.

A thrust bearing washer (not shown) could be placed on the screw 58 between the connecting member 23A and the pivot end fitting 59A to assist in reducing friction of the pivot joint and act as a wearing part that could be replaced. A material with good lubricity such as sintered bronze would work well.

Additionally, to reduce the friction of the rotating handle 41C, thrust washers (not shown) could be placed at either end of the handle 41C or flange bushings (not shown) could be placed in either end of the handle 41C.

This embodiment is shown with the hex bit adapters 56A on both ends but any other drive types or adapters could be incorporated.

OPERATION

Eighth Embodiment

This embodiment is used similar to the sixth embodiment FIG. 6D except that there are no pivot rotation stops, so all the axial engagement force must be created by the hand on the output member.

The input/outputs and connecting member can pivot a full 360 degrees with respect to each other. This also allows the members to fold side by side into a very compact shape. In use, the input, connecting, and output members swing in separate but parallel adjacent planes.

FIGS. 8E-8G show that for storage the members all fold into a single plane and will fit in a rectangular volume ½"× 1¾"×6". The compact shape is rather flat and smooth which makes it well suited to fit in a toolbox, pocket or holster.

This embodiment can be made in any size but is well suited to a small compact tool for applying limited torque and force to small fasteners.

DETAILED DESCRIPTION

Ninth Embodiment—FIGS. 9A-9F

FIGS. 9A to 9F show a ninth embodiment that is similar to the eighth embodiment but to each pivot end fitting a pivot rotation stop 96C has been incorporated. The pivot rotation stop 96C is a block of material about 3⁄16"×½"×13⁄16" on the side of both a pivot end fitting 59B and a pivot end fitting 59C. The two end fittings are not identical but are mirror images, having their pivot rotation stop blocks 96C on opposite sides. As an alternative to adding the stops to the pivot end fittings 59B and 59C the stops could as well have been added to both ends of the connecting member 23A (shown without stops). The stop could also take some other shape than the block shown in this embodiment.

OPERATION

Ninth Embodiment

This embodiment is used similar to the sixth embodiment FIG. 6D. From the folded position the input/output members can rotate approximately ¾ circle (about 270 degrees) and then the pivot rotation stops 96C contact the connecting member 23A. In cranking configuration the stops allow the right hand R on the input member to apply additional axial force which is transferred through the pivots and stop blocks to the output member to urge engagement with the object being rotated.

For storage the members all fold compactly and will fit in a volume 11⁄16"×1¾"×6". The compact shape is rather flat, smooth, and well suited to fit in a pocket or holster.

DETAILED DESCRIPTION

Tenth Embodiment—FIGS. 10A-C

FIG. 10A shows a tenth embodiment. This embodiment is similar to the eighth embodiment except the input/output members are attached on the same side of the connecting member 23A. The input and output members pivot in substantially the same plane and the connecting member 23A lies in a closely adjacent parallel plane. The input and output members can each swing through an arc of slightly less than a full circle and then stop against each other's pivot end fitting 59A.

FIG. 10B shows that the input and output members can be folded against themselves and together with the connecting member 23A to form a substantially tri-lobular and compact shape. Appropriate shaping of the input, output, handles, and connecting member could, when folded, form a cylindrical, square or other shape that will allow the tool to be used similar to a conventional screwdriver, be a more ergonomic handle in that use or be a more pleasing style.

Rotations stops (not shown) similar to that in the ninth embodiment could be incorporated on the end members or connecting member. In this case the end fittings could be identical (need not be mirror image), with their stop blocks on the same side.

OPERATION

Tenth Embodiment

This embodiment is used similar to the sixth embodiment FIG. 6D. If there are no pivot rotation stops (as shown) then all the axial force must be transmitted by the hand on the output member.

FIGS. 10B-10E shows that the input and output members can be folded against themselves and the connecting member 23A to form a substantially tri-lobular shape. In this configuration this embodiment could then be gripped and used similar to a conventional screwdriver. Either one end or both could be used by placing a hex bit, adapter or other tool in the hex bit adapter 56A. The hex bit adapter 56A socket is slightly offset from the effective centerline of the substantially tri-lobular handle, but this does not pose a problem when using it as a conventional screwdriver.

For storage the input and output members fold against themselves and it forms a substantially tri-lobular shape and will fit in a volume 1"×1¼"×6". The compact shape is well suited to fit in a toolbox, pocket or holster.

DETAILED DESCRIPTION

Eleventh Embodiment—FIGS. 11A-11C

FIGS. 11A and 11B show that this embodiment is similar to the tenth embodiment but the individual parts have been shaped so that when folded it forms a capsule shape, as shown by FIG. 110.

FIG. 11B shows a connecting member 24 has a cross section that is approximately a half circle of ⅝" radius and approximately 7" long, with both ends a half sphere of ⅝" radius. It has a counterbored screw hole 92E on each end that is perpendicular to the flat face and offset from the center of the part. The holes are slightly larger than the pivot screws 58 threaded portion and the counterbore slightly larger than the screw head. The counterbore allows the screw heads to be recessed. The connecting member has four cavities 105 for storage of hex bits (not shown). It is made of aluminum but could be any substantially rigid material including steel, titanium, and plastic.

FIG. 11B shows a rotating handle 42 with a cross section that is substantially a quarter circle of ⅝" radius with a hole through it that is slightly larger than the end shaft 18 diameter. Its outer edges are rounded enough to allow it to be comfortably gripped. The handle 42 length of 4 15/16" is just less than the spacing between the end fittings, a hex bit adapter 56B and a pivot end fitting 59D, to allow it to rotate freely. It is made of aluminum but could be any substantially rigid material including steel, titanium, and plastic. It could also have a rigid center portion with an elastomeric outer portion to make for a more comfortable grip and one that provides improved friction to help keep the left hand from sliding axially on the handle.

The hex bit adapter end fitting 56B and the pivot end fitting 59D both have a cross section approximately a quarter circle of radius ⅝" and are 1¼" long, with the outboard ends a quarter sphere of ⅝" radius. The hex bit adapter 56B has a hexagon hole 34 to accept hex bits and press onto the hexagon end of the end shaft 18. The hexagon hole 34 should be in line with the hole in the handle 42 when the components are in a capsule shape. The hexagon hole 34 may be stepped in size to retain the magnet 57 or the magnet can be glued in. FIG. 11C shows that the pivot end fitting 59D has a #10-24 threaded hole 92F to accept the pivot screw 58. The screw hole is located so as to align with the hole 92E in the connecting member 24 when the parts are arranged in a capsule shape. It has a hexagon hole 99 about ½" deep to accept a press fit of the shaft's 18 hex end. Both end fittings are made of aluminum but could be any substantially rigid material including steel, titanium, and plastic. The material needs to be strong enough to take the bearing loads of the end member shaft's 18 press fit, pivot screw 58, and hex bits (not shown).

A means such as a latch, detent or magnet could be incorporated to help keep the handle in the folded position, shaped like a capsule.

OPERATION

Eleventh Embodiment—FIGS. 11A and 11D-11H

Operation of this embodiment is similar to that of the tenth embodiment. FIG. 11A shows it in cranking configuration. FIGS. 11D to 11H show that when folded into a capsule shape, this embodiment could then be gripped and used similar to a conventional screwdriver. Either one end or both could be used by placing a hex bit, adapter or other tool in the hex bit adapter 56B. The hex bit adapter 56B socket 34 is slightly offset from the effective centerline of the substantially trilobular handle, but this does not pose a problem when using it as a conventional screwdriver.

It's folded capsule shape 1¼" diameter×7" long makes a comfortable handle and is pleasing to the eye.

DETAILED DESCRIPTION

Twelfth Embodiment—FIGS. 12A-12G

FIGS. 12A-12G show views of a twelfth embodiment where the outer disposed ends of the input/outputs have either a first four hexagon socket adapter hub 36A or a second four hexagon socket adapter hub 36B rotatably attached. Each adapter hub has four different size hex sockets. FIG. 12C shows an enlarged perspective view of the four hex socket adapter hub 36B. Alternatively, the adapter hub could have a plurality of sockets, other type drives or adapters. The adapter hubs 36A and 36B are rotateably attached to the clevis with a headed pin 51C. An end such as this is of known design and has been used on a "dogbone" style wrench. The adapter hubs 36A and 36B can be rotated so that any of the four sockets is positioned to be used to rotate an object.

FIG. 12B shows an exploded view of a first input/output member. An end shaft 19 has a clevis 106 on the outboard end to accept the adapter hub 36A. The shaft's body is substantially square but with its corners turned to a radius that makes it slightly smaller than the inside diameter of a rotating handle 41E. The four corner radii end just before the clevis to form a set of four shoulders 102B for an outboard shoulder washer 54D to abut against. A snap ring groove 101C is machined near the pivot end. A spiral snap ring 52C in the groove retains the adjacent inboard shoulder washer 54D. The end shaft 19 is made of steel but other substantially rigid and strong material such as aluminum or titanium will work.

FIG. 12B shows the tubular handle 41E has an inside diameter slightly larger than the diameter described by the shaft's 19 four corner radii. It has a length slightly shorter than the spacing between the two shoulder washers 54D. The handle 41E is made of a material with good lubricity like aluminum or bronze so that it will rotate on the end shaft 19 and against either of the shoulder washers 54D with minimal friction.

FIG. 12G shows the shoulder washer 54D has an outside diameter approximately the same as the handle outside diameter. Its inside is a square that is slightly larger than the square of the end shaft 19 and with inside corner radii slightly smaller than the corner radii of the end shaft 19, such that the shoulder washer 54D can be slipped onto the end shaft 19 but does not turn and does not go past the shaft's shoulders 102B.

The second input/output has the same or similar construction except that it incorporates the second adapter hub 36B.

This embodiment illustrates that the tool can have a plurality of drives or adapters at each end. The adapter hub could have other drives than sockets, such as Phillips, Square Drive, Torx, hex key or other. For example, the adapter hub could have a plurality of square drives to which the desired square drive sockets for a given project could be attached. The adapter hub is not limited to four drives, the number could be more or less. The adapter hub and clevis connection could incorporate a rotation lock mechanism of known construction (not shown) that locks the adapter hub in any of four or more positions, to position and facilitate the use of one of its sockets, drives or adapters.

This type of tool would be useful when all or the majority of the fasteners of a project or device match a type and size of one of the plurality of adapters on the tools adapter hubs. Fastener sizes for a given project or device often all fall within a limited size range. The tool's number and sizes of adapters could be made to match a specific task, such as the disassembly and repair of a specific device. For example a military device might include a dedicated tool designed specifically for its disassembly and repair in the field. The adapters on its adapter hubs would be exactly all the types and sizes needed, for example hexagon sockets, hexagon keys, torx, Phillips etc. An advantage is that no needed tool would be missing. The advantages of this tool not needing any power source, being quiet when operated, and able to be used in wet conditions would be very desirable in a combat situation. A motorcycle, ATV, car or other conveyance used in remote areas could include a dedicated tool of this type for repair or maintenance. The tool could also be made for a type of project, such as automotive wheel removal and the adapters could be hexagon sockets for all common sizes of wheel lug nuts.

The adapter hub is shown being attached to the clevis with the headed pin 51C and is not readily removable. It could be made readily removable by using a removable pin such as a ball detent pin or threaded pin. This would allow the tool to easily utilize any two of a plurality of adapter hubs.

OPERATION

Twelfth Embodiment

FIG. 12A shows the twelfth embodiment in cranking configuration. The adapter hub 36A is rotated so that the socket to be used faces outboard, away from the handle 41E and with its axis in line with the handle 41E. The tool is grasped and used similar to the previous embodiments. FIG. 12E shows a plan view of the maximum torque mode when the socket opening facing away from the handle 41E is being used to rotate an object. FIG. 12F shows an even greater maximum torque mode, if a socket with its axis perpendicular to the handle's 41E axis is used to rotate an object. This configuration provides a longer lever arm than the maximum torque mode of FIG. 12E. FIG. 12F also shows the tool in storage configuration when straight. FIG. 12D shows the tool folded compactly for storage into a volume of about 1½×4×10.

OTHER VARIATIONS

Not Shown

The pivot connections between the connecting member and input/output members could be made easily separable to allow the user to easily change the connecting or end members. One method is to make the pins easily removable. The removable pin could be a bolt and nut or a pin with ball detent as shown in the seventh embodiment. For example the connecting member could be changed to a short one to emphasize speed or a long one to emphasize torque, while keeping the input/output members the same. Or an end member could be changed to one with a different adapter but using the same connecting member and second input/output member. A removable pin would also facilitate repair via replacing a member.

One or more of the input, output or connecting members could have means for variable length. One means is telescoping tubing with an extension limiting stop. The tubing pair would have to transmit torque so square tube would work well for this. If round, then it would have to incorporate a key, spline, spring pin with holes or other means to prevent relative rotation.

If the connecting member length is variable then it can be shortened to emphasize speed or lengthened to emphasize torque.

If the input member length is variable then it can be shortened for high speed or cranking mode but lengthened in maximum torque mode. It could have the handle on the portion that telescopes outward or it could be on the portion that stays inboard. In maximum torque mode when used as a lever, during a final tighten or initial loosen, the portion that telescopes outward is gripped for greatest leverage and need not have a rotating handle.

If the output member length is variable then it can be lengthened to minimize the axial misalignment that occurs from slight movements of the handle off center. This is of importance when drilling. In this case, the handle would need to remain on the inboard section of the telescope. The telescoped out section would need to lock in that position to allow axial force to be applied. Also when the ends are swapped and it is used as the input member then it could be lengthened for more maximum torque.

The advantages of having telescoping members are that the speed, torque, and ability to steady can be more greatly varied. This adds complexity to the tool which may have an adverse effect on ease of use, manufacturability, and cost.

DETAILED DESCRIPTION CONNECTING MEMBER CONSTRUCTION VARIATIONS FIGS. 13A-21

For simplicity of illustration of the first through eleventh embodiments, the connecting member has been shown as being made from a single solid member. The primary purpose of the connecting member is to provide two pivots, with substantially parallel axes, and substantially rigidly spaced apart. A second purpose is to provide a pivot limit stop at each pivot so that axial force can be transmitted from the input member to the output member in cranking mode. Cavities in the connecting member can also be used for storage of hex bits or adapters. The connecting member could incorporate some means to keep the tool in the folded position. The connecting member is also a good place for information such as company name, company logo, tool name, end or adapter sizes, patent number, etc. The connecting member can also be styled by shaping, lettering, embossing, and coloring.

The connecting member must resist bending, torsion, and shear forces. There are many alternative ways to make the connecting member to improve a particular attribute, utilize a particular form of raw material, improve its manufacturability or enhance its appearance. This section shows and gives brief details of some alternative construction methods. This does not mean to limit the construction methods by which the claims can be embodied. It is provided to help illustrate that there are a multitude of construction methods that can be used to implement the embodiments.

Figure 13A:
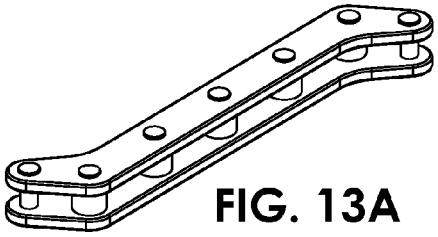
Figure 13B:
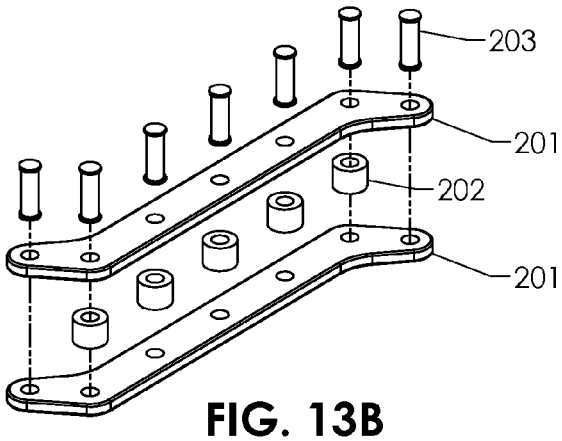

FIGS. 13A and 13B show a connecting member made from two identical pieces of sheet metal or plate that act as beam flanges 201. They are riveted 203 together along with tubular spacers 202 sandwiched between the flanges 201. The rivets 203 are shown with both ends headed in the exploded view, but would have at least one unformed end before assembly. The flanges 201 can be laser cut or stamped complete and tumble deburred. The holes for the rivets 203 won't be smooth if lasered but since the rivets 203 don't turn it's not a problem. The spacers 202 are easily sawn or parted off to any length from tubing. At each end, the outboard spacers 202, act as the rotation stops for the input/output members. The end rivets 203 are used for the pivot pins and would be inserted through the input/output member's pivot holes before forming their second head. Using laser or water jet cutting and varying the flange 201 thickness, shape, size, hole spacing, and material allows this design to make a wide variety of tool sizes and weights without the initial cost of stamping dies or forming tooling.

The flanges 201 and spacers 202 could all be heat treated, plated, and or colored before assembly. The rivets 203 could be of a material that does not corrode, such as stainless steel or aluminum. If the rivets 203 are plated or colored before assembly then the end forming process would compromise or mar the finish. The parts could all be left unplated and after assembly it could be tumble deburred and then plated as a unit.

The torsional strength of this open "I" beam section may not be as strong as other designs with a more closed section. To facilitate compact folding, the input/output members can nest in the openings of the "I" beam.

Figure 14A:
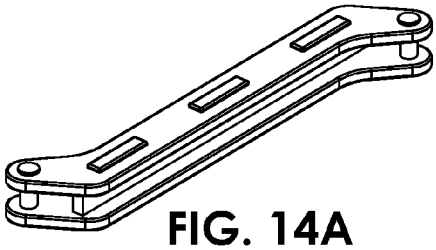
Figure 14B:
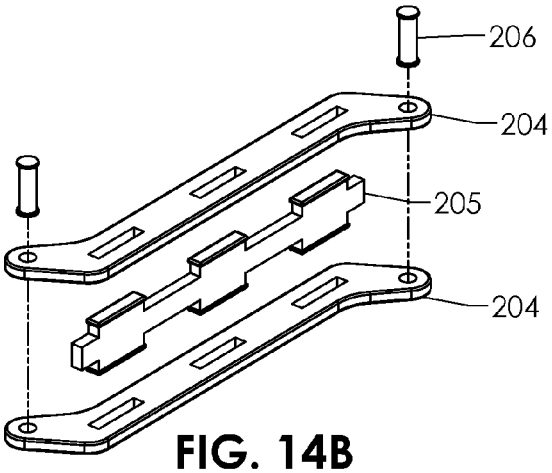

FIGS. 14A and 14B show a connecting member made from two identical flanges 204 that have slots for accepting a web 205 and holes for pivot rivets 206. The web 205 has tabs for engaging the flanges 204. The flange 204 and web 206 can be laser cut, water jet or stamped from sheet metal, plate or other substantially rigid and malleable material. After assembly the web's tabs are either formed or welded to secure the web 205 to flange 204 joints. In the exploded view the web's tab ends are shown as if already formed or welded. The ends of the web 205 act as the rotation stops for the input/output members. Using laser or water jet cutting and varying the flange 204 and web 205 thickness, size, hole spacing, and material lends itself to making a wide variety of connector sizes and weights without the initial cost of stamping dies or forming tooling.

Figure 15A:
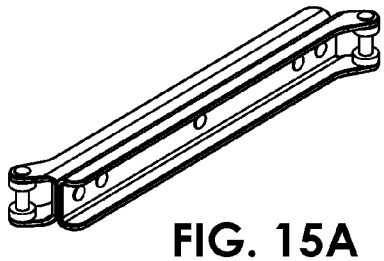
Figure 15B:
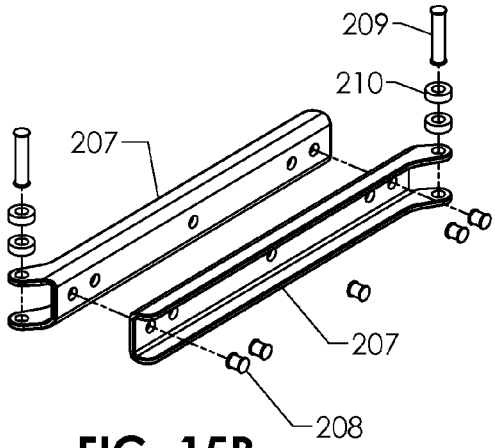

FIGS. 15A and 15B show a connecting member made of two identical "U" shapes 207 formed from laser cut or stamped sheet and riveted 208 together to form an "I" beam shape. The end of the "U" shape 207 can act as a pivot rotation stop for the input/output members. The input/output members can nest inside the "U" shapes 207 for more compact folding. The end member pivot pin rivets 209 are show and with spacer rings 210 to accommodate end member shafts of less width than the "U" opening. U's of two different inside widths could also be joined to accommodate different sized input/output members.

Figure 16A:
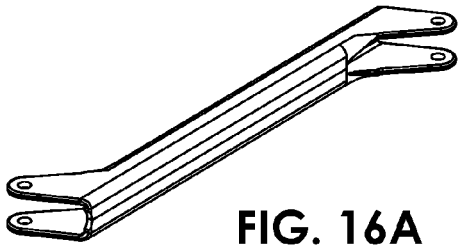
Figure 16B:
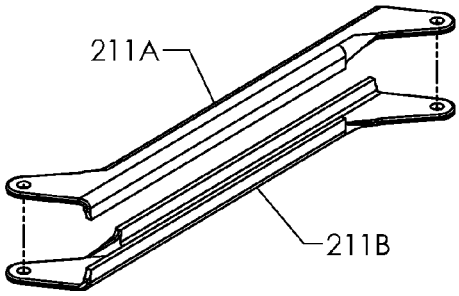

FIGS. 16A and 16B show a connecting member made from pieces of laser cut or stamped sheet metal that are identical when flat but are formed oppositely into mirror image "U" shaped halves 211A and 211B. The two halves are then welded together. The ends of the bent and welded "U"s can act as rotation stops for the input/output members. The tubular section has a good strength to weight ratio and is good at resisting both bending and torsional loads. The hollow of the member could be used to store hex bits, sockets or other adapters, for use on the input/output members. The pivot pins are not shown.

Figure 17A:
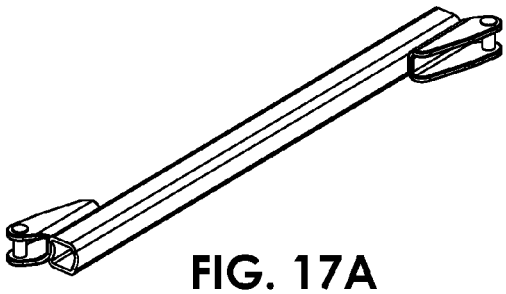
Figure 17B:
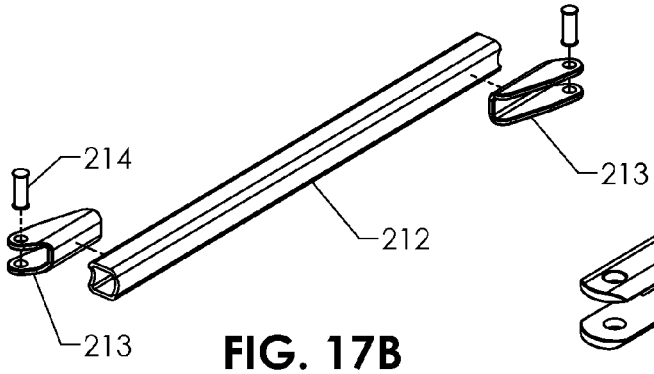

FIGS. 17A and 17B show a connecting member made from square or rectangular tubing 212 with "U" shaped ends 213 that weld on or could be riveted on (not shown). The ends of the tube 212 act as the pivot limit stops for the input/output members. The "U" shapes 213 can be laser cut or stamped and formed or could be laser cut complete from a section of rectangular tubing. The hollow of the tubular member could be used to store hex bits, sockets or other adapters for use on the input/outputs.

Alternatively, the center tube could be made from solid bar.

Figure 18A:
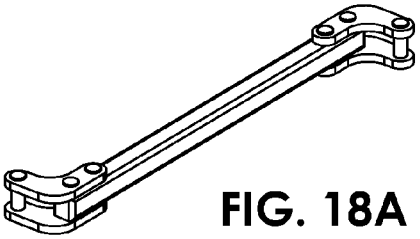
Figure 18B:
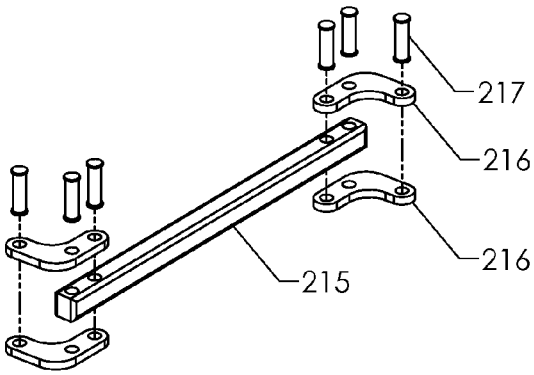

FIGS. 18A and 18B show a connecting member made from a solid square or rectangular bar 215 with holes in the end to which plate or sheet metal brackets 216 are riveted 217 to form the pivot clevises. The ends of the bar 215 act as the pivot limit stops.

Alternatively the brackets 216 could be welded on. Alternatively the solid bar could be a piece of square or rectangular tubing.

Figure 19:
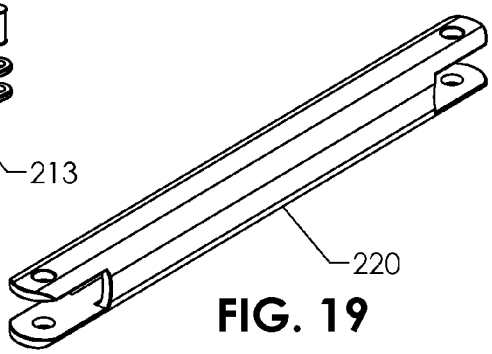

FIG. 19 shows a connecting member made from a single piece of square or rectangular tubing 220. It could be machined or laser cut complete. The root of the clevis cuts can act as the rotation stops. The location of the pivot pin holes on the tube's centerline prevents straight input/output members from folding compactly. The inboard ends of the input/output members could be angled or bent to effect compact folding. The tubular section has a good strength to weight ratio and is good at resisting both bending and torsion loads.

Alternatively, a connecting member of this type could be machined or laser cut from solid bar, but that would be much heavier.

Figure 20:
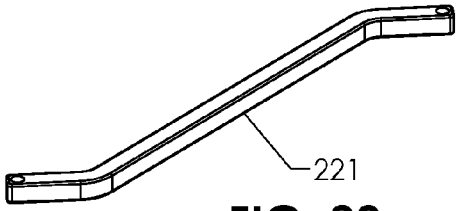

FIG. 20 shows a connecting member made from a single piece of square or rectangular bar 221 with bent ends for compact folding of the tool. Holes in the ends are for connection to input/output member assemblies that have an inboard clevis end and may also have integral pivot limit stops.

Alternatively this could be made from a square or rectangular tube which has a better strength to weight ratio.

Figure 21:
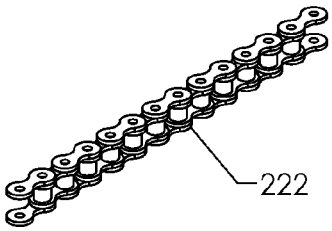
Figure 22A:
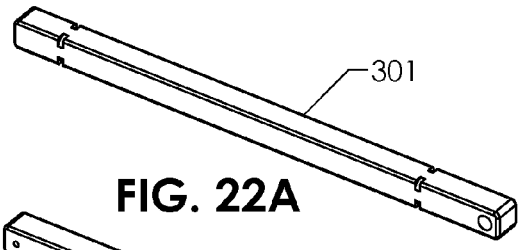

FIG. 21 shows a connecting member made from a section of roller chain 222. This allows the tool to fold compactly but it is harder to hold the desired configuration (shape) for speed and cranking during operation. It cannot incorporate a rotation stop. It holds the two pivot axis substantially parallel. The pivots can be chain length apart or can come closer together.

Alternatively this type of flexible connecting member could be made from two or more pivotably connected links.

DETAILED DESCRIPTION END MEMBER CONSTRUCTION VARIATIONS FIGS. 22A-29

For simplicity of illustration the fourth through eleventh embodiments show the input/output shafts as machined from a round bar, often with snap ring grooves. The main requirements of the input/output are to provide a place to grip, an end to pivot, and a means to engage an object to be rotated or an adapter. It must be strong in resisting torsion and bending loads. There are many alternative ways to make the input/output members to improve a particular attribute, utilize a particular form of material, improve its manufacturability or enhance its appearance. This section shows and gives brief details of some alternative construction methods. This does not mean to limit the construction methods by which the claims can be embodied. It is provided to help illustrate that there are a multitude of construction methods that can be used to embody the claims.

Figure 22B:
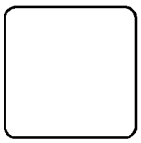

FIG. 22A shows an end member shaft 301 made from a straight square bar. This is useful for when the outboard end is to be of the same shape and size as the bar, such as square drive. FIG. 22B is a cross section and shows the corners of the bar can be rounded or broken slightly for the rotating handle to better bear on and rotate on. Shoulder washers with square centers are used to retain the handle and snap ring grooves are cut in the square bar. The grooves may only cut into the four corners. For a hexagon drive end, a hexagon shaped bar (not shown) and hexagon ID shoulder washer (not shown) could be used.

Figure 23:
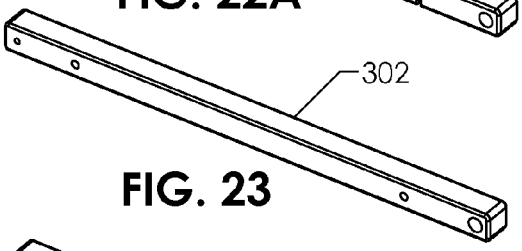

FIG. 23 shows an end member shaft 302 made from a section of straight square bar. It has through holes for pins to retain the shoulder washers. The pins would be self retaining pins such as roll pins or groove pins.

Figure 24A:
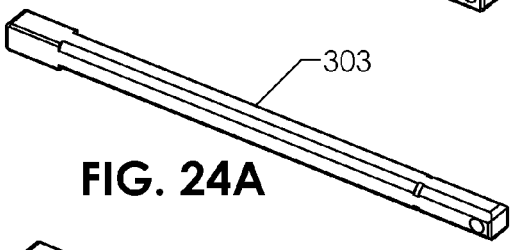
Figure 24B:
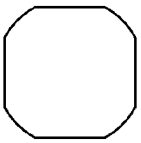

FIG. 24A shows an end member shaft 303 made from a section of straight square bar. FIG. 24B is a cross section and shows the corners machined to a radius of slightly less than the handle inside radius. This will allow the handle to rotate with less friction and wear. The corner radii stop short of the left end to form a four part shoulder for a shoulder washer to bear against. The shoulder washer would have a square hole with radiused corners. The right end has a snap ring groove to retain a second shoulder washer which in turn retains the rotating handle.

Figure 25:
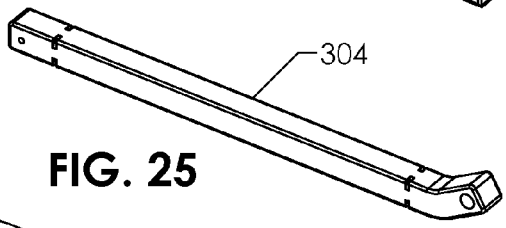

FIG. 25 shows an end member shaft 304 made from a section of square bar with the pivot end angled or bent. The angled end allows for more compact folding of the tool.

Figure 26:
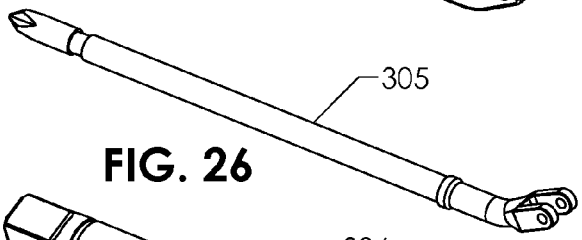

FIG. 26 shows an end member shaft 305 made from a round bar with formed clevis, a shoulder near the clevis end, and snap ring groove near the driving end. The snap ring groove creates a stress riser but it is toward the outboard end where the bending stress is less. The clevis end is bent to allow for more compact folding of the tool. The left end is machined into a Phillips tip.

Figure 27:
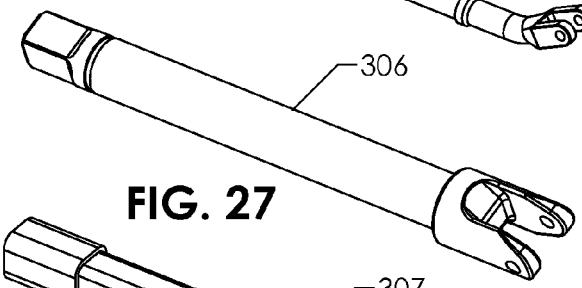

FIG. 27 shows an end member shaft 306 machined from a round bar with diameter large enough to make the clevis. The body is turned down to accommodate the handle. The clevis body end acts as a shoulder to retain the handle. On the other end is a groove for a snap ring that will retain the handle. The outboard end is machined into a square drive.

Figure 28:
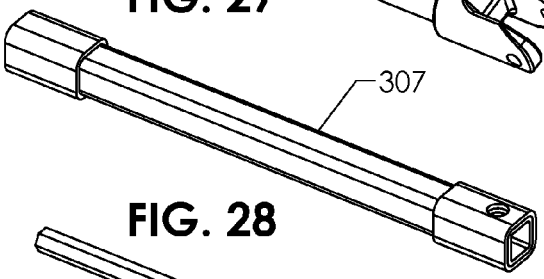

FIG. 28 shows an end member shaft 307 made from square tube. Both ends have a closely fitting larger outer tube section on each end. The outer tube on right end is removable for assembly of the handle and shoulder washers. It is retained by the pivot pin. The left end can be soldered on so it is fixed to the shaft and reinforces the opening. It can use adapters with two oppositely disposed ends and a stepped center boss that fits in the end tube, similar to known adapters with Phillips tip on one end and straight blade on the other end. Alternatively, the hollow end member could store hex bits. An end cap would retain the hex bits in the hollow and also have a hex bit socket in it for affixing and using one. Another alternative is to have the outer end be closed and use a removable ball detent pin. The pin would be pulled to access the stored hex bits.

This nonround cross section end member would require use of a handle with a circular hole. A handle with noncircular hole could be used if it had bushings with a circular hole.

This is to illustrate that the end member or end member shaft can be a hollow member. A hollow member has a better strength to weight ratio and its hollow can be used for accepting or storing adapters.

Figure 29:
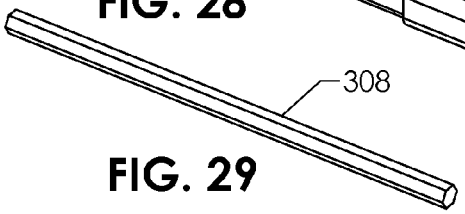

FIG. 29 shows an end member shaft 307 made from a hexagon bar cut to length. It needs no further processing. It will use a press on pivot end fitting and press on end drive tip, drive or adapter.

DETAILED DESCRIPTION HANDLE CONSTRUCTION VARIATIONS FIGS. 30-46B

For simplicity of illustration the fifth through tenth embodiments show the rotating handles as being a round hollow cylinder. The main requirements of the handle are to provide a place to grip and operate the tool, transmit axial force, reduce frictional losses, and increase comfort. There are many alternative ways to make the handles to improve the grip, utilize various materials or improve its manufacturability. This section shows and gives brief details of some other handle construction methods and shapes. This does not mean to limit the construction methods, shapes or materials by which the claims can be embodied. It is provided to help illustrate the multitude of construction methods, shapes, and materials that could be used to implement the embodiments.

Figure 30:
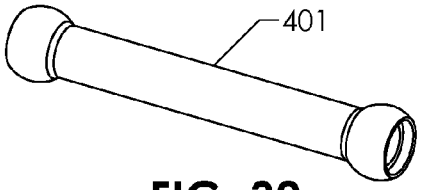

FIG. 30 shows a rotating handle 401 made with spherical ends and a circular hole. When the hand presses against the spherical ends it allow axial force to be conveyed with less gripping effort. The spherical ends also provide more room for incorporating a bushing or ball bearing.

Figure 31:
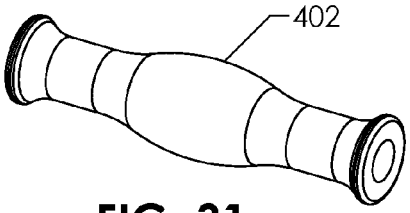

FIG. 31 shows a rotating handle 402 made with a bulged center, flanged ends and a circular hole. The bulge may provide a more comfortable and ergonomic grip. When the hand presses against the sides of the bulge or flanges it allows axial force to be conveyed with less gripping effort. A large bulge hinders compact folding. The handle shape is symmetrical about its transverse midplane.

The handle need not be symmetrical about its transverse midplane, since no matter which end is being used for input or output, the thumb always points inboard toward the pivot end. It could be irregularly shaped to fit the contours of the users grip. Envision the shape of a gripped lump of clay. Having a handle shape that is symmetrical about its transverse midplane would eliminate the possibility an assembly error where the handle gets put on backwards.

Figure 32:
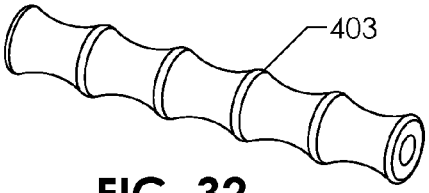

FIG. 32 shows a rotating handle 403 made with grooves or valleys and a circular hole. When the fingers and thumbs lie in and press against the sides of the valleys it allows axial force to be conveyed with less gripping effort.

Figure 33:
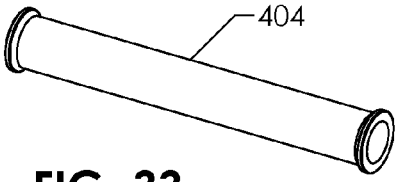

FIG. 33 shows a rotating handle 404 made with small diameter flanged ends and a circular hole. The flange will support a flange bushing's flange or thrust washer. When the hand presses against the flange it will allow axial force to be conveyed with less gripping effort and more comfort.

Figure 34:
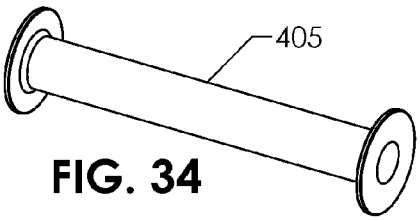

FIG. 34 shows a rotating handle 405 made with large diameter flanged ends and a circular hole. The large flange will support a flange bushing or thrust washer. When the hand presses against the large flange it allows axial force to be conveyed with even less gripping effort and even more comfort. The large flanges hinder compact folding.

Figure 35A:
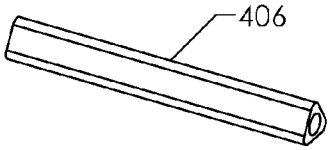
Figure 35B:
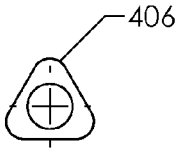

FIG. 35A shows a rotating handle 406 of triangular cross section with rounded edges and a circular hole. FIG. 35B shows a cross section. This may provide a comfortable grip. A constant cross section like this can be extruded of aluminum or plastic and then cut to length, making it easy to manufacture.

Figure 36A:
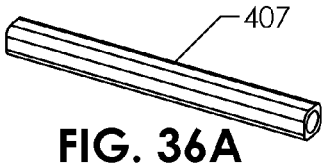
Figure 36B:
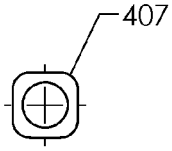

FIG. 36A shows a rotating handle 407 of square cross section with rounded edges and a circular hole. FIG. 36B shows a cross section. This may provide a comfortable grip. A constant cross section like this can be extruded of aluminum or plastic and then cut to length, making it easy to manufacture.

Figure 37A:
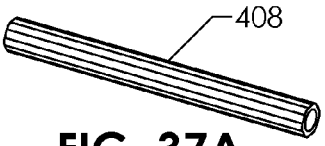
Figure 37B:
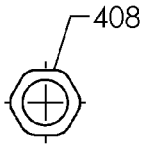

FIG. 37A shows a rotating handle 408 of hexagon cross section and a circular hole. FIG. 37B shows a cross section. This may provide a comfortable grip. A constant cross section like this can be extruded of aluminum or plastic and then cut to length, making it easy to manufacture.

Figure 38A:
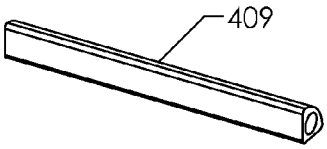
Figure 38B:
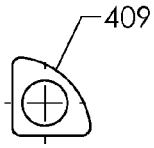

FIG. 38A shows a rotating handle 409 of quarter circle cross section and a circular hole. FIG. 38B shows a cross section. This may provide a comfortable grip. It is can be used with a half circle connecting member with single shear pivot design to make a tool with substantially round shape when folded. When folded, it can be used similar to a conventional screw driver. A constant cross section like this can be extruded of aluminum or plastic and then cut to length, making it easy to manufacture.

Figure 39A:
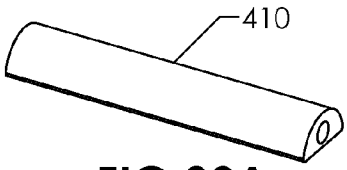
Figure 39B:
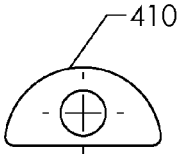

FIG. 39A shows a rotating handle 410 of half circle cross section and a circular hole. FIG. 39B shows a cross section. This may provide a comfortable grip, the broad flat side perhaps being most comfortable to push against with the palm. Two of these can be placed on opposite sides of a flat wide connecting member, with singe shear pivots, to make a tool with nearly round shape, which when folded, can be used similar to a conventional screw driver. A constant cross section like this can be extruded of aluminum or plastic and then cut to length, making it easy to manufacture.

Figure 40A:
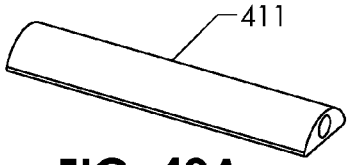
Figure 40B:
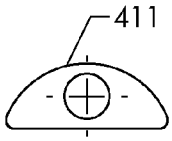

FIG. 40A shows a rotating handle 411 of less than half circle cross section and a circular hole. FIG. 40B shows a cross section. This may provide a comfortable grip, the broad flat side perhaps being most comfortable to push against with the palm. Two of these can be placed on opposite sides of a flat wide connecting member, with singe shear pivots, to make a tool with round shape, which when folded, can be used similar to a conventional screw driver. A constant cross section like this can be extruded of aluminum or plastic and then cut to length, making it easy to manufacture.

Figure 41A:
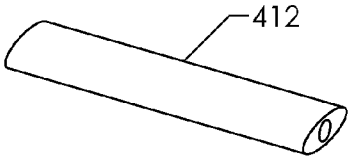
Figure 41B:
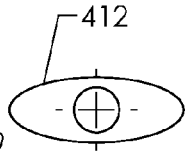

FIG. 41A shows a rotating handle 412 of elliptical cross section and a circular hole. FIG. 41B shows a cross section. This may provide a comfortable grip, the broad rounded sides being comfortable to push against. A constant cross section like this can be extruded of aluminum or plastic and then cut to length, making it easy to manufacture.

Figure 42:
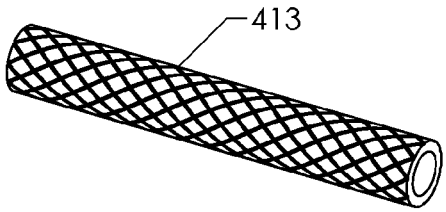

FIG. 42 shows a rotating handle 413 of circular outer cross section with a circular hole. The outer surface has a diamond pattern made by cutting two arrays of parallel spiraling or helical groves, the two arrays spiral in opposite directions in order to create the diamond pattern. The grooves width and depth is small compared to the width of the diamond. The cross section of the groove may be rectangular, trapezoidal, triangular or a half circle. The sharp edges of the diamond's face are broken slightly for a comfortable grip and so they won't easily scratch skin. The points of the diamond could also be rounded for the same purposes. This pattern has been shown to provide a good combination of comfortable grip and good transmission of grip axial forces. The diamonds provide a large area for comfort when pressing against the handle while forcefully cranking. The small grooves allow the skin to undulate into them providing good engagement for transmission of axial forces; it can be likened to gear teeth meshing. The diamond shape improves the transmission of tangential force in any direction, including the desired axial direction. The greatest improvement in transmission of tangential force is in a direction perpendicular to the long axis of the diamond.

Figure 43:
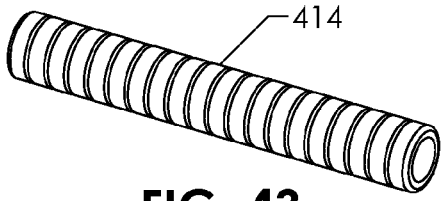

FIG. 43 shows a rotating handle 414 of circular outer cross section with a circular hole. The outer surface has an array of shallow grooves cut all the way around the handle. The grooves width and depth is small compared to the width of the flats between the grooves. The cross section of the groove may be rectangular, trapezoidal, triangular or a half circle. The sharp edges of the flats are broken slightly for a comfortable grip and so they won't easily scratch skin. The small grooves allow the skin to undulate into them providing good engagement for transmission of axial forces; it can be likened to gear teeth meshing.

Figure 44A:
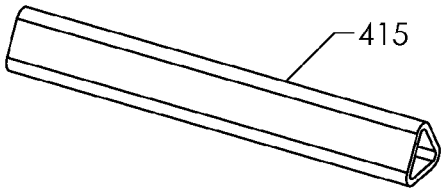
Figure 44B:
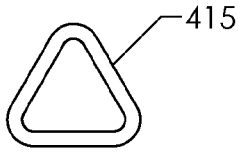

FIG. 44A shows a rotating handle 415 of triangular cross section with triangular hole. FIG. 44B shows a cross section. The triangle outer points are rounded to provide a comfortable grip. The inside triangle points are rounded so as to keep the triangular tube a substantially uniform wall thickness for uniform strength and to facilitate the extrusion process. A constant cross section like this can be extruded of aluminum or plastic and then cut to length, making it easy to manufacture. The triangular hole needs a circular cross section shaft for it to rotate on easily. It would not rotate well on say a square shaft.

Figure 45A:
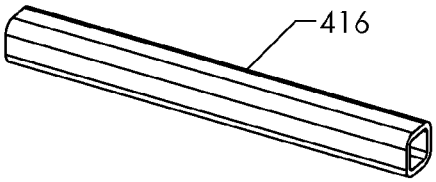
Figure 45B:
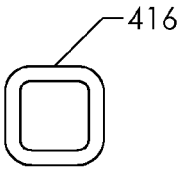

FIG. 45A shows a rotating handle 416 of square cross section with a square hole. FIG. 45B shows a cross section. The square's outer points are rounded to provide a comfortable grip. The inside square points are rounded so as to keep the square tube a substantially uniform wall thickness for uniform strength and to facilitate the extrusion process. A constant cross section like this can be extruded of aluminum or plastic and then cut to length, making it easy to manufacture. The square hole needs a circular cross section shaft for it to rotate on easily. It would not rotate well on say a square shaft.

Figure 46A:
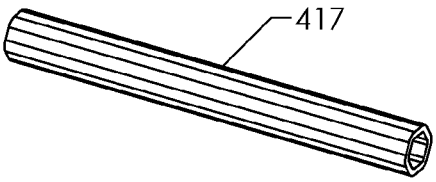
Figure 46B:
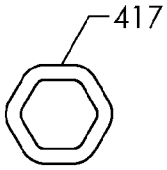

FIG. 46A shows a rotating handle 417 of hexagon cross section with hexagon hole. FIG. 46B shows a cross section. The hexagon's outer points are rounded to provide a comfortable grip. The inside hexagon's points are rounded so as to keep the hexagon tube a substantially uniform wall thickness for uniform strength and to facilitate the extrusion process. A constant cross section like this can be extruded of aluminum or plastic and then cut to length, making it easy to manufacture. The hexagon hole needs a circular cross section shaft for it to rotate on easily. It would not rotate well on say a square shaft.

It should be noted that any of the above handle designs could incorporate a texture, pattern or knurl in order to enhance transmission of the grip forces. They could also have an elastomeric outer layer incorporated to enhance transmission of the grip forces, for enhanced comfort, for styling or for coloring. Either or both of these could be used to improve the ergonomics and appearance of the tool.

DETAILED DESCRIPTION OF USE VARIATIONS

FIGS. 50A-63B

The tool can be used to rotate or drill a plurality of objects. The tool members can also be made such that they are better suited to particular uses. The purpose of this section is to help illustrate some of the various ways the tool can be made and used.

FIG. 50A shows the fourth embodiment in cranking configuration. The left input/output member has a hex bit adapter tip with a Phillips hex bit HBP in it. The right input/output member has a ¼" square drive with a ¼" drive small hex socket SQS attached. This might be used for doing light mechanical work involving Phillips tip screws and small hexagon head fasteners.

FIG. 50B is the same as 50A but with the addition of a second sliding thrust flange 53A on each input/output member. The second sliding flange 53A can be slid to the opposite end of the handle as the first sliding flange 53A. In high speed mode, if the right hand pulls lightly against the second sliding flange 53A it helps in holding the tool in that shape. Both sliding flanges 53A can be slid outboard to facilitate folding of the tool. Alternatively when applying axial force the flanges could be placed together and let rotate against each other, one turning with the input/output and the other staying fixed against the hand. This may reduce the friction.

FIG. 51 shows the fourth embodiment in cranking configuration. This is the same as FIG. 50A except that a connecting member 22C is shorter to emphasize speed, but at the expense of torque.

FIG. 52 shows the seventh embodiment in cranking configuration. In this case the input/output members are each attached to the connecting member 22B with an easily removable ball detent pin 51D. The left input/output member has a ⅜" square drive to which is attached a drill chuck adapter DCA having ⅜" square drive×⅜-24 thread (drill chuck thread) to which is attached a keyless drill chuck DC holding a twist drill bit DB. The right input/output member has a ⅜" square drive with a ⅜" drive medium size hex socket STM attached. The drill could be used to drill pilot holes in wood and then the hexagon socket for installing large hexagon head screws (lag bolts) in the holes. The projection of the drill bit does not interfere with the operator's right fore arm when using the other end of the tool with the hexagon socket to rotate and object.

An adapter for square drive to drill chuck DCA can be made adapt to multiple sizes by having stepped square sockets and threads. For example a ½" square socket with a ⅜" square socket in its bottom. The socket sides may include depressions or grooves for engagement by a retaining mechanism on the square drive. The drill chuck mounting end could have ½-20 threads inboard and then step down to ⅜-24 threads outboard, for mounting drill chucks with either ½-20 or ⅜-24 size thread. A shoulder at the base of each thread provides a stop against which the drill chuck can be tightened to help prevent its coming loose. The threaded end could also have a smaller tapped center hole, say ¼-20 left hand thread, for a left hand thread retaining screw to assist in retaining the drill chuck when it is being turned in a direction that would loosen it on its mounting threads.

The drill chuck adapter could also be made to attach to a hex bit socket adapter. The end opposite the drill chuck mounting threads would be made of hexagon shape, of a size and length to fit known hex bit socket adapter sizes. The hexagon may include a groove for use by a retaining mechanism in the mating hex bit adapter socket.

FIG. 53 shows the same components as FIG. 52 but adds a standard ⅜"×6" socket extension SET between the tools ⅜" square drive and the drill chuck adapter. This extra length increases the ability to hold the drill bit in alignment with the hole being drilled. The extension places the steady hand farther from the drill tip, so a given lateral movement causes less angular misalignment of the drill. The longer the extension, the greater the ability to hold the drill in alignment. Also, if a wobble end extension is used, it will allow the drill bit to self align with the hole as long as the extension and tool are kept within the angular limits of the wobble. The wobble may make the drill harder to start at the desired angle (perhaps normal to the work piece) but can greatly reduce the bending stress on the drill bit due to misalignment of the tool with the hole during drilling.

FIG. 54 shows the seventh embodiment in cranking configuration. The left input/output member has a ⅜" square drive with a ⅜" square drive large size hexagon socket STL. The right input/output member has a ⅜" square drive with a ⅜" drive medium size hex socket STM attached. This might be used for medium duty mechanical work involving hexagon nuts and hexagon head fasteners.

The input/output members are each attached to the connecting member 22B with the ball detent pin 51D. These are retained by a sprung ball but easily removable by pulling on the ring and easily installed by pushing into the hole. The removable ball detent pins 51D allow the input/outputs and connecting member to be easily changed. An input/output can be changed to one with of a different size, drive or tip. The connecting member 22B could be changed to a short one to emphasize speed or a long one to emphasize torque.

FIG. 55 shows the same components as FIG. 54 except that a connecting member 22D is much longer. The longer connecting member enables greater torque but at the expense of speed. This may be preferred for heavy duty applications such as large lag screws, high torque fasteners or for driving machinery.

FIG. 56A shows the twelfth embodiment in cranking configuration. The adapter hub 36A with four sizes of hexagon sockets is on the left and an adapter hub 36E with the square drive 32B, a hexagon key drive tip 37, the Phillips drive tip 31, and a Torx drive tip 35 is on the right end. This could be a special purpose tool for working on a specific piece of equipment that requires just those sockets and drive tips.

FIG. 56B shows an enlarged perspective view of the adapter hub 36E with multiple type drive tips.

FIG. 57 shows a variant of the twelfth embodiment in cranking configuration. An end shaft 20 has a clevis on each end holding the four hexagon socket adapter hubs 36A, 36B, 36C, and 36D. The two inboard adapter hubs 36C and 36D and their clevises act as the pivots between the connecting member and the input/output members. A connecting member 27 has ends that attach inside one of the sockets of each adapter. The connecting member's attachment to the adapter hubs 36C and 36D must prevent rotation about the axis of the connector and hold the pivot axes parallel. The attachment could be a square hole at the base of one of the hexagon sockets or a separate dedicated socket on the hub. The connecting member 27 could have square ends that are retained by some known means such as a locking ball detent. Either of the input/output members can be turned end for end and attached to the connecting member 27 so that any desired adapter hub and socket is outboard and available for use.

Since the end shaft 20 has a clevis on both ends, a cylindrical handle cannot be slipped over one end. The handle can be split into two parts for assembly. If made of thermo plastic material and in halves, it could be glued, heat welded or ultrasonically welded together. Handle halves could also be held together with a wrap of adhesive tape, similar to the tape on a tennis racket, baseball bat or golf club.

FIG. 58 shows the eighth embodiment in cranking configuration. The left input/output has a hex bit socket with Phillips hex bit HBP. The right input/output has a hex bit socket with a Torx hex bit HBT in it. Each input/output has a rotating handle 43 that is a small round discs which is held between two fingers and a thumb. A short connecting member 23B is for high speed and light duty work. This might be useful for very light duty work with very small Phillips and torx headed screws, such as a small electronic assembly.

FIG. 59 shows the ninth embodiment in cranking configuration. The left input/output has a hex bit socket with square drive hex bit HBSQ. The right input/output has a hex bit socket with Phillips hex bit HBP. This might be useful for light duty work with square drive and Phillips headed screws.

FIG. 60 shows the eleventh embodiment in cranking configuration. The left input/output member has a hex bit adapter tip with a square drive hex bit HBSQ in it. The right input/output member has a hex bit adapter with a Phillips hex bit in it HBP. This might be used for doing light mechanical or electronic work involving square drive and Phillips headed fasteners.

The connecting member 24 has a Torx hex bit HBT stored in one cavity 105 and a straight hex bit HBS stored in another cavity 105. Two other cavities 105 are empty and can be used for storing the two hex bits being used.

FIG. 61 shows the eleventh embodiment in folded configuration. One of the input/outputs has a hex bit socket with Phillips hex bit HBP. This can be held and used like a conventional screw driver. It might be useful for slight adjustments of a screw or for starting a screw with only one hand while holding the work piece with the other hand.

FIG. 62 shows the tenth embodiment with a short connecting member 23C about half the length of the input/output members. The short connecting member 23C emphasizes speed. It can be folded such that it can be gripped with only one hand and used much like a conventional T-wrench, if desired. One input/output is folded out for use as a T-wrench and has a torx hex bit in it HTB. The other input/output is left folded against the connecting member. The folded input/output and connecting member are grasped with one hand, like a conventional T-wrench, with two fingers on each side of the unfolded input/output. The middle of the folded input/output handle bears against the pivot end fitting of the folded out input/output handle to transmit axial force from the grip though to urge engagement with the object to be rotated. This illustrates one of the multitude of ways the tool can be used, which is in addition to those previously described for the standard operation of the embodiments.

FIG. 63A shows a variant of the seventh embodiment with connecting member having multiple links. It is shown in cranking configuration with a square drive large hex socket STL on the left end and nothing on the right end. The end member shafts and long center link are all made from the same 7" long×⅜" square section steel bar blanks. All the holes for the pivot pin, shoulder washer retaining pins and ball detent are drilled from the same side of the bar. The four short links are made from ⅛"×⅜×1⅛" long blanks. It holes could be punched, drilled or lasered. The links are riveted to the other members but such that all the joints are still free to pivot. The shoulder washers with square holes are retained by groove pins or similar self retained pins. The handle is made of simple round steel tubing. This design uses very economical raw material and requires no lathe work, only drilling. The multiple links make it harder to hold a desired configuration shape during use but do allow the tool to fold compactly. It is shown without pivot rotation stops and the links make their design awkward.

FIG. 63B shows the tool of FIG. 63A in folded configuration without the socket.

CONCLUSIONS, RAMIFICATIONS, AND SCOPE

Thus some embodiments have been described of a new and useful tool for imparting rotary motion to an object via human power which improves over existing tools. It allows the speed, torque, and direction of rotation to be easily varied. The two handle design provides a handle for keeping the tool aligned and engaged with the object to be rotated and a second handle to more comfortably create the rotary motion and torque. It allows the tool to be used end for end so that either end of the tool can be used to rotate an object. The tool can have various outer end configurations such that it can be used alone to engage and rotate an object or it can be configured to accept various adapters which engage and rotate an object. The pivoted members allow the tool to be fluidly be repositioned into various shapes for high speed rotation, more torque, maximum torque or folded compactly. It can even be made and positioned so as to be used as a standard screwdriver or T-wrench. The tool members can be shaped and sized to emphasize speed, torque, compactness or strength. The tool is quiet to operate and needs no power source.

The scope of the application should be determined by the appended claims and their legal equivalents, and not just by the examples given.

I claim:

1. For applying rotary motion, torque, and or axial force to a first object or a second object via human power, a tool comprising:

a. a first handle of sufficient size, shape and length to allow it to be grasped by a hand and or fingers and or thumb, with through hole to allow mounting on a shaft, b. a second handle of sufficient size, shape and length to allow it to be grasped by a hand and or fingers and or thumb, with through hole to allow mounting on a shaft, c. a first elongated input/output shaft of sufficient length and suitable girth to accept said first handle, having an outer disposed end with first means to couple to said first object to be rotated or to accept an adapter which will couple it to said first object to be rotated and having an inner disposed end with second means to pivotably connect it to another member, the axis of pivot being substantially perpendicular to the shaft's major axis, d. a second elongated input/output shaft of sufficient length and suitable girth to accept said second handle, having an outer disposed end with third means to couple it to said second object to be rotated or to accept an adapter which will couple it to said second object to be rotated and having an inner disposed end with fourth means to pivotably connect it to another member, the axis of pivot being substantially perpendicular to the shaft's major axis, e. a fifth means for said first handle to be rotationally and axially coupled to said first input/output shaft, f. a sixth means for said second handle to be rotationally and axially coupled to said second input/output shaft, g. an elongated connecting member which has seventh means on the first end and eighth means on the second end to pivotably connect it to said first input/output shaft on one end and said second input/output shaft on the other end, the two axis of pivoting to be substantially parallel, each of the two axis of pivoting to be substantially perpendicular to the member's main axis, of sufficient length to allow either of said input/output shaft to be orbited about the axis of the other input/output shaft, h. a ninth means for joining one end of said connecting member's first end to said first input/output shaft's inner disposed end and a tenth means for joining said connecting member's second end to said second input output shaft's inner disposed end, so as to allow each of them to pivot with respect to the connecting member, such that while pivoting, the first input/output member and second input/output member remain in substantially the same plane or in closely adjacent parallel planes, whereby the handle of either the first or second input/output member is grasped by a first hand and or fingers and or thumb and acts as a steadying handle to effect alignment with said first or second object to be rotated or an adapter that couples it to said first or second object to be rotated and simultaneously applies a primary axial force urging engagement with said first or second object to be rotated and the handle of the other second or first input/output member respectively is grasped by a second hand and or fingers and or thumb and acts as an input handle which when placed in a plurality of positions with respect to said first member and said connecting member, is orbited in such a way as to vary the rotational speed and torque applied to said first or second input/output member and through to the coupled object to be rotated.

2. For applying rotary motion, torque, and or axial force to a first object or a second object via human power, a tool comprising:

a. a first handle of sufficient size, shape and length to allow it to be grasped by a hand and or fingers and or thumb, with through hole to allow mounting on a shaft, b. a second handle of sufficient size, shape and length to allow it to be grasped by a hand and or fingers and or thumb, with through hole to allow mounting on a shaft, c. a first elongated input/output shaft of sufficient length and suitable girth to accept said first handle, having an outer disposed end with first means to couple to said first object to be rotated or to accept an adapter which will couple it to said first object to be rotated and having an inner disposed end with second means to pivotably connect it to another member, the axis of pivot being substantially perpendicular to the shaft's major axis, d. a second elongated input/output shaft of sufficient length and suitable girth to accept said second handle, having an outer disposed end with third means to couple it to said second object to be rotated or to accept an adapter which will couple it to said second object to be rotated and having an inner disposed end with fourth means to pivotably connect it to another member, the axis of pivot being substantially perpendicular to the shaft's major axis, e. a fifth means for said first handle to be rotationally and axially coupled to said first input/output shaft, f. a sixth means for said second handle to be rotationally and axially coupled to said second input/output shaft, g. an elongated connecting member which has seventh means on the first end and eighth means on the second end to pivotably connect it to said first input/output shaft on one end and said second input/output shaft on the other end, the two axis of pivoting to be substantially parallel, each of the two axis of pivoting to be substantially perpendicular to the member's main axis, of sufficient length to allow either of said input/output shaft to be orbited about the axis of the other input/output shaft, h. a ninth means for joining one end of said connecting member's first end to said first input/output shaft's inner disposed end and a tenth means for joining said connecting member's second end to said second input output shaft's inner disposed end, so as to allow each of them to pivot with respect to the connecting member, such that while pivoting, the first input/output member and second input/output member remain in substantially the same plane or in closely adjacent parallel planes, i. a pivot rotation stop means, such that the range of pivoting between said connecting member and of each said input/output member is limited to respective predetermined angles between them, whereby the handle of either the first or second input/output member is grasped by a first hand and or fingers and or thumb and acts as a steadying handle to effect alignment with said first or second object to be rotated or an adapter that couples it to said first or second object to be rotated and simultaneously applies a primary axial force urging engagement with said first or second object to be rotated and the handle of the other second or first input/output member respectively is grasped by a second hand and or fingers and or thumb and acts as an input handle which when placed in a plurality of positions with respect to said first member and said connecting member, is orbited in such a way as to vary the rotational speed and torque applied to said first or second input/output member and through to the coupled object to be rotated and said second grasp can push axially on said second or first handle producing a secondary axial force which is transmitted through said pivot and or its said pivot rotation stop means to said connecting member, through the other said pivot and or its said pivot rotation stop means to said first or second input/output member grasped by said first hand, said secondary axial force is in addition to the primary axial force being applied directly to the input/output by said first grasp and both primary and secondary axial forces urging coupling engagement with the object being rotated.

3. The tool of claim 2 wherein both of said connecting member's ends are angled in opposite directions from the member's mid section, forming a substantially short ended and elongated Z shape, so that the pivot axes are located offset of the main centerline of said connecting member's mid section a respective predetermined distance, and such that said pivot axes of the two ends remain substantially parallel, said pivot axes being substantially perpendicular to the approximate longitudinal midplane of the connecting member, whereby said offset pivot axes allows both of said input/output members to fold in toward said connecting member's mid section such that said tool will then fit in a more compact volume.

4. The tool of claim 2 wherein one or both of said input/output members have their inner disposed pivoting end angled, formed, or bent so that their pivot axis is offset of the centerline of the member's main body, the axis being substantially perpendicular to the approximate longitudinal midplane of the member, whereby the offset axis allows one or both of said input/output members to fold in toward the connecting member's mid section such that the tool will then fit in a more compact volume.

5. The tool of claim 2 wherein one or both of said connecting member's ends are angled, formed, or bent so that the pivot axes are located offset of the main centerline of the connecting member's mid section a respective predetermined distance, if both axis are offset then each being offset from the centerline in a direction opposite the other and such that the pivot axes of the two ends remain substantially parallel, the axes are substantially perpendicular to the approximate longitudinal midplane of the connecting member, where one or both of said input/output members have their inner disposed pivot end angled, formed or bent so that their pivot axis is offset of the centerline of the member's main body, the axis being substantially perpendicular to the approximate longitudinal midplane of the member, whereby said offset pivot axes allows one or both of said input/output members to fold in toward said connecting member's mid section such that said tool will then fit in a more compact volume.

6. The tool of claim 2 further including a means to reduce the friction of said rotationally and axially coupling of said handle to said shaft, the means including but not limited to one or more radial or thrust bearing of ball or roller type, thrust washer, sleeve bushing or flange bushing, placed between the input/output shaft and the handle, in the handle end or next to the handle end, whereby more of the operator's effort and energy is converted into rotational speed and torque and less is lost to friction.

7. The tool of claim 2 further including a clevis on the end of one of both of said input/output shafts, the clevis having a rotatably mounted hub which has a plurality of adapters, whereby any of the adapters on either of one or both of said hubs can be used to engage an object to be rotated by rotating or indexing said hub so that the desired adapter is accessible and in the desired position in relation to the input/output shaft.

8. The tool of claim 2 wherein said input/output members both pivot in a plane adjacent and parallel to the longitudinal plane of the connecting member which is substantially perpendicular to the pivot axes and the connecting member and said handles are individually shaped such that when folded they form a substantially compact shape, whereby such compact folded shape can be grasped and used similar to a known standard screw driver.

9. The tool of claim 2 further including a sliding thrust flange on each said handle and a shoulder at each end of said handles, said sliding thrust flange having an inside diameter large enough that it can slide over and along said handle and said shoulders are large enough to stop the sliding thrust flange, whereby said sliding thrust flange can be slid up against either said shoulder and with the users gripping hand against said sliding thrust flange, such that the user can impart axial force to said tool through either of said sliding thrust flanges and said sliding thrust flanges can both be slid to their respective outboard positions to facilitate compact folding of said tool for storage.

10. A hand tool for generating and applying a smoothly variable combination of rotary motion, torque and axial force to an object, comprising:

a. a first shaft of predetermined length with a first drive on its outer disposed end and means to pivotably connect its inner disposed end to a connecting member and means to rotatably and axially couple with a first handle, b. said first handle with means to be rotatably and axially coupled on said first shaft, c. said connecting member of predetermined length with means at each end to pivotably connect to said first input/output shaft and a second input/output shaft such that when pivoted, both said shafts remain in substantially the same plane or parallel planes, d. said second shaft of predetermined length with a second drive on its outer disposed end and means to pivotably connect its inner disposed end to said connecting member and means to rotatably and axially couple with a second handle, e. said second handle with means to be rotatably and axially coupled on said second shaft.

* * * * *